US009916713B1

(12) United States Patent
Yacoubian et al.

(10) Patent No.: US 9,916,713 B1
(45) Date of Patent: Mar. 13, 2018

(54) SYSTEMS, METHODS AND DEVICES FOR PROCESSING COINS UTILIZING NORMAL OR NEAR-NORMAL AND/OR HIGH-ANGLE OF INCIDENCE LIGHTING

(71) Applicant: Cummins-Allison Corp., Mt. Prospect, IL (US)

(72) Inventors: Araz Yacoubian, Carlsbad, CA (US); Danny D. Yang, San Diego, CA (US); Tomasz M. Jagielinksi, Carlsbad, CA (US); Frank M. Csulits, Gurnee, IL (US); Gary P. Watts, Buffalo Grove, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 15/356,295

(22) Filed: Nov. 18, 2016

Related U.S. Application Data

(63) Continuation-in-part of application No. 14/794,262, filed on Jul. 8, 2015, now Pat. No. 9,501,885.
(Continued)

(51) Int. Cl.
*G07D 3/14* (2006.01)
*G07D 11/00* (2006.01)
*G07D 5/00* (2006.01)

(52) U.S. Cl.
CPC ..... *G07D 11/0036* (2013.01); *G07D 3/14* (2013.01); *G07D 5/005* (2013.01)

(58) Field of Classification Search
CPC ..... G07D 5/005; G07D 3/14; G07D 5/00; G07D 11/003; G07D 2205/00
See application file for complete search history.

(56) References Cited

U.S. PATENT DOCUMENTS 1,099,706 A 6/1914 Lindeen ..... 141/298
2,570,920 A 10/1951 Clough et al. ..... 232/16
(Continued)

FOREIGN PATENT DOCUMENTS

CA 2235925 C 11/1995 ..... G07D 9/00
CA 2189330 C 12/2000 ..... G07F 17/42
(Continued)

OTHER PUBLICATIONS

English Translation of Japanese Publication JP-09-44641-A, dated Feb. 14, 1997 (9 pages).*
(Continued)

*Primary Examiner* — Mark J Beauchaine
(74) *Attorney, Agent, or Firm* — Greer, Burns & Crain, Ltd

(57) ABSTRACT

Currency processing systems, coin processing machines, and methods of imaging coins are presented herein. A currency processing system is disclosed which includes a housing with an input area for receiving coins and receptacles for stowing processed coins. A disk-type coin processing unit is coupled to the coin input area and coin receptacles. The coin processing unit includes a rotatable disk for imparting motion to coins, and a sorting head adjacent the rotatable disk with shaped regions for guiding moving coins to exit channels through which the coins are discharged to the coin receptacles. A sensor arrangement mounted adjacent the rotatable disk includes one light emitting device for emitting light onto a coin surface at near-normal incidence. A photodetector senses light reflected off the coin surface and outputs a coin-image signal for processing the coin.

17 Claims, 12 Drawing Sheets

Related U.S. Application Data

(60) Provisional application No. 62/022,373, filed on Jul. 9, 2014.

(56) References Cited

U.S. PATENT DOCUMENTS

| | | | | |
|---|---|---|---|---|
| 2,669,998 | A | 2/1954 | Buchholz | 133/8 |
| 2,750,949 | A | 6/1956 | Kulo et al. | 133/8 |
| 2,835,260 | A | 5/1958 | Buchholz | 133/8 |
| 2,865,561 | A | 12/1958 | Rosapepe | 232/7 |
| 3,132,654 | A | 5/1964 | Adams | 133/1 |
| 3,376,970 | A | 4/1968 | Roseberg | 198/40 |
| 3,771,583 | A | 11/1973 | Bottemiller | 160/327 |
| 3,778,595 | A | 12/1973 | Hatanaka et al. | 235/61.7 B |
| 3,851,755 | A | 12/1974 | Hull et al. | 206/0.82 |
| 3,916,922 | A | 11/1975 | Prumm | 133/3 R |
| 3,998,237 | A | 12/1976 | Kressin | 133/3 A |
| 3,998,379 | A | 12/1976 | Myers et al. | 229/33 |
| 4,050,218 | A | 9/1977 | Call | 53/167 |
| 4,059,122 | A | 11/1977 | Kinoshita | 133/3 D |
| 4,075,460 | A | 2/1978 | Gorgens | 235/420 |
| 4,124,111 | A | 11/1978 | Hayashi | 194/102 |
| 4,150,740 | A | 4/1979 | Douno | 194/4 C |
| 4,166,945 | A | 9/1979 | Inoyama et al. | 235/379 |
| 4,172,462 | A | 10/1979 | Uchida et al. | 133/3 A |
| 4,179,685 | A | 12/1979 | O'Maley | 340/146.3 H |
| 4,179,723 | A | 12/1979 | Spencer | 361/384 |
| 4,184,366 | A | 1/1980 | Butler | 73/163 |
| 4,197,986 | A | 4/1980 | Nagata | 235/379 |
| 4,208,549 | A | 6/1980 | Polillo et al. | 179/6.3 R |
| 4,228,812 | A | 10/1980 | Marti | 133/3 F |
| 4,232,295 | A | 11/1980 | McConnell | 340/152 R |
| 4,234,003 | A | 11/1980 | Ristvedt et al. | 133/3 |
| 4,249,552 | A | 2/1981 | Margolin et al. | 133/1 R |
| 4,251,867 | A | 2/1981 | Uchida et al. | 364/408 |
| 4,286,703 | A | 9/1981 | Schuller et al. | 194/100 A |
| RE30,773 | E | 10/1981 | Glaser et al. | 235/379 |
| 4,310,885 | A | 1/1982 | Azcua et al. | 364/405 |
| 4,317,957 | A | 3/1982 | Sendrow | 178/22.08 |
| 4,341,951 | A | 7/1982 | Benton | 235/379 |
| 4,355,369 | A | 10/1982 | Garvin | 364/900 |
| 4,360,034 | A | 11/1982 | Davila et al. | 133/3 D |
| 4,369,442 | A | 1/1983 | Werth et al. | 340/825.35 |
| 4,380,316 | A | 4/1983 | Glinka et al. | 232/16 |
| 4,383,540 | A | 5/1983 | DeMeyer et al. | 133/3 H |
| 4,385,285 | A | 5/1983 | Horst et al. | 382/3 |
| 4,412,292 | A | 10/1983 | Sedam et al. | 364/479 |
| 4,416,299 | A | 11/1983 | Bergman | 133/1 R |
| 4,417,136 | A | 11/1983 | Rushby et al. | 235/379 |
| 4,423,316 | A | 12/1983 | Sano et al. | 235/379 |
| 4,434,359 | A | 2/1984 | Watanabe | 235/379 |
| 4,436,103 | A | 3/1984 | Dick | 133/3 D |
| 4,454,414 | A | 6/1984 | Benton | 235/379 |
| 4,474,197 | A | 10/1984 | Kinoshita et al. | 133/4 A |
| 4,488,116 | A | 12/1984 | Plesko | 324/236 |
| 4,531,531 | A | 7/1985 | Johnson et al. | 133/3 |
| 4,543,969 | A | 10/1985 | Rasmussen | 133/3 |
| 4,549,561 | A | 10/1985 | Johnson et al. | 133/3 |
| 4,556,140 | A | 12/1985 | Okada | 194/4 C |
| 4,558,711 | A | 12/1985 | Yoshiaki et al. | 133/3 F |
| 4,564,036 | A | 1/1986 | Ristvedt | 133/3 |
| 4,570,655 | A | 2/1986 | Raterman | 133/3 |
| 4,594,664 | A | 6/1986 | Hashimoto | 364/405 |
| 4,602,332 | A | 7/1986 | Hirose et al. | 364/408 |
| 4,607,649 | A | 8/1986 | Taipale et al. | 133/3 C |
| 4,620,559 | A | 11/1986 | Childers et al. | 133/3 R |
| 4,641,239 | A | 2/1987 | Takesako | 364/408 |
| 4,674,260 | A | 6/1987 | Rasmussen et al. | 53/212 |
| 4,681,128 | A | 7/1987 | Ristvedt et al. | 453/6 |
| 4,705,154 | A | 11/1987 | Masho et al. | 194/319 |
| 4,718,218 | A | 1/1988 | Ristvedt | 53/532 |
| 4,731,043 | A | 3/1988 | Ristvedt et al. | 453/6 |
| 4,733,765 | A | 3/1988 | Watanabe | 194/206 |
| 4,749,074 | A | 6/1988 | Ueki et al. | 194/317 |
| 4,753,624 | A | 6/1988 | Adams et al. | 453/10 |
| 4,753,625 | A | 6/1988 | Okada | 453/32 |
| 4,765,464 | A | 8/1988 | Ristvedt | 206/0.82 |
| 4,766,548 | A | 8/1988 | Cedrone et al. | 364/479 |
| 4,775,353 | A | 10/1988 | Childers et al. | 453/6 |
| 4,775,354 | A | 10/1988 | Rasmussen et al. | 453/10 |
| 4,778,983 | A | 10/1988 | Ushikubo | 235/381 |
| 4,803,347 | A | 2/1989 | Sugahara et al. | 235/379 |
| 4,804,830 | A | 2/1989 | Miyagisima et al. | 235/379 |
| 4,812,629 | A | 3/1989 | O'Neil et al. | 235/383 |
| 4,839,505 | A | 6/1989 | Bradt et al. | 235/381 |
| 4,840,290 | A | 6/1989 | Nakamura et al. | 221/10 |
| 4,844,369 | A | 7/1989 | Kanayachi | 242/56 R |
| 4,848,556 | A | 7/1989 | Shah et al. | 194/212 |
| 4,863,414 | A | 9/1989 | Ristvedt et al. | 453/6 |
| 4,883,158 | A | 11/1989 | Kobayashi et al. | 194/217 |
| 4,884,212 | A | 11/1989 | Stutsman | 364/479 |
| 4,900,909 | A | 2/1990 | Nagashima et al. | 235/487 |
| 4,908,516 | A | 3/1990 | West | 250/556 |
| 4,921,463 | A | 5/1990 | Primdahl et al. | 453/3 |
| 4,936,435 | A | 6/1990 | Griner | 194/317 |
| 4,953,086 | A | 8/1990 | Fukatsu | 364/408 |
| 4,954,697 | A | 9/1990 | Kokubun et al. | 235/381 |
| 4,964,495 | A | 10/1990 | Rasmussen | 194/344 |
| 4,966,570 | A | 10/1990 | Ristvedt et al. | 453/6 |
| 4,970,655 | A | 11/1990 | Winn et al. | 364/479 |
| 4,971,187 | A | 11/1990 | Furuya et al. | 194/318 |
| 4,988,849 | A | 1/1991 | Sasaki et al. | 235/379 |
| 4,992,647 | A | 2/1991 | Konishi et al. | 235/379 |
| 4,995,848 | A | 2/1991 | Goh | 453/3 |
| 5,009,627 | A | 4/1991 | Rasmussen | 453/10 |
| 5,010,238 | A | 4/1991 | Kadono et al. | 235/379 |
| 5,010,485 | A | 4/1991 | Bigari | 364/408 |
| 5,011,455 | A | 4/1991 | Rasmussen | 453/10 |
| 5,022,889 | A | 6/1991 | Ristvedt et al. | 453/6 |
| 5,025,139 | A | 6/1991 | Halliburton, Jr. | 235/379 |
| 5,026,320 | A | 6/1991 | Rasmussen | 453/6 |
| 5,031,098 | A | 7/1991 | Miller et al. | 364/405 |
| 5,033,602 | A | 7/1991 | Saarinen et al. | 194/334 |
| 5,039,848 | A | 8/1991 | Stoken | 235/381 |
| 5,055,086 | A | 10/1991 | Raterman et al. | 453/10 |
| 5,055,657 | A | 10/1991 | Miller et al. | 235/381 |
| 5,056,643 | A | 10/1991 | Kirberg | 194/202 |
| 5,064,999 | A | 11/1991 | Okamoto et al. | 235/379 |
| 5,067,928 | A | 11/1991 | Harris | 453/17 |
| 5,080,633 | A | 1/1992 | Ristvedt et al. | 435/6 |
| 5,091,713 | A | 2/1992 | Horne et al. | 340/541 |
| 5,104,353 | A | 4/1992 | Ristvedt et al. | 453/6 |
| 5,105,601 | A | 4/1992 | Horiguchi et al. | 53/465 |
| 5,106,338 | A | 4/1992 | Rasmussen et al. | 453/10 |
| 5,111,927 | A | 5/1992 | Schulze | 194/209 |
| 5,114,381 | A | 5/1992 | Ueda et al. | 453/57 |
| 5,120,945 | A | 6/1992 | Nishibe et al. | 235/379 |
| 5,123,873 | A | 6/1992 | Rasmussen | 453/10 |
| 5,129,205 | A | 7/1992 | Rasmussen | 53/52 |
| 5,135,435 | A | 8/1992 | Rasmussen | 453/56 |
| 5,140,517 | A | 8/1992 | Nagata et al. | 364/408 |
| 5,141,443 | A | 8/1992 | Rasmussen et al. | 453/10 |
| 5,141,472 | A | 8/1992 | Todd et al. | 453/10 |
| 5,145,455 | A | 9/1992 | Todd | 453/6 |
| 5,146,067 | A | 9/1992 | Sloan et al. | 235/381 |
| 5,154,272 | A | 10/1992 | Nishiumi et al. | 194/318 |
| 5,163,866 | A | 11/1992 | Rasmussen | 453/10 |
| 5,163,867 | A | 11/1992 | Rasmussen | 453/10 |
| 5,163,868 | A | 11/1992 | Adams et al. | 453/11 |
| 5,167,313 | A | 12/1992 | Dobbins et al. | 194/317 |
| 5,175,416 | A | 12/1992 | Mansvelt et al. | 235/379 |
| 5,176,565 | A | 1/1993 | Ristvedt et al. | 453/6 |
| 5,179,517 | A | 1/1993 | Sarbin et al. | 364/410 |
| 5,183,142 | A | 2/1993 | Latchinian et al. | 194/206 |
| 5,184,709 | A | 2/1993 | Nishiumi et al. | 194/318 |
| 5,194,037 | A | 3/1993 | Jones et al. | 453/10 |
| 5,197,919 | A | 3/1993 | Geib et al. | 453/10 |
| 5,205,780 | A | 4/1993 | Rasmussen | 453/10 |
| 5,207,784 | A | 5/1993 | Schwartzendruber | 221/6 |
| 5,209,696 | A | 5/1993 | Rasmussen et al. | 453/10 |
| 5,236,071 | A | 8/1993 | Lee | 194/200 |
| 5,243,174 | A | 9/1993 | Veeneman et al. | 235/381 |
| 5,251,738 | A | 10/1993 | Dabrowski | 194/206 |
| 5,252,811 | A | 10/1993 | Henochowicz et al. | 235/379 |
| 5,253,167 | A | 10/1993 | Yoshida et al. | 364/408 |

(56) References Cited

U.S. PATENT DOCUMENTS 5,259,491 A 11/1993 Ward, II ..... 194/350
5,263,566 A 11/1993 Nara et al. ..... 194/318
5,265,874 A 11/1993 Dickinson et al. ..... 273/138 A
5,268,561 A 12/1993 Kimura et al. ..... 235/384
5,277,651 A 1/1994 Rasmussen et al. ..... 453/10
5,282,127 A 1/1994 Mii ..... 364/130
5,286,226 A 2/1994 Rasmussen ..... 453/10
5,286,954 A 2/1994 Sato et al. ..... 235/379
5,291,003 A 3/1994 Avnet et al. ..... 235/381
5,291,560 A 3/1994 Daugman ..... 382/2
5,293,981 A 3/1994 Abe et al. ..... 194/345
5,297,030 A 3/1994 Vassigh et al. ..... 364/405
5,297,598 A 3/1994 Rasmussen ..... 141/314
5,297,986 A 3/1994 Ristvedt et al. ..... 453/6
5,299,977 A 4/1994 Mazur et al. ..... 453/10
5,302,811 A 4/1994 Fukatsu ..... 235/381
5,324,922 A 6/1994 Roberts ..... 235/375
5,326,104 A 7/1994 Pease et al. ..... 273/138 A
5,370,575 A 12/1994 Geib et al. ..... 453/3
5,372,542 A 12/1994 Geib et al. ..... 453/10
5,374,814 A 12/1994 Kako et al. ..... 235/379
5,379,344 A 1/1995 Larson et al. ..... 380/23
5,379,875 A 1/1995 Shames et al. ..... 194/317
5,382,191 A 1/1995 Rasmussen ..... 453/11
5,390,776 A 2/1995 Thompson ..... 194/346
5,401,211 A 3/1995 Geib et al. ..... 453/10
5,404,986 A 4/1995 Hossfield et al. ..... 194/317
5,410,590 A 4/1995 Blood et al. ..... 379/147
RE34,934 E 5/1995 Raterman et al. ..... 453/10
5,425,669 A 6/1995 Geib et al. ..... 453/10
5,429,550 A 7/1995 Mazur et al. ..... 453/10
5,440,108 A 8/1995 Tran et al. ..... 235/381
5,443,419 A 8/1995 Adams et al. ..... 453/17
5,450,938 A 9/1995 Rademacher ..... 194/206
5,453,047 A 9/1995 Mazur et al. ..... 453/10
5,458,285 A 10/1995 Remien ..... 232/15
5,468,182 A 11/1995 Geib ..... 453/10
5,470,079 A 11/1995 LeStrange et al. ..... 273/138 A
5,474,495 A 12/1995 Geib et al. ..... 453/3
5,474,497 A 12/1995 Jones et al. ..... 453/17
5,480,348 A 1/1996 Mazur et al. ..... 453/10
5,489,237 A 2/1996 Geib et al. ..... 453/12
5,500,514 A 3/1996 Veeneman et al. ..... 235/381
5,501,631 A 3/1996 Mennie et al. ..... 453/3
5,507,379 A 4/1996 Mazur et al. ..... 194/318
5,514,034 A 5/1996 Jones et al. ..... 453/10
5,520,577 A 5/1996 Rasmussen ..... 453/56
5,531,309 A 7/1996 Kloss et al. ..... 194/202
5,538,468 A 7/1996 Ristvedt et al. ..... 453/3
5,542,880 A 8/1996 Geib et al. ..... 453/10
5,542,881 A 8/1996 Geib ..... 453/10
5,553,320 A 9/1996 Matsuura et al. ..... 235/379
5,559,887 A 9/1996 Davis et al. ..... 380/24
5,564,546 A 10/1996 Molbak et al. ..... 194/216
5,564,974 A 10/1996 Mazur et al. ..... 453/10
5,564,978 A 10/1996 Jones et al. ..... 453/17
5,570,465 A 10/1996 Tsakanikas ..... 395/114
5,573,457 A 11/1996 Watts et al. ..... 453/31
5,584,758 A 12/1996 Geib ..... 453/10
5,592,377 A 1/1997 Lipkin ..... 395/242
5,602,933 A 2/1997 Blackwell et al. ..... 382/116
5,615,625 A 4/1997 Cassidy et al. ..... 109/45
5,620,079 A 4/1997 Molbak ..... 194/217
5,623,547 A 4/1997 Jones et al. ..... 380/24
5,625,562 A 4/1997 Veeneman et al. ..... 364/479.05
5,630,494 A 5/1997 Strauts ..... 194/317
5,641,050 A 6/1997 Smith et al. ..... 194/210
5,650,605 A 7/1997 Morioka et al. ..... 235/379
5,650,761 A 7/1997 Gomm et al. ..... 235/381
5,652,421 A 7/1997 Veeneman et al. ..... 235/381
5,665,952 A 9/1997 Ziarno ..... 235/380
5,679,070 A 10/1997 Ishida et al. ..... 453/41
5,684,597 A 11/1997 Hossfield et al. ..... 356/384
5,696,366 A 12/1997 Ziarno ..... 235/380
5,743,373 A 4/1998 Strauts ..... 194/318
5,746,299 A 5/1998 Molbak et al. ..... 194/200
5,774,874 A 6/1998 Veeneman et al. ..... 705/27
5,782,686 A 7/1998 Geib et al. ..... 453/10
5,799,767 A 9/1998 Molbak ..... 194/217
5,813,510 A 9/1998 Rademacher ..... 194/206
5,823,315 A 10/1998 Hoffman et al. ..... 194/203
5,830,054 A 11/1998 Petri ..... 453/5
5,838,812 A 11/1998 Pare, Jr. et al. ..... 382/115
5,842,188 A 11/1998 Ramsey et al. ..... 705/416
5,842,916 A 12/1998 Gerrity et al. ..... 453/57
5,850,076 A 12/1998 Morioka et al. ..... 235/379
5,854,581 A 12/1998 Mori et al. ..... 235/379
5,865,673 A * 2/1999 Geib ..... G07D 3/128 194/346
5,875,879 A 3/1999 Hawthorn ..... 194/350
5,880,444 A 3/1999 Shibata et al. ..... 235/379
5,892,211 A 4/1999 Davis et al. ..... 235/380
5,892,827 A 4/1999 Beach et al. ..... 380/24
5,909,793 A 6/1999 Beach et al. ..... 194/210
5,909,794 A 6/1999 Molbak et al. ..... 194/216
5,913,399 A 6/1999 Takemoto et al. ..... 194/200
5,918,748 A 7/1999 Clark et al. ..... 209/534
5,940,623 A 8/1999 Watts et al. ..... 395/712
5,941,364 A 8/1999 Wei ..... 194/350
5,944,162 A 8/1999 Filiberti ..... 194/204
5,944,600 A 8/1999 Zimmermann ..... 435/10
5,944,601 A 8/1999 Hayashi et al. ..... 453/61
5,951,476 A 9/1999 Beach et al. ..... 600/437
5,957,262 A 9/1999 Molbak et al. ..... 194/200
5,988,348 A 11/1999 Martin et al. ..... 194/317
5,995,949 A 11/1999 Morioka et al. ..... 705/43
5,997,395 A 12/1999 Geib et al. ..... 453/10
6,017,270 A 1/2000 Ristvedt et al. ..... 453/5
6,021,883 A 2/2000 Casanova et al. ..... 194/217
6,032,859 A 3/2000 Muehlberger et al. ..... 235/449
6,039,644 A 3/2000 Geib et al. ..... 453/10
6,039,645 A 3/2000 Mazur ..... 453/10
6,042,470 A 3/2000 Geib et al. ..... 453/10
6,047,807 A 4/2000 Molbak ..... 194/217
6,047,808 A 4/2000 Neubarth et al. ..... 194/317
6,056,104 A 5/2000 Neubarth et al. ..... 194/317
6,068,194 A 5/2000 Mazur ..... 235/492
6,080,056 A 6/2000 Karlsson ..... 453/3
6,082,519 A 7/2000 Martin et al. ..... 194/350
6,086,471 A 7/2000 Zimmermann ..... 453/3
6,095,313 A 8/2000 Molbak et al. ..... 194/344
6,116,402 A 9/2000 Beach et al. ..... 194/216
6,131,625 A 10/2000 Casanova et al. ..... 141/314
6,139,418 A 10/2000 Geib et al. ..... 453/10
6,142,285 A 11/2000 Panzeri et al. ..... 194/328
6,145,738 A 11/2000 Stinson et al. ..... 235/379
6,154,879 A 11/2000 Pare, Jr. et al. ..... 902/3
6,168,001 B1 1/2001 Davis ..... 194/200
6,171,182 B1 1/2001 Geib et al. ..... 453/10
6,174,230 B1 1/2001 Gerrity et al. ..... 453/57
6,196,371 B1 3/2001 Martin et al. ..... 194/317
6,196,913 B1 3/2001 Geib et al. ..... 453/10
6,202,006 B1 3/2001 Scott ..... 700/231
6,213,277 B1 4/2001 Blad et al. ..... 194/350
6,230,928 B1 5/2001 Hanna et al. ..... 221/13
6,264,545 B1 7/2001 Magee et al. ..... 453/3
6,308,887 B1 10/2001 Korman et al. ..... 235/379
6,318,536 B1 11/2001 Korman et al. ..... 194/217
6,318,537 B1 11/2001 Jones et al. ..... 194/346
6,349,972 B1 2/2002 Geiger et al. ..... 283/67
6,386,323 B1 5/2002 Ramachandran et al. ..... 186/36
6,412,620 B1 7/2002 Imura ..... 194/317
6,431,342 B1 8/2002 Schwartz ..... 194/346
6,438,230 B1 8/2002 Moore ..... 380/42
6,456,928 B1 9/2002 Johnson ..... 701/114
6,471,030 B1 10/2002 Neubarth et al. ..... 194/317
6,474,548 B1 11/2002 Montross et al. ..... 235/379
6,484,863 B1 11/2002 Molbak ..... 194/216
6,484,884 B1 11/2002 Gerrity et al. ..... 209/233
6,494,776 B1 12/2002 Molbak ..... 453/32
6,499,277 B1 12/2002 Warner et al. ..... 53/447
6,503,138 B2 1/2003 Spoehr et al. ..... 453/10
6,520,308 B1 2/2003 Martin et al. ..... 194/317
6,522,772 B1 2/2003 Morrison et al. ..... 382/124

(56) References Cited

U.S. PATENT DOCUMENTS 6,547,131 B1 4/2003 Foodman et al. ..... 235/380
6,552,781 B1 4/2003 Rompel et al. ..... 256/71
6,554,185 B1 4/2003 Montross et al. ..... 235/379
6,579,165 B2 6/2003 Kuhlin et al. ..... 453/3
6,581,042 B2 6/2003 Pare, Jr. et al. ..... 705/40
6,602,125 B2 8/2003 Martin ..... 453/12
6,609,604 B1 * 8/2003 Jones ..... G07D 3/06 194/302
6,612,921 B2 9/2003 Geib et al. ..... 453/13
6,637,576 B1 10/2003 Jones et al. ..... 194/216
6,640,956 B1 11/2003 Zwieg et al. ..... 194/328
6,644,696 B2 11/2003 Brown et al. ..... 283/67
6,652,380 B1 11/2003 Luciano ..... 463/25
6,655,585 B2 12/2003 Shinn ..... 235/382
6,659,259 B2 12/2003 Knox et al. ..... 194/217
6,662,166 B2 12/2003 Pare, Jr. et al. ..... 705/39
6,663,675 B2 12/2003 Blake et al. ..... 753/63
6,666,318 B2 12/2003 Gerrity et al. ..... 194/347
6,719,121 B2 4/2004 Alexander et al. ..... 194/350
6,755,730 B2 6/2004 Geib et al. ..... 453/3
6,758,316 B2 7/2004 Molbak ..... 194/200
6,761,308 B1 7/2004 Hanna et al. ..... 235/379
6,766,892 B2 7/2004 Martin et al. ..... 194/317
6,783,452 B2 8/2004 Hino et al. ..... 453/3
6,786,398 B1 9/2004 Stinson et al. ..... 235/379
6,854,581 B2 2/2005 Molbak ..... 194/344
6,854,640 B2 2/2005 Peklo ..... 235/100
6,863,168 B1 3/2005 Gerrity et al. ..... 194/347
6,892,871 B2 5/2005 Strauts et al. ..... 194/302
6,896,118 B2 5/2005 Jones et al. ..... 194/217
6,928,546 B1 8/2005 Nanavati et al. ..... 713/186
6,950,810 B2 9/2005 Lapsley et al. ..... 705/78
6,953,150 B2 10/2005 Shepley et al. ..... 235/379
6,957,746 B2 10/2005 Martin et al. ..... 221/131
6,966,417 B2 11/2005 Peklo et al. ..... 194/344
6,976,570 B2 12/2005 Molbak ..... 194/215
6,988,606 B2 1/2006 Geib et al. ..... 194/334
6,991,530 B2 1/2006 Hino et al. ..... 453/3
7,004,831 B2 2/2006 Hino et al. ..... 453/5
7,014,029 B2 3/2006 Winters ..... 194/302
7,014,108 B2 3/2006 Sorenson et al. ..... 235/381
7,017,729 B2 3/2006 Gerrity et al. ..... 194/347
7,018,286 B2 3/2006 Blake et al. ..... 453/61
7,028,827 B1 4/2006 Molbak et al. ..... 194/346
7,036,651 B2 5/2006 Tam et al. ..... 194/217
7,083,036 B2 8/2006 Adams ..... 194/223
7,113,929 B1 9/2006 Beach et al. ..... 705/65
7,131,580 B2 11/2006 Molbak ..... 235/379
7,149,336 B2 12/2006 Jones et al. ..... 382/135
7,152,727 B2 12/2006 Waechter ..... 194/317
7,158,662 B2 1/2007 Chiles ..... 382/135
7,188,720 B2 3/2007 Geib et al. ..... 194/302
7,213,697 B2 5/2007 Martin et al. ..... 194/317
7,243,773 B2 7/2007 Bochonok et al. ..... 194/350
7,269,279 B2 9/2007 Chiles ..... 382/135
7,303,119 B2 12/2007 Molbak ..... 235/379
7,331,521 B2 2/2008 Sorenson et al. ..... 235/381
7,337,890 B2 3/2008 Bochonok et al. ..... 194/353
7,427,230 B2 9/2008 Blake et al. ..... 453/63
7,438,172 B2 10/2008 Long et al. ..... 194/347
7,464,802 B2 12/2008 Gerrity et al. ..... 194/347
7,500,568 B2 3/2009 Cousin ..... 209/534
7,520,374 B2 4/2009 Martin et al. ..... 194/317
7,551,764 B2 6/2009 Chiles et al. ..... 382/135
7,552,810 B2 6/2009 Mecklenburg ..... 194/317
7,580,859 B2 8/2009 Economy ..... 705/16
7,604,107 B2 10/2009 Richard et al. ..... 194/351
7,654,450 B2 2/2010 Mateen et al. ..... 235/379
7,658,270 B2 2/2010 Bochonok et al. ..... 194/350
7,735,125 B1 6/2010 Alvarez et al. ..... 726/9
7,743,902 B2 6/2010 Wendell et al. ..... 194/302
7,778,456 B2 8/2010 Jones et al. ..... 382/135
7,819,308 B2 10/2010 Osterberg et al. ..... 235/379
7,874,478 B2 1/2011 Molbak ..... 235/379
7,886,890 B2 2/2011 Blake et al. ..... 194/347
7,931,304 B2 4/2011 Brown et al. ..... 283/57
7,946,406 B2 5/2011 Blake et al. ..... 194/200
7,949,582 B2 5/2011 Mennie et al. ..... 705/35
7,963,382 B2 6/2011 Wendell et al. ..... 194/302
7,980,378 B2 7/2011 Jones et al. ..... 194/217
8,023,715 B2 9/2011 Jones et al. ..... 382/135
8,042,732 B2 10/2011 Blake et al. ..... 235/375
8,202,144 B2 6/2012 Hino ..... 453/6
8,229,821 B2 7/2012 Mennie et al. ..... 232/16
8,346,610 B2 1/2013 Mennie et al. ..... 705/16
8,352,322 B2 1/2013 Mennie et al. ..... 705/16
8,393,455 B2 3/2013 Blake et al. ..... 194/350
8,443,958 B2 5/2013 Jones et al. ..... 194/215
RE44,252 E 6/2013 Jones et al. ..... 194/217
8,523,641 B2 9/2013 Kuykendall et al. ..... 194/217
8,545,295 B2 10/2013 Blake et al. ..... 453/4
8,602,200 B2 12/2013 Blake ..... 194/216
8,607,957 B2 12/2013 Blake et al. ..... 194/344
8,616,359 B2 12/2013 Bochonok et al. ..... 194/202
RE44,689 E 1/2014 Wendell et al. ..... 194/302
8,684,159 B2 4/2014 Blake ..... 194/216
8,684,160 B2 4/2014 Hallowell et al. ..... 194/344
8,701,860 B1 4/2014 Blake et al. ..... 194/350
8,950,566 B2 2/2015 Hallowell et al. ..... 194/206
8,959,029 B2 2/2015 Jones et al. ..... 705/18
9,092,924 B1 7/2015 Rasmussen et al. ..... 453/3
9,330,515 B1 5/2016 Rasmussen et al. ..... 453/3
9,430,893 B1 8/2016 Blake et al. ..... G07D 3/16
9,437,069 B1 9/2016 Blake et al. ..... G07D 13/00
9,501,885 B1 * 11/2016 Yacoubian ..... G07D 3/14
9,508,208 B1 11/2016 Jagielinski et al. ..... G07D 3/14
2001/0034203 A1 10/2001 Geib et al. ..... 453/3
2001/0048025 A1 12/2001 Shinn ..... 235/382
2002/0065033 A1 5/2002 Geib et al. ..... 453/3
2002/0069104 A1 6/2002 Beach et al. ..... 705/14
2002/0074209 A1 6/2002 Karlsson ..... 194/330
2002/0085745 A1 7/2002 Jones et al. ..... 382/135
2002/0095587 A1 7/2002 Doyle et al. ..... 713/186
2002/0107738 A1 8/2002 Beach et al. ..... 705/14
2002/0126885 A1 9/2002 Mennie et al. ..... 382/135
2002/0130011 A1 9/2002 Casanova et al. ..... 194/344
2002/0147588 A1 10/2002 Davis et al. ..... 704/246
2002/0151267 A1 10/2002 Kuhlin et al. ..... 453/3
2002/0174348 A1 11/2002 Ting ..... 713/186
2002/0179401 A1 12/2002 Knox et al. ..... 194/217
2003/0004878 A1 1/2003 Akutsu et al. ..... 705/43
2003/0013403 A1 1/2003 Blake et al. ..... 453/60
2003/0042110 A1 3/2003 Wilfong ..... 194/302
2003/0081824 A1 5/2003 Mennie et al. ..... 382/135
2003/0127299 A1 7/2003 Jones et al. ..... 194/217
2003/0168309 A1 9/2003 Geib et al. ..... 194/302
2003/0168310 A1 9/2003 Strauts et al. ..... 194/302
2003/0182217 A1 9/2003 Chiles ..... 705/35
2003/0190882 A1 10/2003 Blake et al. ..... 453/63
2003/0230464 A1 12/2003 Deaville et al. ..... 194/302
2003/0234153 A1 12/2003 Blake et al. ..... 194/347
2004/0021898 A1 2/2004 Ashizaki ..... 358/1.15
2004/0055902 A1 3/2004 Peklo ..... 206/0.815
2004/0092222 A1 5/2004 Kowalczyk et al. ..... 453/12
2004/0153406 A1 8/2004 Alarcon-Luther et al. ..... 705/41
2004/0153421 A1 8/2004 Robinson ..... 705/75
2004/0154899 A1 8/2004 Peklo et al. ..... 193/33
2004/0173432 A1 9/2004 Jones ..... 194/216
2004/0188221 A1 9/2004 Carter ..... 194/215
2004/0195302 A1 10/2004 Washington et al. ..... 232/15
2004/0199924 A1 10/2004 Ganesh et al. ..... 719/313
2004/0200691 A1 10/2004 Geib et al. ..... 194/302
2004/0238319 A1 12/2004 Hand et al. ..... 194/207
2004/0238614 A1 12/2004 Yoshioka et al. ..... 232/7
2004/0256197 A1 12/2004 Blake et al. ..... 194/350
2005/0006197 A1 1/2005 Wendell et al. ..... 194/302
2005/0035140 A1 2/2005 Carter ..... 221/195
2005/0040007 A1 2/2005 Geib et al. ..... 194/302
2005/0040225 A1 2/2005 Csulits et al. ..... 235/379
2005/0045450 A1 3/2005 Geib et al. ..... 194/318
2005/0067305 A1 3/2005 Bochonok et al. ..... 206/8
2005/0077142 A1 4/2005 Tam et al. ..... 194/217
2005/0086140 A1 4/2005 Ireland et al. ..... 705/35
2005/0087425 A1 4/2005 Peklo ..... 194/350

(56) References Cited

U.S. PATENT DOCUMENTS

| | | | | |
|---|---|---|---|---|
| 2005/0096986 | A1 | 5/2005 | Taylor et al. | 705/16 |
| 2005/0098625 | A1 | 5/2005 | Walker et al. | 235/381 |
| 2005/0108165 | A1 | 5/2005 | Jones et al. | 705/43 |
| 2005/0109836 | A1 | 5/2005 | Ben-Aissa | 235/380 |
| 2005/0121507 | A1 | 6/2005 | Brown et al. | 235/379 |
| 2005/0124407 | A1 | 6/2005 | Rowe | 463/25 |
| 2005/0150740 | A1 | 7/2005 | Finkenzeller et al. | 194/207 |
| 2005/0156318 | A1 | 7/2005 | Douglas | 257/761 |
| 2005/0205654 | A1 | 9/2005 | Carter | 235/7 R |
| 2005/0205655 | A1 | 9/2005 | Carter | 235/7 R |
| 2005/0228717 | A1 | 10/2005 | Gusler et al. | 705/14 |
| 2005/0256792 | A1 | 11/2005 | Shimizu et al. | 705/35 |
| 2006/0032726 | A1 | 2/2006 | Vook et al. | 194/328 |
| 2006/0037835 | A1 | 2/2006 | Doran et al. | 194/302 |
| 2006/0054455 | A1 | 3/2006 | Kuykendall et al. | 194/217 |
| 2006/0054457 | A1 | 3/2006 | Long et al. | 194/347 |
| 2006/0060363 | A2 | 3/2006 | Carter | 172/111 |
| 2006/0064379 | A1 | 3/2006 | Doran et al. | 705/42 |
| 2006/0065717 | A1 | 3/2006 | Hurwitz et al. | 235/381 |
| 2006/0069654 | A1 | 3/2006 | Beach et al. | 705/65 |
| 2006/0146839 | A1 | 7/2006 | Hurwitz et al. | 370/401 |
| 2006/0148394 | A1 | 7/2006 | Blake et al. | 453/12 |
| 2006/0149415 | A1 | 7/2006 | Richards | 700/236 |
| 2006/0151285 | A1 | 7/2006 | String | 194/350 |
| 2006/0154589 | A1 | 7/2006 | String | 453/11 |
| 2006/0163029 | A1 | 7/2006 | Wollny | 194/328 |
| 2006/0175176 | A1 | 8/2006 | Blake | 194/216 |
| 2006/0182330 | A1 | 8/2006 | Chiles | 382/135 |
| 2006/0196754 | A1 | 9/2006 | Bochonok et al. | 194/347 |
| 2006/0205481 | A1 | 9/2006 | Dominelli | 463/25 |
| 2006/0207856 | A1 | 9/2006 | Dean et al. | 194/302 |
| 2006/0219519 | A1 | 10/2006 | Molbak et al. | 194/346 |
| 2006/0253332 | A1 | 11/2006 | Dobbins | 705/21 |
| 2006/0283685 | A1 | 12/2006 | Cousin | 194/217 |
| 2007/0051582 | A1 | 3/2007 | Bochonok et al. | 194/202 |
| 2007/0071302 | A1 | 3/2007 | Jones et al. | 382/135 |
| 2007/0108015 | A1 | 5/2007 | Bochonok et al. | 194/350 |
| 2007/0119681 | A1 | 5/2007 | Blake et al. | 194/215 |
| 2007/0181676 | A1 | 8/2007 | Mateen et al. | 235/381 |
| 2007/0187494 | A1 | 8/2007 | Hanna | 235/383 |
| 2007/0221470 | A1 | 9/2007 | Mennie et al. | 194/216 |
| 2007/0251800 | A1 | 11/2007 | Castleberry | 194/219 |
| 2007/0269097 | A1 | 11/2007 | Chiles et al. | 382/135 |
| 2007/0270997 | A1 | 11/2007 | Brumfield et al. | 700/214 |
| 2008/0033829 | A1 | 2/2008 | Mennie et al. | 705/16 |
| 2008/0044077 | A1 | 2/2008 | Mennie et al. | 382/135 |
| 2008/0135608 | A1 | 6/2008 | Ireland et al. | 232/1 D |
| 2008/0220707 | A1 | 9/2008 | Jones et al. | 453/2 |
| 2008/0223930 | A1 | 9/2008 | Rolland et al. | 235/385 |
| 2009/0018959 | A1 | 1/2009 | Doran et al. | 705/44 |
| 2009/0236200 | A1 | 9/2009 | Hallowell et al. | 194/215 |
| 2009/0236201 | A1 | 9/2009 | Blake et al. | 194/215 |
| 2009/0239459 | A1 | 9/2009 | Watts et al. | 453/18 |
| 2009/0242626 | A1 | 10/2009 | Jones et al. | 235/379 |
| 2009/0320106 | A1 | 12/2009 | Jones et al. | 726/5 |
| 2010/0038419 | A1 | 2/2010 | Blake et al. | 235/379 |
| 2010/0065623 | A1 | 3/2010 | Sauter | 232/1 D |
| 2010/0198726 | A1 | 8/2010 | Doran et al. | 705/41 |
| 2010/0234985 | A1 | 9/2010 | Shuren et al. | 700/223 |
| 2010/0261421 | A1 | 10/2010 | Wendell et al. | 453/4 |
| 2010/0276485 | A1 | 11/2010 | Jones et al. | 235/379 |
| 2010/0327005 | A1 | 12/2010 | Martin et al. | 221/98 |
| 2011/0098845 | A1 | 4/2011 | Mennie et al. | 700/223 |
| 2011/0099105 | A1 | 4/2011 | Mennie et al. | 705/41 |
| 2011/0259961 | A1 | 10/2011 | Fold et al. | 235/385 |
| 2011/0270695 | A1 | 11/2011 | Jones et al. | 705/43 |
| 2012/0067950 | A1 | 3/2012 | Blake | 235/381 |
| 2012/0156976 | A1 | 6/2012 | Blake et al. | 453/4 |
| 2012/0301009 | A1* | 11/2012 | Dabic | G07D 3/14 382/136 |
| 2013/0178139 | A1 | 7/2013 | Hallowell et al. | 453/15 |
| 2013/0199890 | A1 | 8/2013 | Blake | 194/216 |
| 2013/0205723 | A1 | 8/2013 | Blake et al. | 53/473 |
| 2015/0302678 | A1 | 10/2015 | Blake et al. | |

FOREIGN PATENT DOCUMENTS

| | | | | |
|---|---|---|---|---|
| CA | 2143943 | C | 3/2003 | G07D 3/16 |
| DE | 06 60 354 | | 5/1938 | G07F 17/26 |
| DE | 30 21 327 | A1 | 12/1981 | G07D 3/06 |
| EP | 0 351 217 | A2 | 1/1990 | G07F 9/04 |
| EP | 0 667 973 | B1 | 1/1997 | G07D 3/14 |
| EP | 0 926 634 | A2 | 6/1999 | G07D 3/14 |
| EP | 1 104 920 | A1 | 6/2001 | G07D 5/08 |
| EP | 1 209 639 | A2 | 5/2002 | G07F 19/00 |
| EP | 1 528 513 | A1 | 5/2005 | G07F 7/08 |
| FR | 2042254 | | 2/1971 | G07B 11/00 |
| GB | 2035642 | A | 6/1980 | G07F 7/10 |
| GB | 2175427 | A | 11/1986 | G07F 17/42 |
| GB | 2198274 | A | 6/1988 | G07D 3/00 |
| GB | 2458387 | A | 9/2009 | G07D 11/00 |
| GB | 2468783 | A | 9/2010 | C07D 9/00 |
| JP | 49-058899 | | 6/1974 | |
| JP | 52-014495 | | 2/1977 | G07F 5/10 |
| JP | 52-071300 | A | 6/1977 | G07F 5/22 |
| JP | 56-040992 | A | 4/1981 | G07F 5/18 |
| JP | 57-117080 | A | 7/1982 | G07D 3/16 |
| JP | 59-079392 | A | 5/1984 | G07D 3/16 |
| JP | 60-016271 | U | 2/1985 | G07F 7/02 |
| JP | 62-134168 | U | 8/1987 | G07B 1/00 |
| JP | 62-182995 | A | 8/1987 | G07F 7/08 |
| JP | 62-221773 | A | 9/1987 | G06F 15/30 |
| JP | 62-166562 | U | 10/1987 | G07B 1/00 |
| JP | 64-035683 | A | 2/1989 | G07D 9/00 |
| JP | 64-042789 | A | 2/1989 | G07F 9/00 |
| JP | 64-067698 | A | 3/1989 | G07F 7/08 |
| JP | 01-118995 | A | 5/1989 | G07G 1/00 |
| JP | 01-307891 | A | 12/1989 | G07D 9/00 |
| JP | 02-050793 | A | 2/1990 | G07D 9/00 |
| JP | 02-252096 | A | 10/1990 | G07D 9/00 |
| JP | 03-012776 | A | 1/1991 | G06F 15/30 |
| JP | 03-063795 | A | 3/1991 | G07D 3/00 |
| JP | 03-092994 | A | 4/1991 | G07D 9/00 |
| JP | 03-156673 | A | 7/1991 | G06F 15/30 |
| JP | 04-085695 | A | 3/1992 | G07F 11/72 |
| JP | 04-175993 | A | 6/1992 | G07F 5/22 |
| JP | 05-046839 | A | 2/1993 | G07D 5/02 |
| JP | 05-217048 | A | 8/1993 | G07D 3/16 |
| JP | 05-274527 | A | 10/1993 | G07D 9/00 |
| JP | 06-035946 | A | 2/1994 | G06F 15/30 |
| JP | 06-103285 | A | 4/1994 | G06F 15/21 |
| JP | 09-44641 | A * | 2/1997 | G06T 1/00 |
| JP | 09-251566 | A | 9/1997 | G07F 7/08 |
| JP | 2002-117439 | A | 4/2002 | G07D 9/00 |
| JP | 2003-242287 | A | 8/2003 | G06F 17/60 |
| JP | 2004-213188 | A | 7/2004 | G06F 17/60 |
| SE | 44 244 | | 9/1988 | |
| WO | WO 85/00909 | A1 | 2/1985 | G07D 5/02 |
| WO | WO 91/06927 | A1 | 5/1991 | G07D 3/16 |
| WO | WO 91/08952 | A1 | 6/1991 | B65B 11/04 |
| WO | WO 91/12594 | A1 | 8/1991 | G07D 3/16 |
| WO | WO 91/18371 | A1 | 11/1991 | G07D 3/16 |
| WO | WO 92/08212 | A1 | 5/1992 | G07D 3/16 |
| WO | WO 92/20043 | A1 | 11/1992 | G07D 3/00 |
| WO | WO 92/20044 | A1 | 11/1992 | G07D 3/16 |
| WO | WO 92/22044 | A1 | 12/1992 | G07D 3/00 |
| WO | WO 93/00660 | A1 | 1/1993 | G07D 3/00 |
| WO | WO 93/09621 | A1 | 5/1993 | H04L 9/32 |
| WO | WO 94/06101 | A1 | 3/1994 | G07D 3/16 |
| WO | WO 94/08319 | A1 | 4/1994 | G07D 3/16 |
| WO | WO 94/23397 | A1 | 10/1994 | G07D 3/00 |
| WO | WO 95/02226 | A1 | 1/1995 | G07D 3/00 |
| WO | WO 95/04978 | A1 | 2/1995 | G07D 3/06 |
| WO | WO 95/06920 | A1 | 3/1995 | G07D 3/16 |
| WO | WO 95/09406 | A1 | 4/1995 | G07D 3/16 |
| WO | WO 95/13596 | A1 | 5/1995 | G07D 3/14 |
| WO | WO 95/19017 | A1 | 7/1995 | G07D 1/00 |
| WO | WO 95/23387 | A1 | 8/1995 | G07D 3/16 |
| WO | WO 95/30215 | A1 | 11/1995 | G07F 17/42 |
| WO | WO 96/07163 | A1 | 3/1996 | G07D 3/06 |
| WO | WO 96/07990 | A1 | 3/1996 | G07D 3/16 |
| WO | WO 96/12253 | A1 | 4/1996 | G07D 3/00 |
| WO | WO 96/27525 | A1 | 9/1996 | B65B 11/02 |
| WO | WO 96/27859 | A1 | 9/1996 | G07D 5/08 |

(56) References Cited

FOREIGN PATENT DOCUMENTS

| | | | | |
|---|---|---|---|---|
| WO | WO 97/22919 | A1 | 6/1997 | G06F 7/08 |
| WO | WO 97/25692 | A1 | 7/1997 | G07D 3/06 |
| WO | WO 98/24041 | A1 | 6/1998 | G06F 17/60 |
| WO | WO 98/24067 | A1 | 6/1998 | G07D 3/14 |
| WO | WO 98/48383 | A2 | 10/1998 | G07D 1/00 |
| WO | WO 98/48384 | A2 | 10/1998 | G07D 1/00 |
| WO | WO 98/48385 | A2 | 10/1998 | G07D 1/00 |
| WO | WO 98/51082 | A1 | 11/1998 | H04N 7/18 |
| WO | WO 98/59323 | A1 | 12/1998 | G07D 3/00 |
| WO | WO 99/00776 | A1 | 1/1999 | G07F 9/06 |
| WO | WO 99/06937 | A1 | 2/1999 | G06F 19/00 |
| WO | WO 99/16027 | A2 | 4/1999 | G07F 7/02 |
| WO | WO 99/33030 | A1 | 7/1999 | G07D 3/00 |
| WO | WO 99/41695 | A1 | 8/1999 | G06K 5/00 |
| WO | WO 99/48057 | A1 | 9/1999 | G07D 3/06 |
| WO | WO 99/48058 | A1 | 9/1999 | G07D 3/06 |
| WO | WO 00/48911 | A1 | 8/2000 | B65B 67/12 |
| WO | WO 00/65546 | A1 | 11/2000 | G07F 1/04 |
| WO | WO 01/63565 | A2 | 8/2001 | G07D 9/00 |
| WO | WO 02/071343 | A1 | 9/2002 | G07D 3/00 |
| WO | WO 03/052700 | A2 | 6/2003 | |
| WO | WO 03/079300 | A1 | 9/2003 | G07D 7/00 |
| WO | WO 03/085610 | A1 | 10/2003 | G07D 9/06 |
| WO | WO 03/107280 | A2 | 12/2003 | |
| WO | WO 04/044853 | A1 | 5/2004 | G07D 3/12 |
| WO | WO 04/109464 | A2 | 12/2004 | |
| WO | WO 05/041134 | A2 | 5/2005 | |
| WO | WO 05/088563 | A1 | 9/2005 | G07D 3/00 |
| WO | WO 06/086531 | A1 | 8/2006 | G07D 9/00 |
| WO | WO 07/035420 | A2 | 3/2007 | G06F 7/00 |
| WO | WO 07/120825 | A2 | 10/2007 | G06K 9/00 |

OTHER PUBLICATIONS

Amiel Industries: AI-1500 'Pulsar' High Performance Sorting and Bagging Machine, 13 pages (date unknown, but prior to Dec. 14, 2000).
AUI: Coinverter—"No More Lines . . . Self-Serve Cash-Out," by Cassius Elston, 1995 World Games Congress/Exposition Converter, 1 page (dated prior to 1995).
Brandt: 95 Series Coin Sorter Counter, 2 pages (1982).
Brandt: Model 817 Automated Coin and Currency Ordering System, 2 pages (1983).
Brandt: Model 920/925 Counter, 2 pages (date unknown, prior to Jul. 2011, possibly prior to Mar. 17, 1997).
Brandt: System 930 Electric Counter/Sorter, "Solving Problems, Pleasing Customer, Building Deposits," 1 page (date unknown, prior to Mar. 2, 2011, possibly prior to Mar. 17, 1997).
Brandt: Model 940-6 High Speed Sorter/Counter, 2 pages (date unknown, prior to Oct. 31, 1989).
Brandt: System 945 High-Speed Sorter, 2 pages (date unknown, prior to Mar. 2, 2011, possibly prior to Mar. 17, 1997).
Brandt: Model 952 Coin Sorter/Counter, 2 pages (date unknown, prior to Oct. 31, 1989).
Brandt: Model 954 Coin Sorter/Counter, 2 pages (date unknown, prior to Oct. 31, 1989).
Brandt: Model 957 Coin Sorter/Counter, 2 pages (date unknown, prior to Oct. 31, 1989).
Brandt: Model 958 Coin Sorter/Counter, 5 pages (© 1982).
Brandt: Model 960 High-Speed Coin Sorter & Counter, 2 pages (1984).
Brandt; Model 966 Microsort™ Coin Sorter and Counter, 4 pages, (1979).
Brandt: Model 970 Coin Sorter and Counter, 2 pages (1983).
Brandt: Model 1205 Coin Sorter Counter, 2 pages (1986).
Brandt: Model 1400 Coin Sorter Counter, 2 pages (date unknown, prior to Mar. 2, 2011, possibly prior to Mar. 17, 1997).
Brandt: Model 8904 Upfeed—"High Speed 4-Denomination Currency Dispenser," 2 pages (1989).
Brandt: Mach 7 High-Speed Coin Sorter/Counter, 2 pages (1992).
Case ICC Limited: CDS Automated Receipt Giving Cash Deposit System, 3 pages (date unknown, prior to Nov. 15, 2000).
Cash, Martin: Newspaper Article "Bank Blends New Technology With Service," Winnipeg Free Press, 1 page (Sep. 4, 1992).
Childers Corporation: Computerized Sorter/Counter, "To coin an old adage, time is money . . . ," 3 pages (1981).
CTcoin: CDS602 Cash Deposit System, 1 page (date unknown, prior to Jan. 15, 2001).
Cummins: Cash Information and Settlement Systems (Form 023-1408), 4 pages (date Dec. 1991).
Cummins: The Universal Solution to All Coin and Currency Processing Needs (Form 13C1218 3-83), 1 page (Mar. 1983).
Cummins: JetSort® High Speed Sorter/Counter Kits I & J—Operating Instructions (Form 022-7123-00) 12 pages (1994).
Cummins: JetSort® Coin Sorter Counter/CA-130XL Coin Wrapper, Cummins Automated Money Systems (AMS) Case Study—Fifth-Third, "6,000 Coin Per Minute Counter/Sorter Keeps pace With Fifth-Third Bank's Money Processing Needs," (Form 13C1180), 2 pages (Nov. 1981).
Cummins: JetSort®, "Venders Love JetSort," (13C1255), 1 page (Mar. 1987).
Cummins: JetSort® "High Speed Coin Sorter & Counter for Payphone Applications," "CTOCS Ready" (Form 023-1365), 2 pages (Mar. 1989).
Cummins: JetSort® mailer, "One moving part simplicity," "Vendors—Are validators changing your coin and currency needs?" (Form 023-1297), 3 pages (Apr. 1987).
Cummins: JetSort® Series V High Speed Coin Sorter/Counter, (Form 023-1383), 2 pages (Sep. 1990).
Cummins: JetSort® "Time for a Change, Be a smashing success!," (Form 023-1328), 1 page (Jun. 1988).
Cummins: JetSort® "Time for a Change—JetSort® vs. Brandt X," (Form 023-1330), 1 page (Jun. 1988).
Cummins: JetSort® "Time for a Change—No Coins Sorted After 3:00 or on Saturday," (Form 023-1327), 1 page (Aug. 1988).
Cummins: JetSort®, "What do all these Banks have in Common . . . ?", JetSort, CA-130XL coin wrapper, CA-118 coin wrapper, CA-4000 JetCount, (13C1203), 3 pages (Aug. 1982).
Cummins: JetSort® 700-01/CA-118 Coin Wrapper, Cummins Automated Money Systems (AMS) Case Study—University State Bank, "Cummins Money Processing System Boosts Teller Service at University State Bank," (Form 13C1192), 2 pages (Mar. 1982).
Cummins: JetSort® 700-01, Cummins Automated Money Systems (AMS) Case Study—First State Bank of Oregon, "JetSort® Gives Bank Coin Service Edge," (Form 13C1196), 2 pages (Apr. 1982).
Cummins: JetSort® 700-01 Coin Sorter/Counter, Operating Instructions, 14 pages (1982).
Cummins: JetSort® 701, Cummins Automated Money Systems (AMS) Case Study—Convenco Vending, "High Speed Coin Sorter increases coin processing power at Convenco Vending," (Form 13C1226), 2 pages (Jul. 1983).
Cummins: JetSort Models 701 and 750 , "State-of-the-art coin processing comes of age," 2 pages (Feb. 1984).
Cummins: JetSort® Model CA-750 Coin Processor (Item No. 50-152), 1 page (Jul. 1984).
Cummins: JetSort® Model CA-750 Coin Sorter/Counter and CA-4050 JetCount currency counter, "Money Processing Made Easy," (Form 13C1221) 2 pages (Jun. 1983).
Cummins: JetSort® Model 1701 with JetStops, Operating Instructions Manual (Form 022-1329-00), 16 pages (1984).
Cummins: JetSort® Model 1760 brochure, (Form 023-1262-00), 2 pages (Jul. 1985).
Cummins: JetSort® Models 1770 and 3000, Communication Package specification and operating instructions, 10 pages (uncertain, possibly Nov. 1985).
Cummins: JetSort® Model 1770, "JetSort® Speed and Accuracy, Now with Communications!", (Form 023-1272) 1 page (Oct. 1986).
Cummins: JetSort® 2000 Series High Speed Coin Sorter/Counter (Form 023-1488), 2 pages (Oct. 2000).
Cummins: JetSort® 3000 Series High Speed Coin Sorter (Form 023-1468 Rev 1), 2 pages (Feb. 1995).
Cummins: JetSort® 3000 Series Options, "Talking JetSort 3000," (Form 023-1338-00), 1 page (between Jan. 1989-Feb. 1989).

(56) References Cited

OTHER PUBLICATIONS

Cummins: JetSort® 3000, "3,000 Coins per Minute!," (Form 023-1312), 1 page (date unknown, est. 1987).
Cummins: JetSort® 3200, Enhanced electronics for the JetSort® 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
De La Rue: CDS 5700 and CDS 5800 Cash Deponier System (German) and translation, 7 pages (date unknown, prior to Aug. 13, 1996).
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 pages (date unknown, prior to Nov. 10, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, In Less Space Than a Branch Manager's Desk, 4 pages (date unknown, prior to Jan. 15, 2001).
Intellectual Australia Pty. Ltd.: Microbank, "From down under: Microbank," "hand-held smart card terminal that combines smart card functions and telephone banking," 2 pages (Feb. 1996).
ISH Electronic: ISH 12005/500 Coin Counter (with translation), 4 pages (date unknown, prior to Aug. 1996).
ISH Electronic: ISH 12005/501 Self-Service Unit (with translation), 4 pages (date unknown, prior to Aug. 1996).
Namsys, Inc.: Namsys Express, Making currency management . . . more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Aug. 13, 1996, maybe Feb. 1995).
Reis Eurosystems: CRS 6520/ CRS 6525 Standard-Class Coin Deposit Systems, 1 page (date unknown, prior to Apr. 2003).
Reis Eurosystems: CS 3510 Disc-Sorter, 1 page (date unknown, prior to Apr. 2003).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Gazette Montreal, 2 pages (Sep. 14, 1991).
Royal Bank: SuperBranch, "Experience the Ultimate in Convenience Banking," 2 pages (Feb. 1992).
Scan Coin: International Report, 49 pages (Apr. 1987).
Scan Coin: Money Processing Systems, 8 pages (date unknown, prior to Apr. 2003).
Scan Coin: World, 2 pages (Feb. 1988).
Scan Coin: CDS Cash Deposit System, 6 pages (date unknown, prior to Apr. 2003) [SC 0369].
Scan Coin: CDS Coin Deposit System—Technical Referens Manual, 47 pages (1989).
Scan Coin: CDS 600 User's Manual, 14 pages (date unknown, prior to Apr. 2003).
Scan Coin: CDS 600 & CDS 640 Cash Deposit System—Technical Manual, 45 pages (date unknown, prior to Apr. 2003).
Scan Coin: CDS MK 1 Coin Deposit System—Technical Manual, 32 pages (1991).
Scan Coin: SC 102 Value Counter Technical Manual, 28 pages (date unknown, prior to Apr. 2003).
Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Cards," American Banker, New York, NY, vol. 159, Iss. 195, p. 37, 2 pages (Oct. 10, 1994).
Scan Coin: Coin Sachet System brochure, 4 pages (last page marked "© Scan Coin / 2007-06").
U.S. Appl. No. 14/804,670 Office Action, United States Patent & Trademark Office, dated Mar. 17, 2016; (10 pages).

* cited by examiner

SYSTEMS, METHODS AND DEVICES FOR PROCESSING COINS UTILIZING NORMAL OR NEAR-NORMAL AND/OR HIGH-ANGLE OF INCIDENCE LIGHTING

CLAIM OF PRIORITY AND CROSS-REFERENCE TO RELATED APPLICATION

This application is a continuation-in-part of U.S. patent application Ser. No. 14/794,262, filed on Jul. 8, 2015, and entitled Systems, Methods and Devices for Processing Coins Utilizing Near-Normal and High-Angle of Incidence Lighting, which claims the benefit of priority to U.S. Provisional Patent Application No. 62/022,373, which was filed on Jul. 9, 2014, each of which is incorporated herein by reference in its entirety.

TECHNICAL FIELD

The present disclosure relates generally to systems, methods, and devices for processing currency. More particularly, aspects of this disclosure relate to coin processing units for imaging and evaluating batches of coins.

BACKGROUND

Some businesses, particularly banks, are regularly faced with large amounts of currency which must be organized, counted, authenticated and recorded. To hand count and record large amounts of currency of mixed denominations requires diligent care and effort, and demands significant manpower and time that might otherwise be available for more profitable and less tedious activity. To make counting of bills and coins less laborious, machines have been developed which automatically sort, by denomination, mixed assortments of currency, and transfer the processed currency into receptacles specific to the corresponding denominations. For example, coin processing machines for processing large quantities of coins from either the public at large or private institutions, such as banks, casinos, supermarkets, and cash-in-transit (CIT) companies, have the ability to receive bulk coins from users of the machine, count and sort the coins, and store the received coins in one or more coin receptacles, such as coin bins or coin bags. One type of currency processing machine is a redemption-type processing machine wherein, after the deposited coins and/or bank notes are counted, funds are returned to the user in a pre-selected manner, such as a payment ticket or voucher, a smartcard, a cash card, a gift card, and the like. Another variation is the deposit-type processing machine where funds which have been deposited by the user are credited to a personal account. Hybrid variations of these machines are also known and available.

A well-known device for processing coins is the disk-type coin sorter. In one exemplary configuration, the coin sorter, which is designed to process a batch of mixed coins by denomination, includes a rotatable disk that is driven by an electric motor. The lower surface of a stationary, annular sorting head is parallel to and spaced slightly from the upper surface of the rotatable disk. The mixed batch of coins is progressively deposited onto the top surface of the rotatable disk. As the disk is rotated, the coins deposited on the top surface thereof tend to slide outwardly due to centrifugal force. As the coins move outwardly, those coins which are lying flat on the top surface of the rotatable disk enter a gap between the disk and the sorting head. The lower surface of the sorting head is formed with an array of exit channels which guide coins of different denominations to different exit locations around the periphery of the disk. The exiting coins, having been sorted by denomination for separate storage, are counted by sensors packed along the exit channel. An example of a disk-type coin sorting mechanism is disclosed in U.S. Pat. No. 5,009,627, to James M. Rasmussen, which is incorporated herein by reference in its entirety and for all purposes.

It is oftentimes desirable in the sorting of coins to discriminate between valid coins and invalid coins. Use of the term "valid coin" can refer to genuine coins of the type to be sorted. Conversely, use of the term "invalid coin" can refer to items in the coin processing unit that are not one of the coins to be sorted. For example, it is common that foreign (or "stranger") coins and counterfeit coins enter a coin processing system for sorting domestic coin currency. So that such items are not sorted and counted as valid coins, it is helpful to detect and discard these "invalid coins" from the coin processing system. In another application wherein it is desired to process only U.S. quarters, nickels and dimes, all other U.S. coins, including dollar coins, half-dollar coins, pennies, etc., can be considered "invalid." Additionally, coins from all other coins sets including Canadian coins and European coins, for example, can be considered "invalid" when processing U.S. coins. In another application it may be desirable to separate coins of one country (e.g., Canadian coins) from coins of another country (e.g., U.S. coins). Finally, any truly counterfeit coins (also referred to in the art as "slugs") are always considered "invalid" regardless of application.

Historically, coins have been sorted and validated or otherwise processed based on physical assessment of their structural characteristics, such as coin diameter, coin thickness, metal content, shape, serrations and engravings on obverse and reverse sides of the coin. To improve discriminating accuracy, coin processing units have been designed for discriminating and authenticating coins by optically detecting coin surface patterns. For example, one known coin discriminating apparatus is provided with an assortment of light emitting elements, such as light emitting diodes (LEDs), for projecting light onto a passing coin, and a photodetector, a charge-coupled device (CCD) detector, or other optical sensor for optically detecting light emitted from the light emitting elements and reflected by the surface of the coin. From the reflected light pattern, the apparatus is able to authenticate and denominate coins based on coin image pattern data that was optically detected and digitized.

One drawback with many prior art optical coin discriminating devices is an undesirably large proportion of discrimination errors caused by variations in coin surface reflectance due to aging and wear. In addition, the processing and remediation time for identifying and removing invalid or unfit coins using many conventional optical coin discriminating devices is undesirably long for bulk coin processing systems that must process thousands of coins within a few minutes. In addition to being slow and unreliable, many prior art optical coin discriminating devices are costly and require a great deal of packaging space with a large window for imaging. Moreover, most optical coin processing systems that are available today utilize single/broad wavelength lighting schemes (e.g., white light) that can only capture limited spectral characteristics of the coins being processed.

SUMMARY

Currency processing systems, coin processing machines, coin processing units, and methods of imaging and processing batches of coins are presented herein. For example, aspects of the present disclosure are directed to currency processing machines and coin processing units which utilize a linear array of optical coin-imaging sensors with multiple light emitting sources to provide near-normal and high-angle of incidence lighting for high-speed imaging and processing of coins. In some embodiments, the light emitting devices have multi-wavelength capabilities to capture multiple spectral characteristics of the coins being processed. The foregoing sensor assembly enables the capturing of at least two different types of images: uniform illumination to reveal and image coin surface details, and high-angle illumination to produce edge-enhanced images to reveal surface topography variations and coin wear. Optionally, the sensor assembly can be reconfigured in real time by electronic control to enable simultaneously capturing both types of images. The aforementioned sensor assemblies can enable additional functionality, such as authentication, validation, and fitness measurement. The aforementioned sensor assemblies can also allow for imaging of the obverse and reverse faces of the coin, as well as the side of the coin. In contrast to prior art units that utilize two-dimensional (2D) imaging cameras, which are slow, costly, and difficult to implement in many coin sorters because of the large window required for imaging batches of coins with large diameter coins, the disclosed linear array sensor assemblies can offer a lower cost, simpler, faster and more compact system solution for coin imaging and processing.

In some embodiments, a coin processing system is presented which comprises of means to illuminate a passing coin using single and/or plural wavelengths of light (broad spectrum) at multiple incidences, means to detect the coin's response to the illumination excitation, means to transfer the detected information at a speed that is compatible with the speed of coin processing required by high-speed batch coin processing systems, and means to process the information. The aforementioned detection means may comprise a one-dimensional (1D) linear optical detector array, which is more compact, faster, lower cost, and easier to implement than existing 2D camera coin imagers. A 1D linear array comprises multiple identical sensors (sensing elements) that are aligned rectilinearly adjacent one another in a row. Typically, the length of the row is perpendicular to the direction of coin travel. In some embodiments, a coin processing system is presented that is capable of imaging the side of a coin as it is being processed. This system comprises of means to illuminate the side of a passing coin, means to image the side of the coin, means to process the side image, and means to classify the coin based on the side image. The side coin processing system can be based on a 1D imaging system or a 2D imaging system.

Aspects of the present disclosure are directed to currency processing systems for processing, inter alia, batches of coins. In an example, a currency processing system is disclosed which includes a housing, one or more coin receptacles, and a disk-type coin processing unit. The housing has a coin input area for receiving a batch of coins. The one or more coin receptacles are stowed inside or adjacent the housing and are otherwise operatively coupled to the housing. The disk-type coin processing unit is operatively coupled to the coin input area and the one or more coin receptacles to transfer coins therebetween. The coin processing unit includes a rotatable disk for imparting motion to a plurality of the coins, and a sorting head with a lower surface that is generally parallel to and at least partially spaced from the rotatable disk. The lower surface forms a plurality of shaped regions for guiding the coins, under the motion imparted by the rotatable disk, to a plurality of exit stations through which the coins are discharged from the coin processing unit to the one or more coin receptacles. A sensor arrangement, which is mounted adjacent the rotatable disk, includes a photodetector and first and second light emitting devices. The first light emitting device emits light onto a surface of a passing coin at normal or near-normal incidence, while the second light emitting device emits light onto the surface of the passing coin at high-angle incidence. The photodetector senses light reflected off the surface of the passing coin and outputs a signal indicative of coin image information for processing the coin. Optionally, one or more additional light emitting devices are included in the sensor arrangement and configured to emit light at angles between normal and high incidence.

Aspects of the present disclosure are directed to coin processing machines for processing, inter alia, batches of coins. In an example, a coin processing machine is featured which includes a housing with a coin input area for receiving therethrough a batch of coins. Plural coin receptacles are stowed inside the housing. A processor is also stored inside the housing. A disk-type coin processing unit is disposed at least partially inside the housing and is operatively coupled to the coin input area and the coin receptacles to transfer coins therebetween. The coin processing unit includes a rotatable disk for supporting on an upper surface thereof and imparting motion to a plurality of coins received from the coin input area. The coin processing unit also includes a stationary sorting head with a lower surface that is generally parallel to and spaced slightly apart from the rotatable disk. The lower surface forms a plurality of exit channels for guiding the coins, under the motion imparted by the rotatable disk, to exit stations through which the coins are discharged to one or more of the coin receptacles. A sensor arrangement is mounted to the sorting head facing the rotatable disk. An example of a sensor arrangement includes a linear array of photosensors and at least one or, in some preferred embodiments, at least two rows of light sources. A first row of LEDs, for example, is configured to emit light onto respective surfaces of passing coins at near-normal incidence, whereas a second row of LEDs is configured to emit light onto the respective surfaces of the passing coins at high-angle incidence. The linear array of photosensors, which has a normal incidence with the surfaces of the passing coins, is configured to sense light reflected off the surfaces of the passing coins and output signals indicative thereof. The processor is configured to receive the coin image signals from the sensor arrangement and generate therefrom multiple images of the respective surfaces of each of the passing coins for processing the coins.

Other aspects of this disclosure are directed to coin imaging sensor systems for processing coins. In an example, a coin imaging sensor system for a coin processing apparatus is presented. The coin processing apparatus includes a housing with an input area for receiving coins, one or more coin receptacles for stowing processed coins, a coin sorting device for separating the coins by denomination, and a coin transport mechanism for transferring the coins from the input area, through the coin sorting device, to the one or more coin receptacles. The coin imaging sensor system comprises a sensor arrangement that is configured to mount inside the housing adjacent the coin transport mechanism upstream of the coin receptacle(s) and downstream from the coin input area. The sensor arrangement includes a photodetector and first and second light emitting devices. The first light emitting device is configured to emit light onto a surface of a passing coin at near-normal incidence, while the second light emitting device is configured to emit light onto the surface of the passing coin at high-angle incidence. The photodetector is configured to sense light reflected off the surface of the passing coin and output a signal indicative of coin image information. An image processing circuit is operatively coupled to the sensor arrangement and configured to process the coin image information signal output therefrom. The coin imaging sensor system also includes a processor that is operatively coupled to the image processing circuit and configured to analyze the processed signals and generate therefrom an image for the passing coin. The processor can also analyze the coin image and make determinations about coin properties, such as physical dimensions, features, denominations, authenticity, fitness, and/or other properties as required by the coin sorting system.

Other aspects of the present disclosure are directed to currency processing devices. In an example, a currency processing device is disclosed which includes a coin input area for receiving coins from a user, and at least one coin receptacle for receiving and stowing processed coins. The currency processing device also includes a coin processing unit that receives coins from the coin input area, processes the received coins, and outputs the processed coins to the coin receptacle(s). A sensor arrangement, which is mounted to or adjacent the coin processing unit, includes a photodetector and at least first and second light emitting devices. The first light emitting device is configured to emit light onto a surface of a passing coin at near-normal incidence, while the second light emitting device is configured to emit light onto the surface of the passing coin at high-angle incidence. The photodetector is configured to sense light reflected off the surface of the passing coin and output a signal indicative of coin image information. One or more processors receive the coin image signal from the sensor arrangement and generate therefrom an image of the surface of the passing coin. The light emitting devices could be turned on separately, synchronously, simultaneously, or they could operate in a predefined sequence to provide optimum coin illumination.

For any of the disclosed configurations, the photodetector may include a linear array of photosensors with a normal incidence with the surface of the passing coin. Optionally, any of the aforementioned sensor arrangements may further comprise a lens array or other optical means to converge the light, such as a gradient-index (GRIN) lens array or a SELFOC lens array, between the photodetector and the passing coin. Optionally, the first light emitting device comprises light sources, such as two rows of LEDs, that are configured to emit light onto the surface of the passing coin at a first near-normal incidence and a first high-angle of incidence. Moreover, the second light emitting device may comprise light sources, such as two rows of LEDs, configured to emit light onto the surface of the passing coin at a second near-normal incidence and a second high-angle of incidence. Optionally, any of the aforementioned sensor arrangements may further comprise a light diffusing element operable to diffuse high-angle incidence light emitted by the second light emitting device. Alternatively, the sensor arrangements may further comprise a cylindrical lens and a light scattering element operable to scatter high-angle incidence light emitted by the second light emitting device. In addition, the coin could travel partially outside the scandisk to allow for imaging of multiple surfaces (e.g., both sides) of the coin. In this instance, two identical or similar 1D sensor arrays can be used, one for imaging the top of the coin and one for imaging the bottom of the coin. Alternatively, the illumination means could be a single pair of optical waveguides each with multiple LED. Each illumination means comprise of two identical illuminations means one on each side of the photodetector array.

The above summary is not intended to represent each embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the exemplary embodiments and modes for carrying out the present invention when taken in connection with the accompanying drawings and appended claims.

Figure 1:
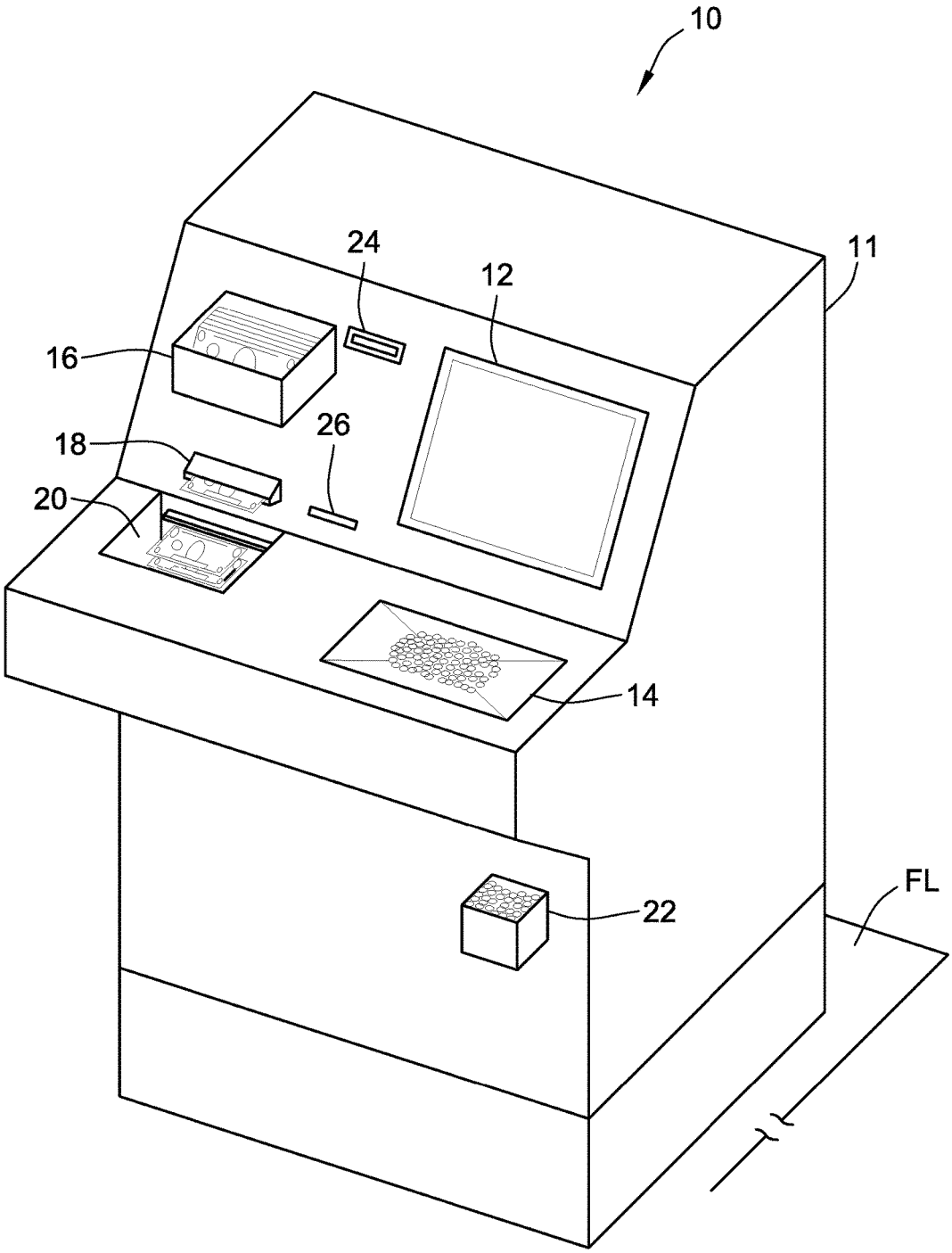
FIG. 1 is a front perspective-view illustration of an example of a currency processing system in accordance with aspects of the present disclosure.

The present disclosure is susceptible to various modifications and alternative forms, and some representative embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims. Moreover, the disclosure expressly encapsulates any and all combinations and subcombinations of the illustrated and described elements and aspects.

DETAILED DESCRIPTION OF THE ILLUSTRATED EMBODIMENTS

This invention is susceptible of embodiment in many different forms. There are shown in the drawings, and will herein be described in detail, representative embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring now to the drawings, wherein like reference numerals refer to like components throughout the several views, FIG. 1 illustrates an example of a currency processing system, designated generally as 10, in accordance with aspects of the present disclosure. Many of the disclosed concepts are discussed with reference to the representative currency processing systems depicted in the drawings. However, the novel aspects and features of the present disclosure are not per se limited to the particular arrangements and components presented in the drawings. For example, many of the features and aspects presented herein can be applied to other currency processing systems without departing from the intended scope and spirit of the present disclosure. Examples of currency processing systems into which the disclosed concepts can be incorporated are the JetSort™ family of coin sorting machines available from Cummins-Allison Corp. The inventive aspects of the present disclosure, however, are not limited to coins processing systems utilizing sorting disks and could be utilized in other currency processing systems, such as belt and rail systems, regardless of speed as long as the coin position is controlled. In addition, although differing in appearance, the coin processing systems and devices depicted and discussed herein can each take on any of the various forms, optional configurations, and functional alternatives described above and below with respect to the other disclosed embodiments, and thus can include any of the corresponding options and features. It should also be understood that the drawings are not necessarily to scale and are provided purely for descriptive purposes; thus, the individual and relative dimensions and orientations presented in the drawings are not to be considered limiting.

The currency processing system 10 is a hybrid redemption-type and deposit-type currency processing machine with which funds may be deposited into and returned from the machine, in similar or different forms, in whole or in part, and/or funds may be credited to and withdrawn from a personal account. The currency processing machine 10 illustrated in FIG. 1 includes a housing 11 that may house various input devices, output devices, and input/output devices. By way of non-limiting example, the currency processing machine 10 includes a display device 12 that may provide various input and output functions, such as displaying information and instructions to a user and receiving selections, requests, and other forms of inputs from a user. The display device 12 is, in various embodiments, a cathode ray tube (CRT), a high-resolution liquid crystal display (LCD), a plasma display, a light emitting diode (LED) display, a DLP projection display, an electroluminescent (EL) panel, or any other type of display suitable for use in the currency processing machine 10. A touch screen, which has one or more user-selectable soft touch keys, may be mounted over the display device 12. While a display device 12 with a touchscreen may be a preferred means for a user to enter data, the currency processing machine 10 may include other known input devices, such as a keyboard, mouse, joystick, microphone, etc.

The currency processing machine 10 includes a coin input area 14, such as a bin or tray, which receives batches of coins from a user. Each coin batch may be of a single denomination, a mixed denomination, a local currency, or a foreign currency, or any combination thereof. Additionally, a bank note input area 16, which may be in the nature of a retractable pocket or basket, is also offered by the currency processing machine 10. The bank note input area 16, which is illustrated in its open position in FIG. 1, can be retracted by the currency processing machine 10 once the bulk currency has been placed therein by the user. In addition to banknotes, or as a possible alternative, the bank note receptacle 16 of the currency processing machine 10 can also be operable to accommodate casino scrip, paper tokens, bar coded tickets, or other known forms of value. These input devices—i.e., the currency input areas 14 and 16, allow the user of the currency processing machine 10 to input his or her funds, which can ultimately be converted to some other sort of fund source that is available to the user. Optionally or alternatively, the currency processing machine 10 can operate to count, authenticate, valuate, and/or package funds deposited by a user.

In addition to the above-noted output devices, the currency processing machine 10 may include various output devices, such as a bank note dispensing receptacle 20 and a coin dispensing receptacle 22 for dispensing to the user a desired amount of funds in bank notes, coins, or a combination thereof. An optional bank note return slot 18 may also be included with the currency processing machine 10 to return notes to the user, such as those which are deemed to be counterfeit or otherwise cannot be authenticated or processed. Coins which cannot be authenticated or otherwise processed may be returned to the user via the coin dispensing receptacle 22. The currency processing machine 10 further includes a paper dispensing slot 26, which can be operable for providing a user with a receipt of the transaction that was performed.

In one representative transaction, the currency processing machine 10 receives funds from a user via the coin input area 14 and/or the bank note input area 16 and, after these deposited funds have been authenticated and counted, the currency processing machine 10 returns to the user an amount equal to the deposited funds but in a different variation of bank notes and coins. Optionally, the user may be assessed one or more fees for the transaction (e.g., service fees, transaction fees, etc.). For example, the user of the currency processing machine 10 may input $102.99 in various small bank notes and pennies and in turn receive a $100 bank note, two $1 bank notes, three quarters, two dimes, and four pennies. As another option or alternative, the currency processing machine 10 may simply output a voucher or a receipt of the transaction through the paper dispensing slot 26 which the user can then redeem for funds by an attendant of the currency processing machine 10. Yet another option or alternative would be for the currency processing machine 10 to credit some or all of the funds to a personal account, such as a bank account or store account. As yet another option, the currency processing machine 10 may credit some or all of the funds to a smartcard, gift card, cash card, virtual currency, etc.

The currency processing machine 10 may also include a media reader slot 24 into which the user inserts a portable medium or form of identification, such as a driver's license, credit card, or bank card, so that the currency processing machine 10 can, for example, identify the user and/or an account associated with the user. The media reader 24 may take on various forms, such as a ticket reader, card reader, bar code scanner, wireless transceiver (e.g., RFID, Bluetooth, etc.), or computer-readable-storage-medium interface. The display device 12 with a touchscreen typically provides the user with a menu of options which prompts the user to carry out a series of actions for identifying the user by displaying certain commands and requesting that the user press touch keys on the touch screen (e.g. a user PIN). The media reader device 24 of the illustrated example is configured to read from and write to one or more types of media. This media may include various types of memory storage technology such as magnetic storage, solid state memory devices, and optical devices. It should be understood that numerous other peripheral devices and other elements exist and are readily utilizable in any number of combinations to create various forms of a currency processing machine in accord with the present concepts.

Figure 2:
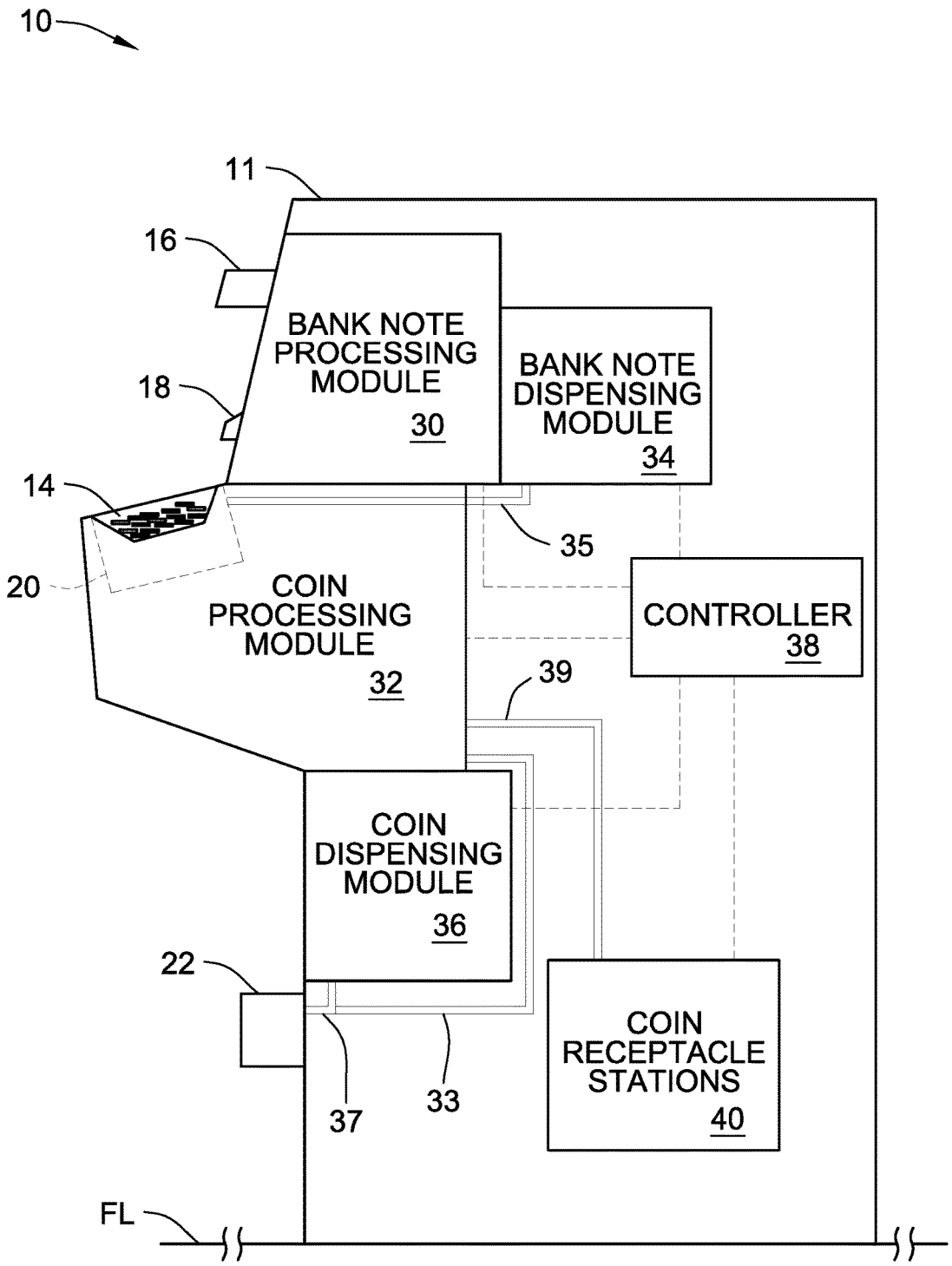
FIG. 2 is a schematic side-view illustration of the representative currency processing machine of FIG. 1.

FIG. 2 is a schematic illustration of the currency processing machine 10 showing various modules which may be provided in accord with the disclosed concepts. A bank note processing module 30, for example, receives bank notes from the bank note input area 16 for processing. In accord with a representative configuration, the inward movement of a retractable bank note input area 16 positions a stack of bills at a feed station of the bank note scanning and counting device which automatically feeds, counts, scans, authenticates, and/or sorts the bank notes, one at a time, at a high rate of speed (e.g., at least approximately 350 bills per minute). In place of, or in addition to the bank note input area 16, the currency processing machine 10 may include a single bank note receptacle for receiving and processing one bank note at a time. The bank notes that are recognized and/or deemed authentic by the bank note processing module 30 are delivered to a currency canister, cassette or other known storage container. When a bank note cannot be recognized by the bank note processing module 30, it can be returned to the customer through the bank note return slot 18. Exemplary machines which scan, sort, count, and authenticate bills as may be required by the bank note processing module 30 are described in U.S. Pat. Nos. 5,295,196, 5,970,497, 5,875,259, which are incorporated herein by reference in their respective entireties and for all purposes.

The representative currency processing machine 10 shown in FIG. 2 also includes a coin processing module 32. The coin processing module 32 may be operable to sort, count, valuate and/or authenticate coins which are deposited in the coin input receptacle 14, which is operatively connected to the coin processing module 32. The coins can be sorted by the coin processing module 32 in a variety of ways, but one known method is sorting based on the diameters of the coins. When a coin cannot be authenticated or counted by the coin processing module 32, it can be directed back to the user through a coin reject tube 33 which leads to the coin dispensing receptacle 22. Thus, a user who has entered such a non-authenticated coin can retrieve the coin by accessing the coin dispensing receptacle 22. Examples of coin sorting and authenticating devices which can perform the function of the coin processing module 32 are disclosed in U.S. Pat. Nos. 5,299,977, 5,453,047, 5,507,379, 5,542,880, 5,865,673, 5,997,395, which are incorporated herein by reference in their respective entireties and for all purposes.

The currency processing machine 10 further includes a bank note dispensing module 34 which is connected via a transport mechanism 35 to the user-accessible bank note dispensing receptacle 20. The bank note dispensing module 34 typically dispenses loose bills in response to a request of the user for such bank notes. Also, the bank note dispensing module 34 may be configured to dispense strapped notes into the bank note dispensing receptacle 20 if that is desired. In one embodiment of the present disclosure, the user may select the denominations of the loose/strapped bills dispensed into the bank note dispensing receptacle 20.

The currency processing machine 10 also includes a coin dispensing module 36 which dispenses loose coins to the user via the coin dispensing receptacle 22. The coin dispensing module 36 is connected to the coin dispensing receptacle 22, for example, via a coin tube 37. With this configuration, a user of the currency processing machine 10 has the ability to select the desired coin denominations that he or she will receive during a transaction, for example, in response to user inputs received by one or more of the available input devices. Also, the coin dispensing module 36 may be configured to dispense packaged (e.g., sachet or rolled) coins into the coin dispensing receptacle 22 if that is desired. The coins which have been sorted into their respective denominations by the coin processing module 32 are discharged into one or more coin chutes or tubes 39 which direct coins to a coin receptacle station(s) 40. In at least some aspects, a plurality of tubes 39 are provided and advantageously are positioned to direct coins of specified denominations to designated coin receptacles. The currency processing machine 10 may include more or fewer than the modules illustrated in FIG. 2, such as a coin packaging module or a note packaging module.

The currency processing machine 10 includes a controller 38 which is coupled to each module within the currency processing machine 10, and optionally to an external system, and controls the interaction between each module. For example, the controller 38 may review the input totals from the funds processing modules 30 and 32 and direct an appropriate funds output via the funds dispensing modules 34 and 36. The controller 38 also directs the operation of the coin receptacle station 40 as described below. While not shown, the controller 38 is also coupled to the other peripheral components of the currency processing machine 10, such as a media reader associated with the media reader slot 24 (See FIG. 1) and also to a printer at the receipt dispenser 26, if these devices are present on the coin processing mechanism 10. The controller 38 may be in the nature of a central processing unit (CPU) connected to a memory device. The controller 38 may include any suitable processor, processors and/or microprocessors, including master processors, slave processors, and secondary or parallel processors. The controller 38 may comprise any suitable combination of hardware, software, or firmware disposed inside and/or outside of the housing 11.

Figure 3:
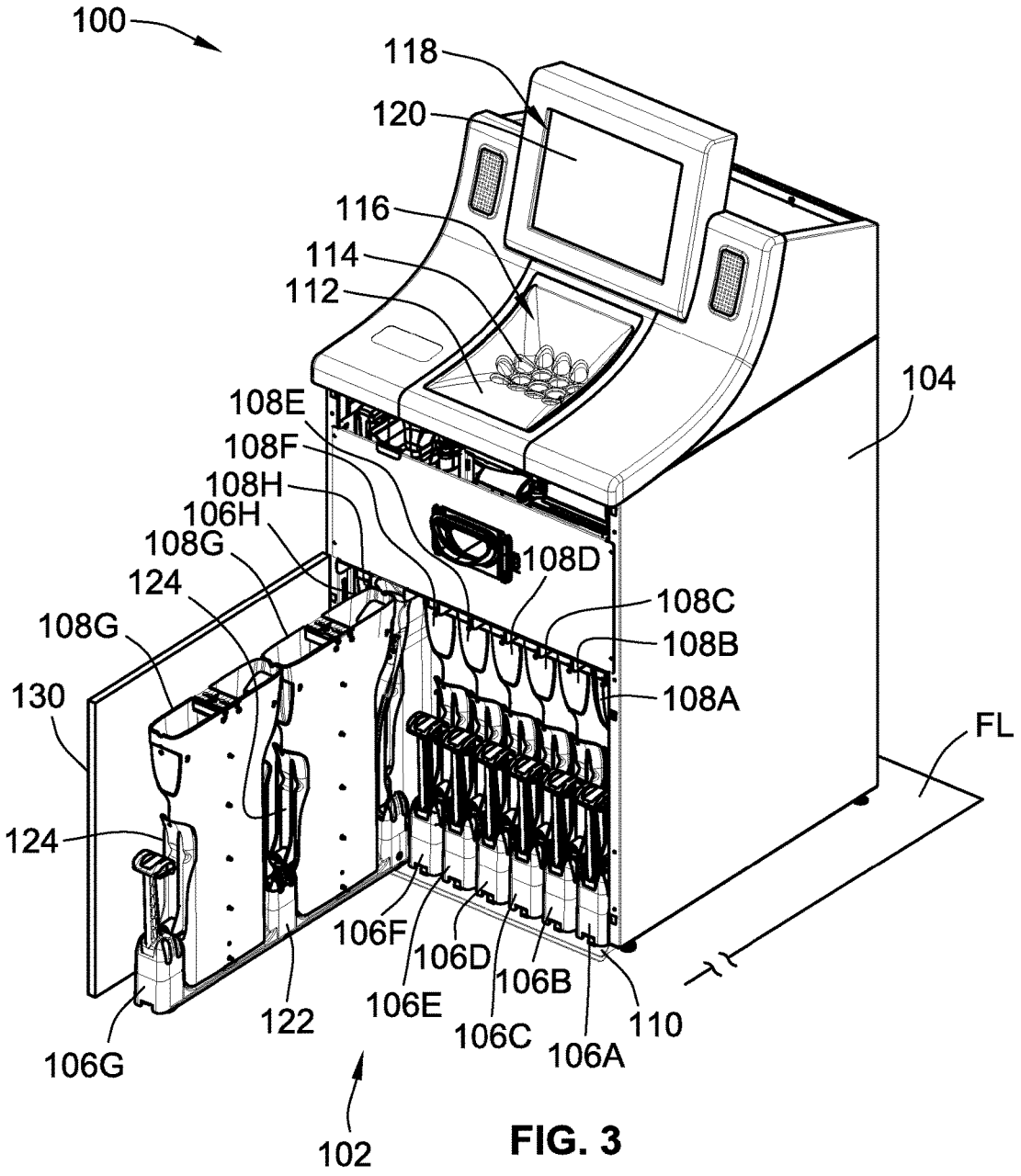
FIG. 3 is a front perspective-view illustration of an example of a coin processing machine in accordance with aspects of the present disclosure.

Another example of a currency processing system is illustrated in accordance with aspects of this disclosure in FIG. 3, this time represented by a coin processing machine

100. The coin processing machine 100 has a coin tray 112 that holds coins prior to and/or during inputting some or all of the coins in the coin tray 112 into the coin processing machine 100. The coin tray 112 may be configured to transfer coins deposited thereon, e.g., by pivoting upwards and/or by downwardly sloping coin surfaces, to a coin sorting mechanism (not visible in FIG. 3; may correspond to coin processing unit 200 of FIG. 4) disposed within a cabinet or housing 104. The coins are transferred from the coin tray 112 to the sorting mechanism, under the force of gravity, via a funnel arrangement 114 formed in a coin input area 116 of the cabinet 104. Once processed, the coin sorting mechanism discharges sorted coins to a plurality of coin bags or other coin receptacles that are housed within the cabinet (or "housing") 104.

A user interface 118 interacts with a controller (e.g., controller 38 of FIG. 2) of the coin processing machine 100. The controller is operable, in at least some embodiments, to control the initiation and termination of coin processing, to determine the coin totals during sorting, to validate the coins, and to calculate or otherwise determine pertinent data regarding the sorted coins. The user interface 118 of FIG. 3 includes a display device 120 for displaying information to an operator of the coin processing machine 100. Like the display device 12 illustrated in FIG. 1, the display device 120 of FIG. 3 may also be capable of receiving inputs from an operator of the coin processing machine 100, e.g., via a touchscreen interface. Inputs from an operator of the coin processing machine 100 can include selection of predefined modes of operation, instructions for defining modes of operation, requests for certain outputs to be displayed on the display device 120 and/or a printer (not shown), identification information, such as an identification code for identifying particular transactions or batches of coins, etc.

During an exemplary batch sorting operation, an operator dumps a batch of mixed coins into the coin tray 112 and inputs an identification number along with any requisite information via the interface 118. The operator (or the machine 100) then transfers some or all of the coins within the coin tray 112 to the sorting mechanism through the coin input area 116 of the cabinet 104. Coin processing may be initiated automatically by the machine 100 or in response to a user input. While the coins are being sorted, the operator can deposit the next batch of coins into the coin tray 112 and enter data corresponding to the next batch. The total value of each processed (e.g., sorted, denominated and authenticated) batch of coins can be redeemed, for example, via a printed receipt or any of the other means disclosed herein.

The coin processing machine 100 has a coin receptacle station 102 disposed within the housing 104. When the coin processing machine 100 is disposed in a retail setting or other publicly accessible environment, e.g., for use as a retail coin redemption machine, the coin receptacle station 102 can be secured inside housing 104, e.g., via a locking mechanism, to prevent unauthorized access to the processed coins. The coin receptacle station 102 includes a plurality of moveable coin-receptacle platforms 106A-H ("moveable platforms"), each of which has one or more respective coin receptacles 108A-H disposed thereon. Each moveable platform 106A-H is slidably attached to a base 110, which may be disposed on the ground beneath the coin processing machine 100, may be mounted to the coin processing machine 100 inside the housing 104, or a combination thereof. In the illustrated embodiment, the coin receptacle station 102 includes eight moveable coin-receptacle platforms 106A-H, each of which supports two coin receptacles 108A-H, such that the coin processing machine 100 accommodates as many as sixteen individual receptacles. Recognizably, the coin processing machine 100 may accommodate greater or fewer than sixteen receptacles that are supported on greater or fewer than eight coin-receptacle platforms.

The coin receptacles 108A-H of the illustrated coin receptacle station 102 are designed to accommodate coin bags. Alternative variations may be designed to accommodate coin cassettes, cashboxes, coin bins, etc. Alternatively still, the moveable platforms 106A-H may have more than one type of receptacle disposed thereon. In normal operation, each of the coin receptacles 108A-H acts as a sleeve that is placed inside of a coin bag to keep coins within a designated volume during filling of the coin bag. In effect, each coin receptacle 108A-H acts as an internal armature, providing an otherwise non-rigid coin bag with a generally rigid internal geometry. Each of the platforms 106A-H includes a coin bag partition 122 that separates adjacent coin bags from one another for preventing coin bags from contacting adjacent coin bags and disrupting the flow of coins into the coin bags. For other embodiments, each moveable platform 106A-H may include multiple partitions 122 to accommodate three or more coin receptacles 108A-H. The moveable platforms 106A-H also include bag clamping mechanisms 124 for each of the coin receptacles 108A-H. Each bag clamping mechanism 124 operatively positions the coin bag for receiving processed coins, and provides structural support to the coin receptacle 108A-H when the moveable platform 106A-H is moved in and out of the machine.

The number of moveable platforms 106A-H incorporated into the coin processing machine 100 can correspond to the number of coin denominations to be processed. For example, in the U.S. coin set: pennies can be directed to the first coin receptacles 108A disposed on the first moveable platform 106A, nickels can be directed to the second coin receptacles 108B disposed on the second moveable platform 106B, dimes can be directed to the third coin receptacles 108C disposed on the third moveable platform 106C, quarters can be directed to the fourth coin receptacles 108D disposed on the fourth moveable platform 106D, half-dollar coins can be directed to the fifth coin receptacles 108E disposed on the fifth moveable platform 106E, dollar coins can be directed to the sixth coin receptacles 108F disposed on the sixth moveable platform 106F. The seventh and/or eighth moveable platforms 106G, 106H can be configured to receive coin overflow, invalid coins, or other rejected coins. Optionally, coins can be routed to the coin receptacles 108A-H in any of a variety of different manners. For example, in the illustrated configuration, if the operator of the coin processing machine 100 is anticipating a larger number of quarters than the other coin denominations, three or more of the coin receptacles 108A-H on the moveable platforms 106A-H may be dedicated to receiving quarters. Alternatively, half-dollar coins and dollar coins, of which there are fewer in circulation and regular use than the other coin denominations, can each be routed to a single dedicated coin receptacle.

In operation, an operator of the coin processing machine 100 who desires to access one or more of the coin receptacles 108A-H unlocks and opens a front door 130 of the housing 104 to access the coin receptacle station 102. Depending on which coin receptacle(s) the operator needs to empty, for example, the operator slides or otherwise moves one of the moveable coin-receptacle platforms 106A-H from a first "stowed" position inside the housing 104 (e.g., moveable platform 106A in FIG. 3) to a second "extracted" position outside of the housing 104 (e.g., moveable platform 106G in FIG. 3). If any of the coin bags are filled and need to be replaced, the operator may remove filled coin bags from the extracted movable platform, replace the filled coin bags with empty coin bags, return the movable platform to the stowed position, and subsequently shut and lock the front door 130.

Figure 4:
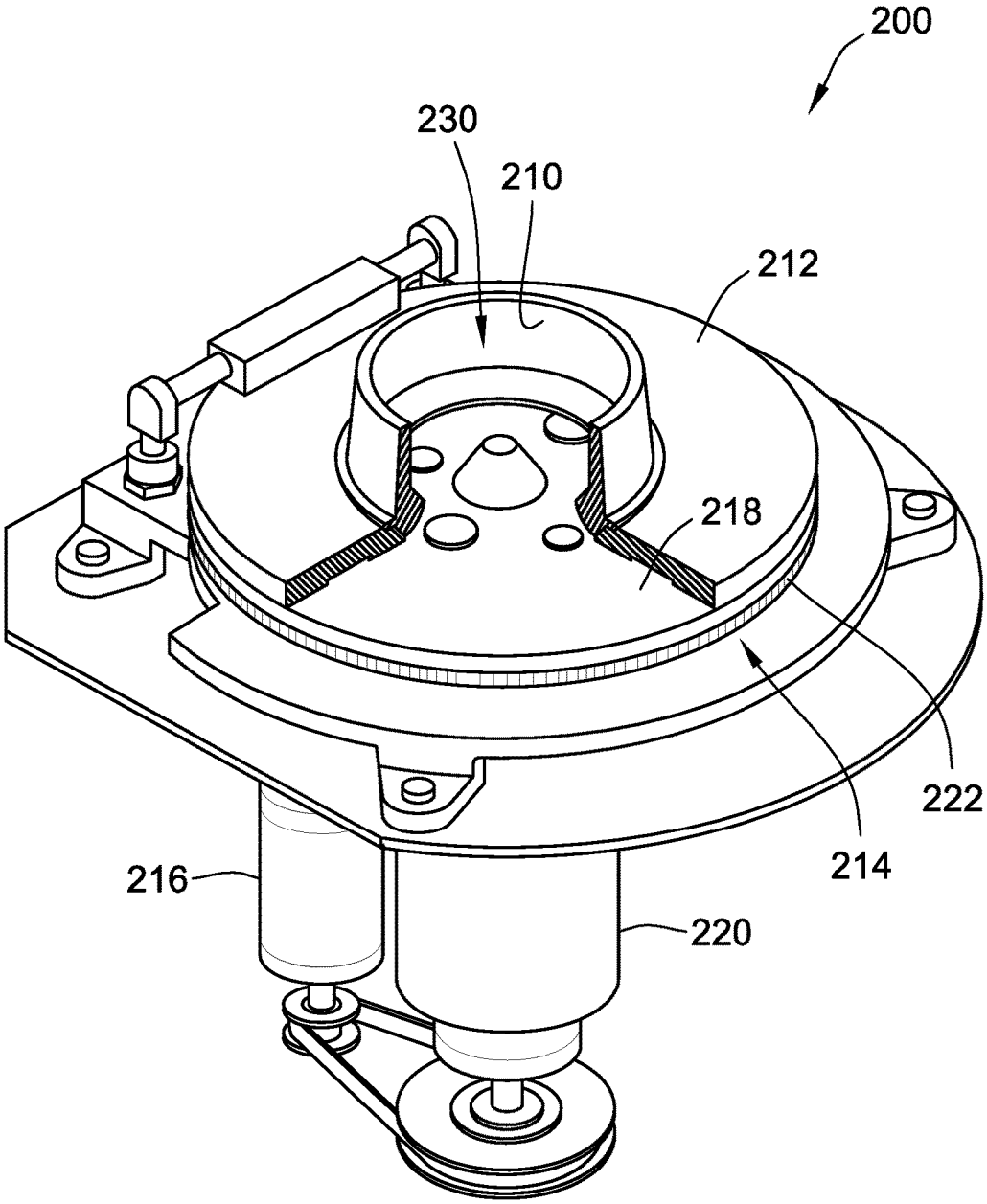
FIG. 4 is a partially broken away perspective-view illustration of an example of a disk-type coin processing unit in accordance with aspects of the present disclosure.

FIG. 4 shows a non-limiting example of a coin sorting device, represented herein by a disk-type coin processing unit 200 that can be used in any of the currency processing systems, methods and devices disclosed herein. The coin processing unit 200 includes a hopper channel, a portion of which is shown at 210, for receiving coins of mixed denominations from a coin input area (e.g., coin input areas 14 or 116 of FIGS. 1 and 3). The hopper channel 210 feeds the coins through a central opening 230 in an annular, stationary sorting head 212. As the coins pass through this opening, the coins are deposited onto the top surface of a resilient pad 218 disposed on a rotatable disk 214. According to some embodiments, coins are initially deposited by a user onto a coin tray (e.g., coin tray 112 of FIG. 3) disposed above the coin processing unit 200; coins flow from the coin tray into the hopper channel 210 under the force of gravity.

This rotatable disk 214 is mounted for rotation on a shaft (not visible) and driven by an electric motor 216. The rotation of the rotatable disk 214 of FIG. 4 is slowed and stopped by a braking mechanism 220. The disk 214 typically comprises a resilient pad 218, preferably made of a resilient rubber or polymeric material, that is bonded to, fastened on, or integrally formed with the top surface of a solid disk 222. The resilient pad 218 may be compressible such that coins laying on the top surface thereof are biased or otherwise pressed upwardly against the bottom surface of the sorting head 212 as the rotatable disk 214 rotates. The solid disk 222 is typically fabricated from metal, but it can also be made of other materials, such as a rigid polymeric material.

The underside of the inner periphery of the sorting head 212 is spaced above the pad 218 by a distance which is approximately the same as or, in some embodiments, just slightly less than the thickness of the thinnest coin. While the disk 214 rotates, coins deposited on the resilient pad 218 tend to slide outwardly over the top surface of the pad 218 due to centrifugal force. As the coins continue to move outwardly, those coins that are lying flat on the pad 218 enter a gap between the upper surface of the pad 218 and the lower surface of the sorting head 212. As is described in further detail below, the sorting head 212 includes a plurality of coin directing channels (also referred to herein as"exit channels") for manipulating the movement of the coins from an entry area to a plurality of exit stations (or "exit slot") where the coins are discharged from the coin processing unit 200. The coin directing channels may sort the coins into their respective denominations and discharge the coins from exit stations in the sorting head 212 corresponding to their denominations.

Figure 5:
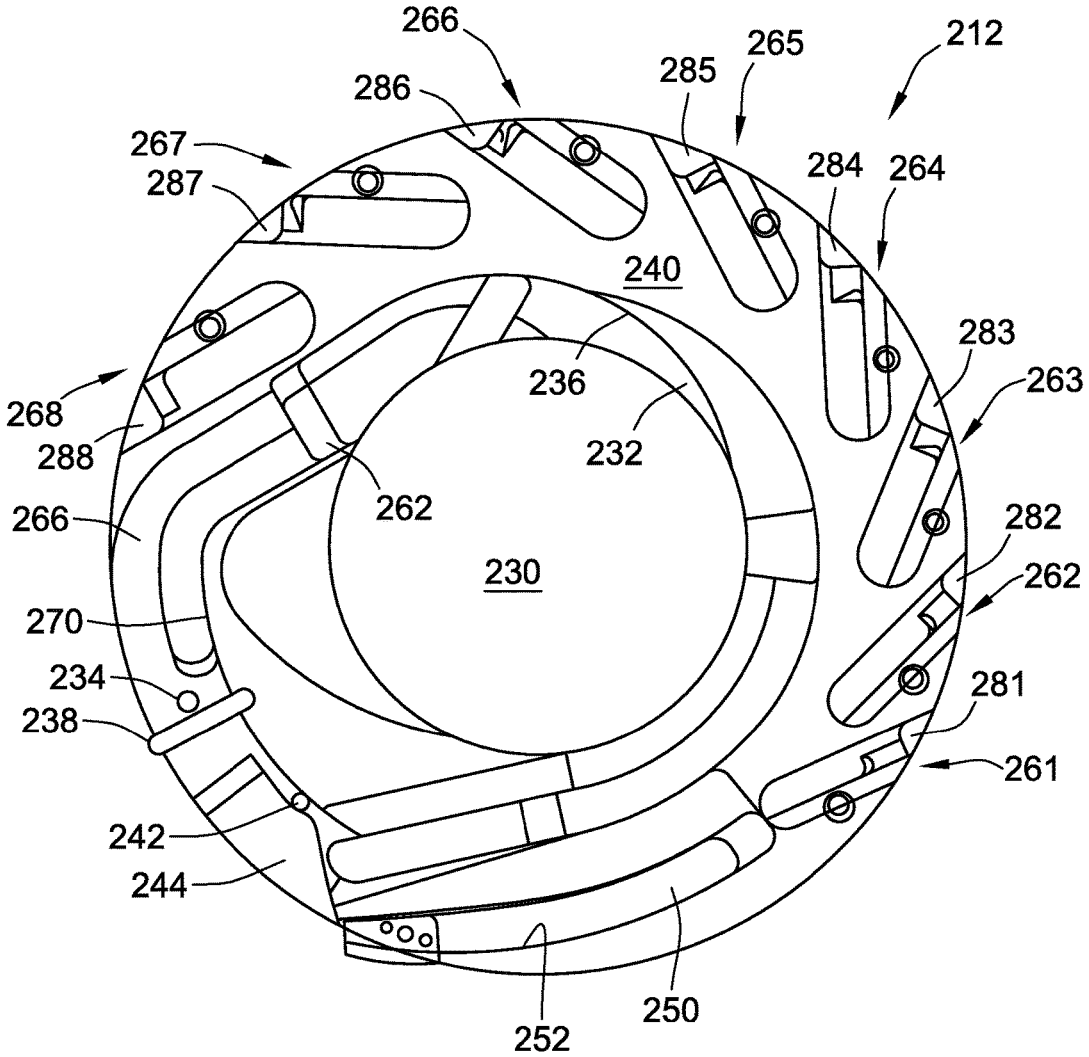
FIG. 5 is an enlarged bottom-view illustration of the sorting head of the exemplary disk-type coin processing unit of FIG. 4.

Referring now to FIG. 5, the underside of the sorting head 212 is shown. The coin set for a given country can be sorted by the sorting head 212 due to variations in the diameter and/or thickness of the individual coin denominations. For example, according to the United States Mint, the U.S. coin set has the following diameters:

Penny=0.750 in. (19.05 mm)
Nickel=0.835 in. (21.21 mm)
Dime=0.705 in. (17.91 mm)
Quarter=0.955 in. (24.26 mm)
Half Dollar=1.205 in. (30.61 mm)
Presidential One Dollar=1.043 in. (26.49 mm)

The coins circulate between the stationary sorting head 212 and the rotating pad 218 on the rotatable disk 214, as shown in FIG. 4. Coins that are deposited on the pad 218 via the central opening 230 initially enter an entry channel 232 formed in the underside of the sorting head 212. It should be kept in mind that the circulation of the coins in FIG. 5 appears counterclockwise as FIG. 5 is a view of the underside of the sorting head 212.

An outer wall 236 of the entry channel 232 divides the entry channel 232 from the lowermost surface 240 of the sorting head 212. The lowermost surface 240 is preferably spaced from the pad 218 by a distance that is slightly less than the thickness of the thinnest coins. Consequently, the initial outward radial movement of all the coins is terminated when the coins engage the outer wall 236, although the coins continue to move more circumferentially along the wall 236 (e.g., in a counterclockwise direction in FIG. 5) by the rotational movement imparted to the coins by the pad 218 of the rotatable disk 214.

While the pad 218 continues to rotate, those coins that were initially aligned along the wall 236 move across the ramp 262 leading to a queuing channel 266 for aligning the innermost edge of each coin along an inner queuing wall 270. The coins are gripped between the queuing channel 266 and the pad 218 as the coins are rotated through the queuing channel 266. The coins, which were initially aligned with the outer wall 236 of the entry channel 232 as the coins move across the ramp 262 and into the queuing channel 266, are rotated into engagement with inner queuing wall 270. As the pad 218 continues to rotate, the coins which are being positively driven by the pad move through the queuing channel 266 along the queuing wall 270 past a trigger sensor 234 and a discrimination sensor 238, which may be operable for discriminating between valid and invalid coins. In some embodiments, the discrimination sensor 238 may also be operable to determine the denomination of passing coins. The trigger sensor 234 sends a signal to the discrimination sensor 238 that a coin is approaching.

In the illustrated example, coins determined to be invalid are rejected by a diverting pin 242 that is lowered into the coin path such that the pin 242 impacts the invalid coin and thereby redirects the invalid coin to a reject channel 244. In some embodiments, the reject channel 244 guides the rejected coins to a reject chute that returns the coin to the user (e.g., rejected coins ejected into the coin reject tube 33 to the coin dispensing receptacle 22 of FIG. 2). The diverting pin 242 depicted in FIG. 5 remains in a retracted "non-diverting" position until an invalid coin is detected. Those coins not diverted into the reject channel 244 continue along inner queuing wall 270 to a gauging region 250. The inner queuing wall 270 terminates just downstream of the reject channel 244; thus, the coins no longer abut the inner queuing wall 270 at this point and the queuing channel 266 terminates. The radial position of the coins is maintained, because the coins remain under pad pressure, until the coins contact an outer wall 252 of the gauging region 250.

The gauging wall 252 aligns the coins along a common outer radius as the coins approach a series of coin exit channels 261-268 which discharge coins of different denominations through corresponding exit stations 281-288. The first exit channel 261 is dedicated to the smallest coin to be sorted (e.g., the dime in the U.S. coin set). Beyond the first exit channel 261, the sorting head 212 shown in FIGS. 4 and 5 forms seven more exit channels 262-268 which discharge coins of different denominations at different circumferential locations around the periphery of the sorting head 212. Thus, the exit channels 261-268 are spaced circumferentially around the outer periphery of the sorting head 212 with the innermost edges of successive channels located progressively closer to the center of the sorting head 212 so that coins are discharged in the order of increasing diameter. The number of exit channels can vary according to alternative embodiments of the present disclosure.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 218. To maintain a constant radial position of the coins, the pad 218 continues to exert pressure on the coins as they move between successive exit channels 261-268.

Further details of the operation of the sorting head 212 shown in FIGS. 4 and 5 are disclosed in U.S. Patent Application Publication No. US 2003/0168309 A1, which is incorporated herein by reference in its entirety. Other disk-type coin processing devices and related features that may be suitable for use with the coin processing devices disclosed herein are shown in U.S. Pat. Nos. 6,755,730; 6,637,576; 6,612,921; 6,039,644; 5,997,395; 5,865,673; 5,782,686; 5,743,373; 5,630,494; 5,538,468; 5,507,379; 5,489,237; 5,474,495; 5,429,550; 5,382,191; and 5,209,696, each of which is incorporated herein by reference in its entirety and for all purposes. In addition, U.S. Pat. Nos. 7,188,720 B2, 6,996,263 B2, 6,896,118 B2, 6,892,871 B2, 6,810,137 B2, 6,748,101 B1, 6,731,786 B2, 6,724,926 B2, 6,678,401 B2, 6,637,576 B1, 6,609,604, 6,603,872 B2, 6,579,165 B2, 6,318,537 B1, 6,171,182 B1, 6,068,194, 6,042,470, 6,039,645, 6,021,883, 5,982,918, 5,943,655, 5,905,810, 5,564,974, and 4,543,969, and U.S. Patent Application Publication Nos. 2007/0119681 A1 and 2004/0256197 A1, are incorporated herein by reference in their respective entireties and for all purposes.

The above referenced U.S. patents and published application described in more detail various operating speeds of the disk-type coin processing devices such as shown in FIG. 4. For example, according to some embodiments, sorting head 212 has an eleven inch diameter and the pad 218 rotates at a speed of approximately three hundred revolutions per minute (300 rpm). According to some embodiments, the sorting head 212 has an eleven inch diameter and the pad 218 rotates at a speed of about 350 rpm. According to some embodiments, the sorting disc 214 has an eleven inch diameter and is capable of sorting a retail mix of coins at a rate of about 3000 coins per minute when operating at a speed for about 250 rpm. A common retail mix of coins is about 30% dimes, 28% pennies, 16% nickels, 15% quarters, 7% half-dollar coins, and 4% dollar coins. According to some embodiments of the coin processing system 200 of FIG. 4, the system 200 is cable of sorting a retail mix of coins at a rate of about 3300 coins per minute when the sorting head 212 has a diameter of eleven inches and the disc is rotated at about 300 rpm. According to some embodiments, the coin processing system 200 is capable of sorting a "Euro financial mix" of coins at rate of about 3400 coins per minute, wherein the sorting head 212 has a diameter of eleven inches and the disc is rotated at about 350 rpm. A common Euro financial mix of coins made up of about 41.1% 2 Euro coins, about 16.7% 1 Euro coins, about 14.3% 50¢ Euro coins, about 13.0% 20¢ Euro coins, about 11.0% 10¢ Euro coins, about 12.1% 5¢ coins and about 8.5% 1¢ Euro coins. According to some embodiments, a coin processing system counts and discriminates at least about 2350 mixed coins per minute or at least about 4280 U.S. nickels per minute, when operating at a speed of about 250 rpm. According to some embodiments, a coin processing system sorts at least about 3300 mixed coins per minute or at least about 6000 U.S. nickels per minute, when operated at a speed of at about 350 rpm.

According to some embodiments, when an eight (8) inch sort head is used to process dimes only and the rotatable disc is operated at 300 rpm, the dimes are counted at a rate of at least about 2200 coins per minute. When only U.S. quarters (diameter=0.955 inch) are counted, the quarters are counted at a rate of at least about 1000 coins per minute. A common retail mix of coins is about 30% dimes, 28% pennies, 16% nickels, 15% quarters, 7% half-dollars, and 4% dollars. When this retail mix of coins is placed in the coin sorter system having an eight (8) inch sort head, the coins are sorted and counted at a rate of at least about 1200 coins per minute. When this same eight (8) inch sort head is used to process dimes only and the rotatable disc is operated at 500 rpm, the dimes are counted at a rate of at least about 3600 coins per minute. When only U.S. quarters are counted, the quarters are counted at a rate of at least about 1600 coins per minute when the disc is rotated at 500 rpm. When the above retail mix of coins is placed in the coin sorter system having an eight (8) inch sort head and the disc is rotated at 500 rpm, the coins are sorted and counted at a rate of at least about 2000 coins per minute.

According to some embodiments, a 13-inch diameter sorting head 212 is operated at various speeds such as 115 rpm, 120 rpm (low-speed mode), 125 rpm, 360 rpm, and 500 rpm (nominal sorting speed).

According to some embodiments, a 13-inch diameter sorting head 212 is operated to count and sort mixed coins at rates in excess of 600, 2000, 3000, 3500, and 4000 coins per minute.

Figure 6:
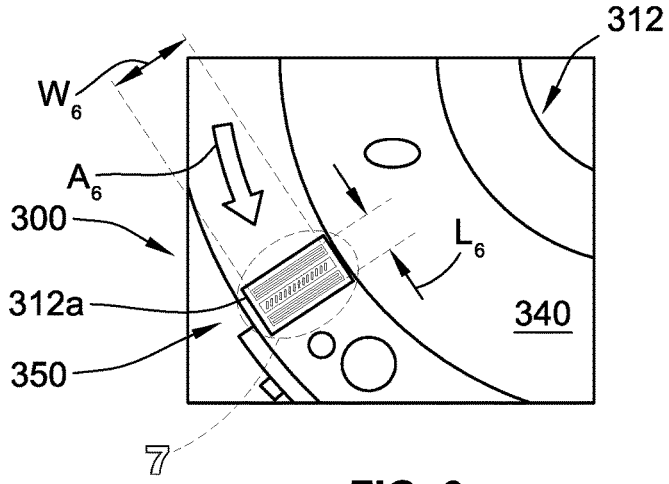
FIG. 6 is an underside perspective-view illustration of the annular sorting head of a disk-type coin processing unit with a representative linear array of optical coin-imaging sensors in accordance with aspects of the present disclosure.

Turning next to FIG. 6, there is shown a coin processing unit, designated generally as 300, for sorting coins, counting coins, authenticating coins, denominating coins, validating coins, and/or any other form of processing coins. As indicated above, the coin processing unit 300 can be incorporated into or otherwise take on any of the various forms, optional configurations, and functional alternatives described herein with respect to the examples shown in FIGS. 1-5, and thus can include any of the corresponding options and features. By way of non-limiting example, the coin processing unit 300 of FIG. 6 may be a disk-type coin processing unit for sorting batches of coins, including batches with coins of mixed denomination, country of origin, etc. The coin processing unit 300 is operatively coupled to the coin input area of a currency processing system (e.g., coin input area 116 of coin processing machine 100) to receive therefrom deposited coins, and is also operatively coupled to one or more coin receptacles (e.g., coin receptacles 108A-H) into which processed coins are deposited. In alternative embodiments, the sensor arrangements disclosed herein can be incorporated into other types of coin processing apparatuses, such as programmable power rail coin processing devices.

Similar to the disk-type coin processing unit 200 of FIGS. 4 and 5, the coin processing unit 300 of FIG. 6 comprises a rotatable disk (not visible in FIG. 6, but structurally and functionally similar to the rotatable disk 214 of FIG. 4) for supporting on an upper surface thereof and imparting motion to coins received from the coin input area of the currency processing system. Like the configuration illustrated in FIG. 4, the rotatable disk of FIG. 6 can be mounted for common rotation with a drive shaft that is driven by an electric motor. A stationary sorting head 312, which is adjacent the rotatable disk, has a lower surface 340 that is located generally parallel to and spaced slight apart from the top surface of the rotatable disk. The lower surface 340 of the sorting head 312 forms a plurality of distinctly shaped regions (or "exit channels"), each of which guides coins of a common diameter, responsive to motion imparted thereto by the rotatable disk, to one of various exit stations through which the coins are discharged from the coin processing unit 300 to the one or more coin receptacles.

A linear array of sensors, designated generally as 350 in FIG. 6, is mounted proximate to, within and/or, as shown, directly on the sorting head 312 adjacent and, in some embodiments, facing the rotatable disk. The linear array of sensors 350 examines or otherwise senses coins seated on the rotatable disk and outputs a signal indicative of coin image information for each of the processed coins. By way of non-limiting example, the linear array of sensors 350 includes a row of rectilinearly aligned optical sensors for detecting topographic variations, surface details, coin wear, and/or other pre-designated characteristics of passing coins. The sensor array 350 has a width $W_6$ parallel to a radius of the rotatable disk and a length $L_6$ perpendicular to its width $W_6$. Coins move past the sensor array 350 in direction $A_6$ which is generally perpendicular to the width $W_6$ of the sensor array 350. The sensor array 350 illuminates passing coins and receives reflected light from passing coins via opening 312*a* in the sorting head 312. For some embodiments, the coin processing unit 300 may include one or more additional sensor arrays positioned, for example, to image obverse and reverse faces of the coin and/or the side of the coin. The sensor array(s) could also extend beyond the sorting disk, for example, in configurations where the coins extend outside the sorting disk. The coin image information signals are stored, for example, in memory device 360 or any other type of computer-readable medium. The memory device 360 can be read, for example, by one or more processors 338 whereby the signals can be interpreted, and an image of the topographic variations in the coin can be generated. The imaging information detected by the sensor array 350 can be processed by array electronics (e.g., an analog signal filter in the sensor circuit 358) and interpreted by imaging software (e.g., stored in a physical, non-transient computer readable medium associated with the processor(s) 338). With the coin image information signals received from the coin imaging sensor system 350, the processor(s) 338 can determine, for example, whether each of the coins is valid or invalid, which may include determining the denomination and/or authenticity of each coin, by comparing the sensed coin image to a previously authenticated image that is stored in a library in the memory device 360.

Figure 7:
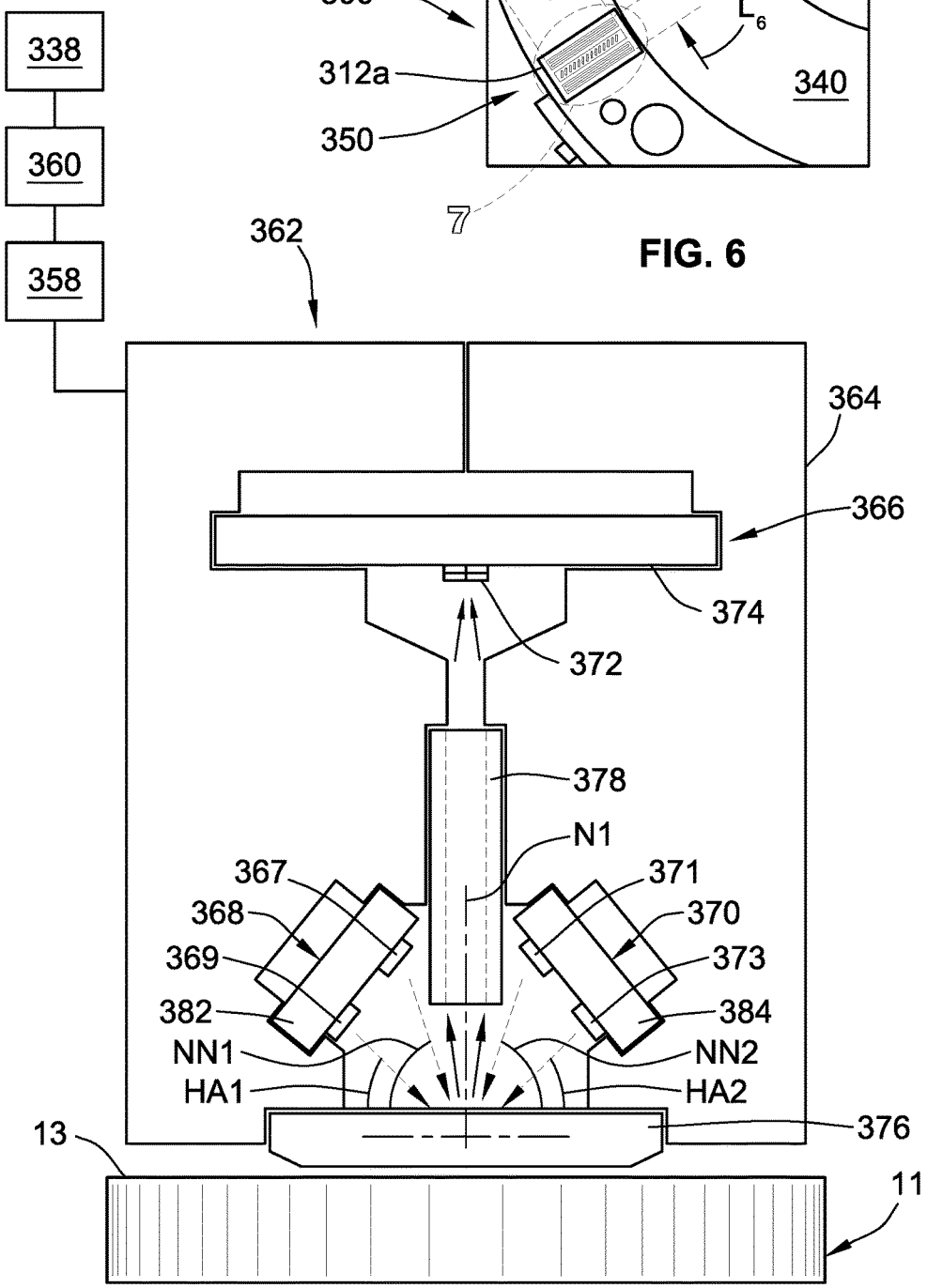
FIG. 7 is a schematic illustration of an example of a linear optical sensor arrangement in accordance with aspects of the present disclosure.

FIG. 7 of the drawings illustrates one of the linear optical sensors (or "sensor arrangement") 362 from the sensor array 350 of FIG. 6. In the illustrated example, the sensor arrangement 362 includes a bipartite housing 364 within which is nested a photodetector 366 and first and second light emitting devices 368 and 370, respectively. Photodetector 366 comprises a linear array of light-sensitive photosensors 372 that detect the presence of visible light, infrared (IR), and/or ultraviolet (UV) light energy. For example, each photosensor may utilize a photoconductive semiconductor in which the electrical conductance varies depending on the intensity of radiation striking the semiconductor. In this regard, the photosensors 372 may take on any of a variety of available configurations, such as photodiodes, bipolar phototransistors, active-pixel sensors (APS), photosensitive field-effect transistors (photoFET), etc. Enclosed within the housing 364 is a printed circuit board (PCB) 374 with a lower surface onto which the photosensors 372 are mounted and oriented with a normal incidence with the upper surface 13 of a passing coin 11. The angle of incidence is the angle between a ray or line incident on a surface and a line perpendicular to that surface at the point of incidence, called the normal N1. For the embodiment of FIG. 7, the angle between a straight line perpendicular to the photosensors 372 and the normal N1 of the coin's upper surface 13 is zero or substantially zero.

The first light emitting device 368 of the sensor arrangement 362 of FIG. 7 comprises multiple light sources for controllably emitting light onto the surface 13 of the passing coin 11 at multiple distinct incidences. By way of example, and not limitation, the light sources of the first light emitting device 368 comprise a first row of light emitting diodes (LED) 367 configured to emit light onto the coin 11 at a first near-normal angle of incidence NN1, and a second row of LEDs 369 configured to emit light onto the coin 11 at a first high-angle of incidence HA1. Likewise, the second light emitting device 370, which is diametrically spaced from the first light emitting device 368 relative to the coin 11, comprises multiple light sources for controllably emitting light onto the surface 13 of the passing coin 11 at multiple distinct incidences. In the illustrated example, the light sources of the second light emitting device 370 comprises a third row of LEDs 371 configured to emit light onto the coin 11 at a second near-normal angle of incidence NN2, and a fourth row of LEDs 373 configured to emit light onto the coin 11 at a second high-angle of incidence HA2. For near-normal incidence, the angle of incidence of illumination is approximately or substantially parallel to, but not completely parallel to the normal of the surface of the coin 11. For example, the first near-normal incidence NN1 may be equal to approximately 5 degrees from the normal N1, while the second near-normal incidence NN2 may be equal to approximately −5 degrees from the normal N1. Comparatively, for high-angle incidence, the angle of incidence of illumination is an oblique angle that is at least approximately 45 degrees from the normal of the coin. In the illustrated embodiment, for example, the first high-angle of incidence HA1 may be equal to approximately 65 degrees from the normal N1 of the coin 11, whereas the second high-angle of incidence HA2 may be equal to approximately −65 degrees from the normal N1.

A transparent quartz cover glass 376 is mounted to the housing 364 under the photodetector 366 to allow light generated by the light emitting devices 368, 370 to pass from the housing 364 to the surface 13 of the coin 11, and to allow light reflected off of the coin 11 to reenter the housing 364 and be captured by the linear array of photosensors 372. Disposed between the photodetector 366 and the passing coin 11 is a lens array 378 for focusing light reflected off of the coin 11 (e.g., via internal refraction) and transmitting the light to the photodetector 366. The lens array 378 may take on a variety of different forms, including a gradient-index (GRIN) lens array or a SELFOC® lens array (SLA), for example.

With continuing reference to FIG. 7, the photodetector 366 senses the time of reflection, intensity and/or incidence angle of the light reflected off of the surface 13 of the coin 11 and outputs a signal indicative of the reflected light as coin image information for optically imaging and processing the coin. One or more processors 338 read or otherwise receive the coin image information signals and determine therefrom whether the passing coin is valid or invalid, which may include determining a denomination, a fitness, a country of origin, or an authenticity, or any combination thereof, of the passing coin by comparing the image data with a library of image data of authentic coins. One or more processors 338 may be operable to selectively simultaneously activate both the first and second light emitting devices 368, 370, and thus all four rows of LEDs 367, 369, 371, 373, to thereby simultaneously provide both high-angle and near-normal illumination (referred to herein as "uniform illumination") of the surface 13 of the passing coin 11. The one or more processors 338 may be further operable to selectively activate only one of the light emitting devices 368, 370 or only the second and fourth rows of high-angle LEDs 369, 373 to thereby provide only high-angle illumination (otherwise referred to herein as "edge-enhanced illumination") of the surface 13 of coin 11. When all four rows of LEDs 367, 369, 371, 373 are turned on such that the coin 11 is illuminated uniformly, the features and details of the surface 13 of coin 11 are visible to the detector. Comparatively, when only high-angle incidence illumination is provided, then an optically edge-enhanced image is obtained, which can be used to measure the topography and wear of the coin. The user can electronically choose the type of illumination suitable for the task required. The sensor arrangement 362 of FIG. 7 allows for real-time electronic selection between the aforementioned types of coin illumination to enable enhanced functionality, such as improved authentication and fitness measurement.

Figure 8:
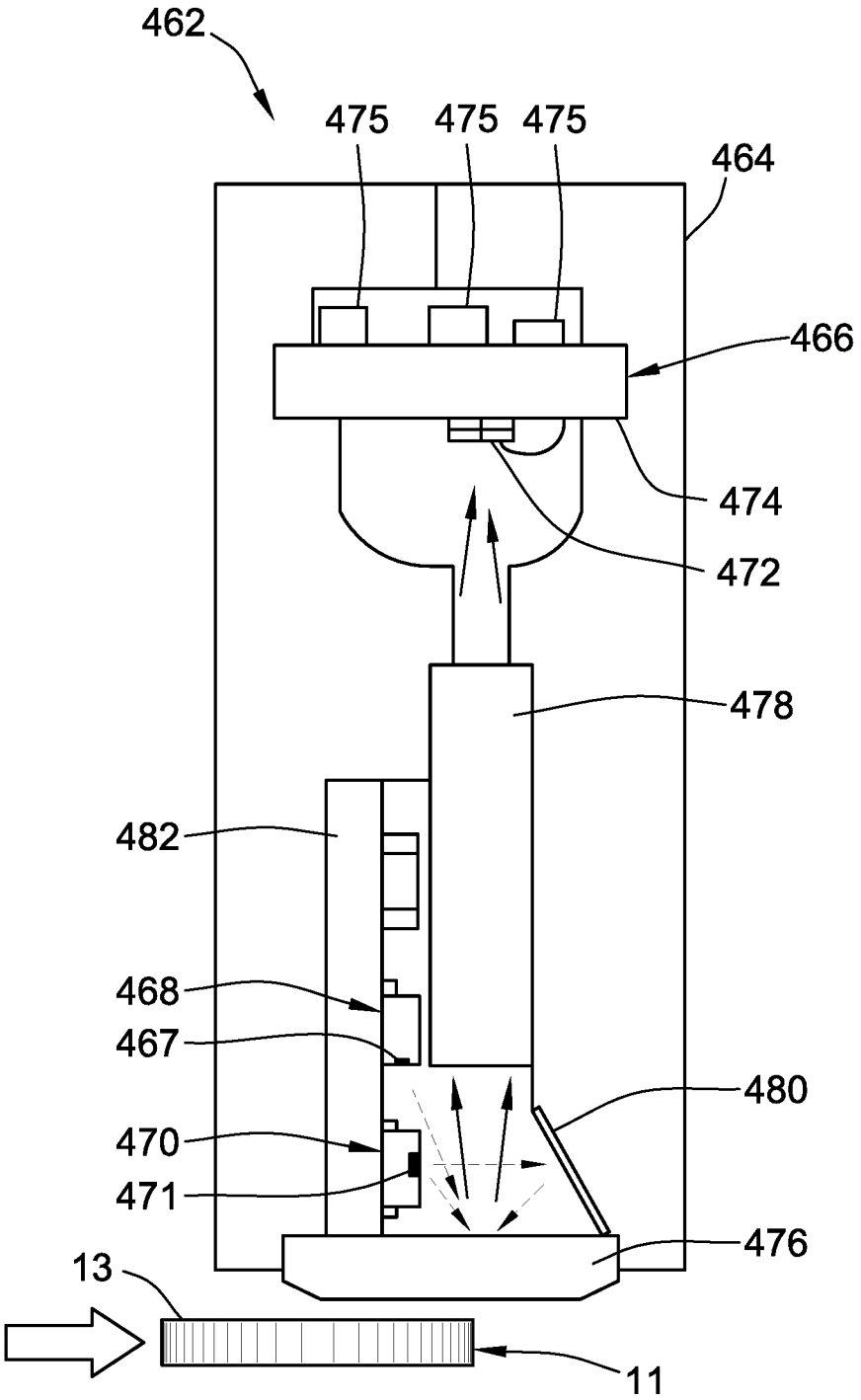
FIG. 8 is a schematic illustration of another example of a linear optical sensor arrangement in accordance with aspects of the present disclosure.
Figure 9:
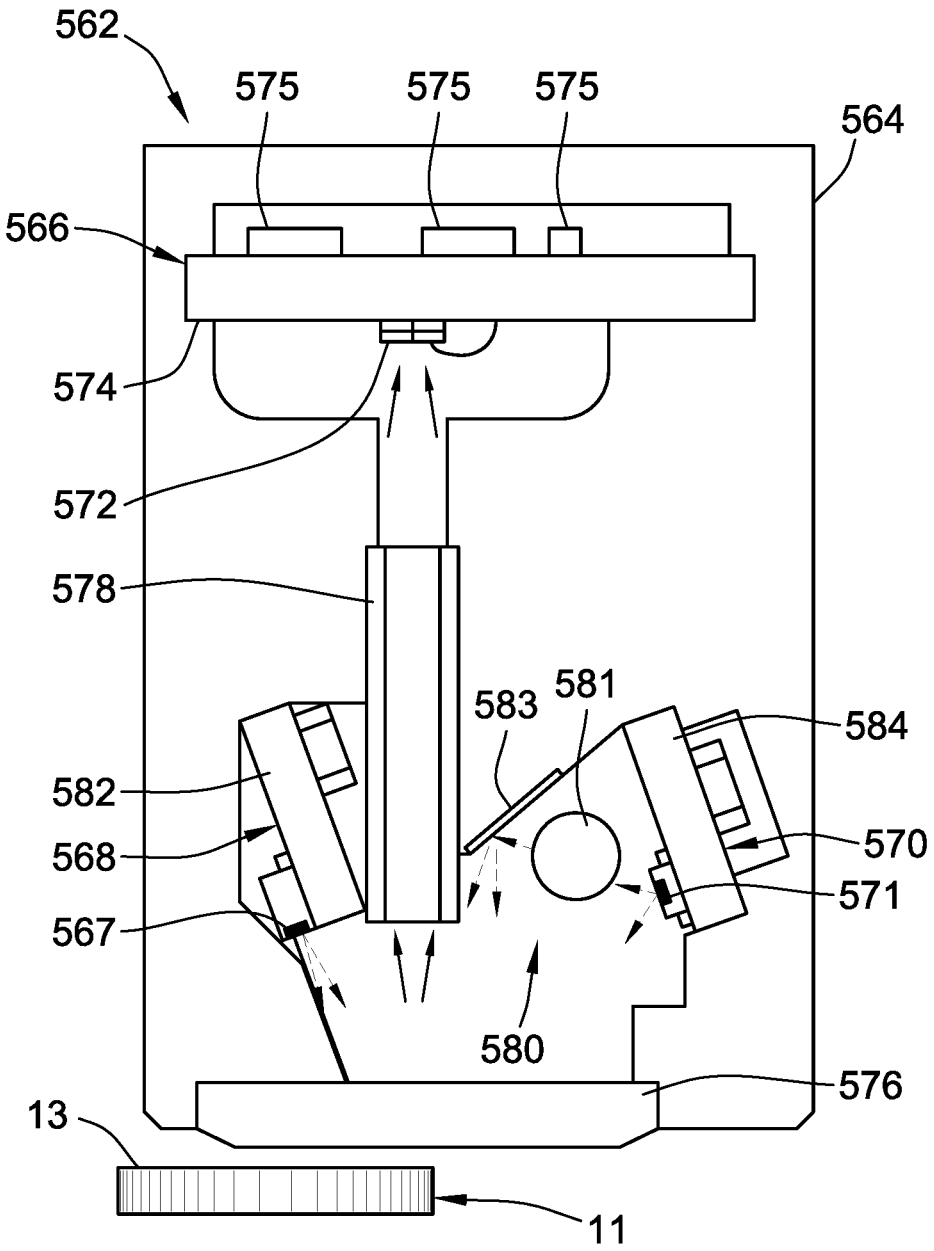
FIG. 9 is a schematic illustration of yet another example of a linear optical sensor arrangement in accordance with aspects of the present disclosure.

Shown in FIGS. 8 and 9 are alternative architectures for the linear optical sensors of the sensor array 350 of FIG. 6. Unless otherwise logically prohibited, the architectures shown in FIGS. 8 and 9 may include any of the features, options and alternatives described above with respect to the architecture in FIG. 7, and vice versa. In the embodiment illustrated in FIG. 8, for example, the sensor arrangement 462 includes a bipartite housing 464 within which is nested a photodetector 466 and first and second light emitting devices 468 and 470, respectively. Like the photodetector 366 of FIG. 7, the photodetector 466 of FIG. 8 comprises a linear array of light-sensitive photosensors 472 that detect the presence of visible light, infrared (IR), and/or ultraviolet (UV) light energy. Enclosed within the housing 464 is a printed circuit board (PCB) 474 with a lower surface onto which the photosensors 472 are mounted and oriented with a normal incidence with the upper surface 13 of a passing coin 11. The PCB 474 supports on an upper surface thereof electronics 475 of the photodetector 466, such as electronics that amplify and process an electronic signal output by a photocell in the photosensor that converts an optical signal into the electronic signal.

In the sensor arrangement 462 of FIG. 8, the first light emitting device 468 comprises one or more light sources for controllably emitting light onto the surface 13 of the passing coin 11 at near-normal incidence. According to one non-limiting example, the first light emitting device 468 comprises a row of light emitting diodes (LED) 467 configured to emit light onto the coin 11 at a near-normal angle of incidence. The second light emitting device 470, however, comprises one or more light sources for controllably emitting light onto the surface 13 of the passing coin 11 at high-angle incidence. In the illustrated example, the second light emitting device 470 comprises a row of LEDs 471 configured to emit light onto the coin 11 at a high-angle of incidence. In contrast to the light emitting devices 368, 370 illustrated in FIG. 7, each light emitting device 468, 470 in the architecture of FIG. 8 is operable to emit light at either high-angle or near-normal incidence. As another point of demarcation, the light emitting devices 468, 470 are both mounted to the same LED printed circuit board (PCB) 482 that is located on the rear side of the housing 464. The light emitting devices 468, 470 are spaced vertically on the LED PCB 482. The light emitting devices 368, 370 of FIG. 7, in contrast, are each mounted to their own respective LED PCB 382 and 384, each of which is positioned at a distinct location within the housing 364. Optionally, the illumination means may comprise a pair of optical waveguides each with multiple LEDs.

Extending across and mounted inside an opening in the housing 464 of the sensor arrangement 462 is a transparent cover glass 476. The cover glass 476 allows light generated by the light emitting devices 468, 470 to pass from the housing 464 to the surface 13 of the coin 11, and then allows light reflected off of the coin 11 to reenter the housing 464 and be captured by the linear array of photosensors 472. Disposed between the photodetector 466 and the passing coin 11 is a lens array 478, such as an SLA or GRIN lens array, for focusing light reflected off of the coin 11 and transmitting the light to the photodetector 466. The architecture of FIG. 8 also utilizes a light diffusing element 480 that is operable to diffuse high-angle incidence light emitted by the second light emitting device 470. In the illustrated example, one or more sections of the inside walls of the sensor housing 464 are coated by scattering media to provide efficient and uniform illumination.

Similar to the sensor arrangements 362, 462 of FIGS. 7 and 8, the sensor arrangement 562 of FIG. 9 includes a rigid outer housing 564 within which is nested a photodetector 566 and a pair of light emitting devices 568 and 570. Like the photodetectors 366 and 466, the photodetector 566 of FIG. 9 comprises a linear array of light-sensitive photosensors 572 that detect the presence of visible light, infrared (IR), and/or ultraviolet (UV) light energy. Enclosed within the housing 564 is a printed circuit board (PCB) 574 with a lower surface onto which the photosensors 572 are mounted and oriented with a normal incidence with the upper surface 13 of a passing coin 11. The PCB 574 also supports on an upper surface thereof electronics 575 which control operation of the photosensors 572.

For the sensor arrangement 562 of FIG. 9, the first light emitting device 568 comprises one or more light sources for controllably emitting light onto the surface 13 of the passing coin 11 at near-normal incidence. By way of example, the first light emitting device 568 comprises a row of light emitting diodes (LED) 567 configured to emit light onto the coin 11 at a near-normal angle of incidence. The second light emitting device 570, in contrast, comprises one or more light sources for controllably emitting light onto the surface 13 of the passing coin 11 at high-angle incidence. For example, the second light emitting device 570 comprises a row of LEDs 571 configured to emit light onto the coin 11 at a high-angle of incidence. Comparable to the light emitting devices 468, 470 of FIG. 8, each light emitting device 568, 570 in the architecture of FIG. 9 is operable to emit light at only -normal incidence or high-angle incidence. In contrast to the architecture of FIG. 8, but comparable to the architecture of FIG. 7, the light emitting devices 568, 570 are each mounted to their own respective LED PCBs 582 and 584 which are diametrically spaced from one another with respect to the coin 11.

A transparent cover glass 576 extends across and closes an opening in the housing 564 of the sensor arrangement 562. The cover glass 576, which is rigidly mounted to the housing 564, allows light generated by the light emitting devices 568, 570 to pass from the housing 564 to the surface 13 of the coin 11, and also allows light reflected off of the coin 11 to enter the housing 564 and be captured by the linear array of photosensors 572. Disposed between the photodetector 566 and the passing coin 11 is a lens array 578, such as an SLA or GRIN lens array, for focusing light reflected off of the coin 11 (e.g., via internal refraction) and transmitting the light to the photodetector 566. The architecture of FIG. 9 also utilizes a light scattering element 580 that is operable to scatter high-angle incidence light emitted by the second light emitting device 570. In the illustrated example, a cylindrical lens 581 and a light scattering wall 583 cooperatively scatter the light emitted by the second light emitting device 570.

Figure 10:
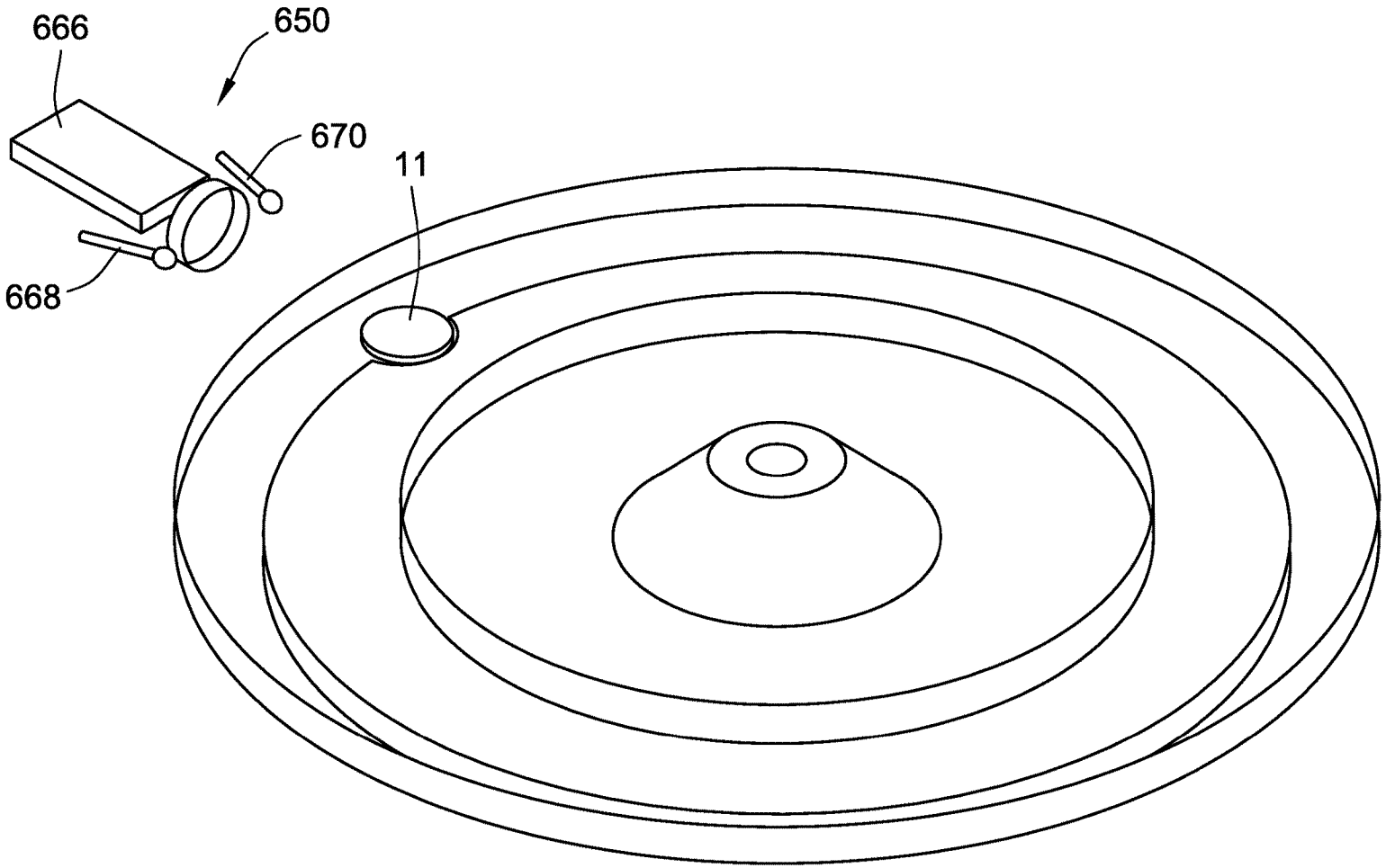
FIG. 10 is a schematic illustration of an example of a linear optical sensor arrangement used to image the side of a coin in accordance with aspects of the present disclosure.

FIG. 10 is a schematic illustration of an example of a linear optical sensor arrangement, designated generally as 650, used to image the side of a coin 11. Unless otherwise logically prohibited, the architecture shown in FIG. 10 may include any of the architectures, features, options and alternatives described above with respect to the sensor arrangements in FIGS. 7-9, and vice versa. The imaging system of FIG. 10 includes one or more light emitting elements 668 and 670 for illuminating the coin 11. Photodetector or photodetector array 666 senses and outputs signals for imaging the side of the coin 11. The coin image information signals are stored, for example, in one or more memory devices (e.g., memory device 360 of FIG. 7) or any other type of computer-readable medium. The memory device(s) can be read, for example, by one or more controllers or processors (e.g., processor(s) 338 of FIG. 7) whereby the signals can be interpreted, and an image of the side of the coin can be generated. The side-imaging sensor arrangement of FIG. 10 can be based on a 1D imaging system or 2D imaging system.

Figure 11A:
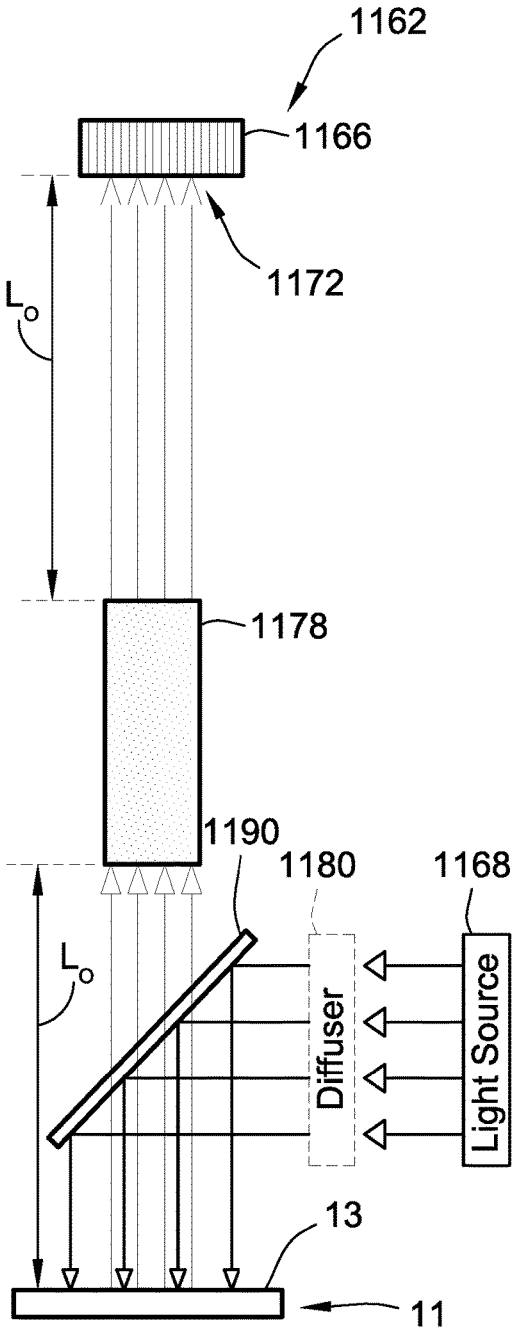
FIGS. 11A and 11B are schematic illustrations of yet other examples of a linear optical sensor arrangement in accordance with aspects of the present disclosure.
Figure 11B:
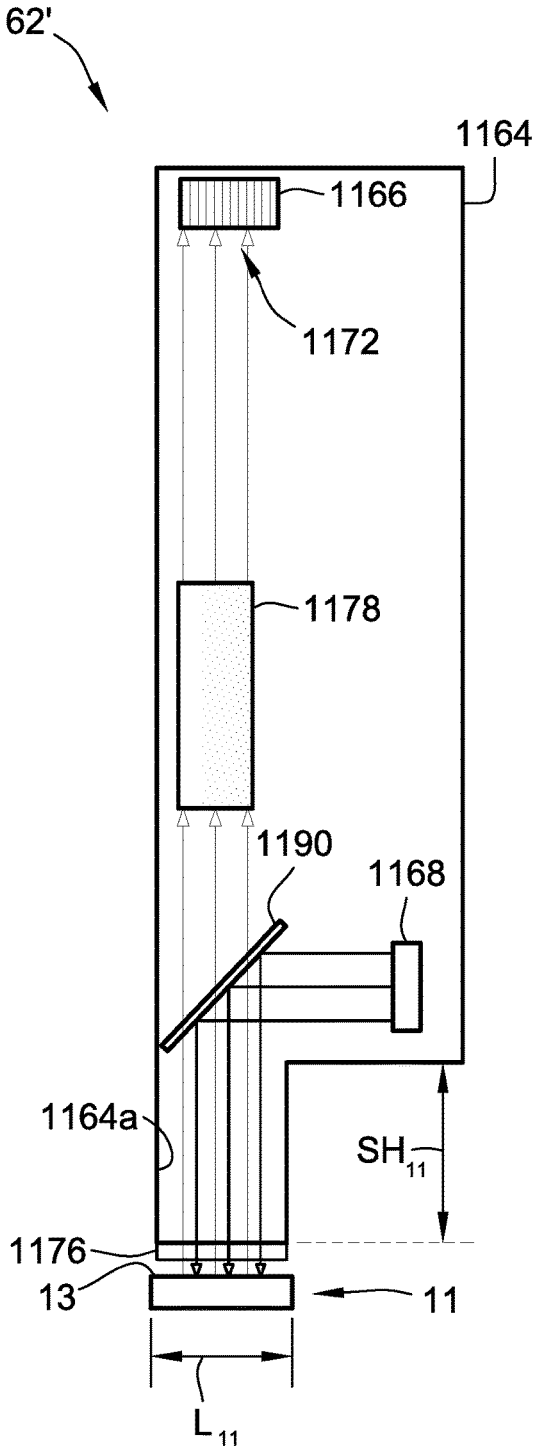

Shown in FIGS. 11A and 11B are alternative architectures for the linear optical sensors of the sensor array 350 of FIG. 6 and/or alternative architectures for the near-normal angle of incidence light sources 367, 371, 467, and/or 567 of FIGS. 7-9. According to some embodiments, the configurations of FIGS. 7-9 may otherwise remain unchanged including the presence of high-angle light sources (e.g., light sources 369, 373, 471, and 571) and their related structures with the light sources 1168 and mirror 1190 being provided in place of or in addition to the near-normal light sources described above in conjunction with FIGS. 7-9 such as light sources, e.g., light emitting diodes 367, 371, 467, 567. According to some embodiments, a Selfoc lens 578 with the proper working distance (Lo) will have to be used to accommodate the change in mechanical dimensions. According to some embodiments, high-angle light sources such as, e.g., light sources 369, 373, 471, and 571, are not included and the sensor arrangements 1162, 1162' only include the normal or near-normal illumination. Unless otherwise logically prohibited, the architectures shown in FIGS. 11A and 11B may include any of the features, options and alternatives described above with respect to the architectures in FIGS. 6-9, and vice versa.

FIGS. 11A and 11B are schematic illustrations of yet other examples of a linear optical sensor arrangement in accordance with aspects of the present disclosure. In the embodiments illustrated in FIGS. 11A and 11B, for example, the sensor arrangement 1162 includes a bipartite or multipart housing 1164 (shown in FIG. 11B only but present in FIG. 11A as well) within which is nested a photodetector 1166 and at least first light emitting devices 1168. Like the photodetector 366 of FIG. 7, the photodetector 1166 of FIGS. 11A and 11B comprise a linear array of light-sensitive photosensors 1172 that detect the presence of visible light, infrared light (IR), and/or ultraviolet light (UV) energy. Enclosed within the housing 1164 is a printed circuit board (PCB) (not shown) with a lower surface onto which the photosensors 1172 are mounted and oriented with a normal or near-normal incidence with the respect to the expected orientation of the upper surface 13 of a passing coin 11. The PCB may support on an upper surface thereof electronics of the photodetector 1166, such as electronics that amplify and process an electronic signal output by a photocell in the photosensor that converts an optical signal into the electronic signal.

In the sensor arrangements 1162 and 1162' of FIGS. 11A and 11B, a first light emitting device 1168 comprises one or more light sources for controllably emitting light onto the surface 13 of the passing coin 11 at normal or near-normal incidence. According to one non-limiting example, the first light emitting device 1168 comprises one or more rows of light emitting diodes (LED), employed with or without the use of optical waveguides or light guides, configured to emit light onto the coin 11 at a normal or near-normal angle of incidence. According to some embodiments, one type of light guide that may be used is a PX-8530 W made by Pixon Technologies.

Although not illustrated, as mentioned above, according the some embodiments, the sensor arrangements 1162 and 1162' of FIGS. 11A and 11B may comprise second light emitting devices comprising one or more light sources for controllably emitting light onto the surface 13 of the passing coin 11 at high-angle incidence (such as light sources 369, 373, 471, and 571). As described above, in embodiments employing both near-normal light sources 1168 and high-angle light sources, a processor such as processor 338 may operate or activate the near-normal light sources 1168 and high-angle light sources either simultaneously or with only the near-normal light source 1168 being illuminated, or only the high-angle light sources being turned on at any given time to vary the type of illumination incident on the surface 13 of a passing coin 11.

Figure 12:
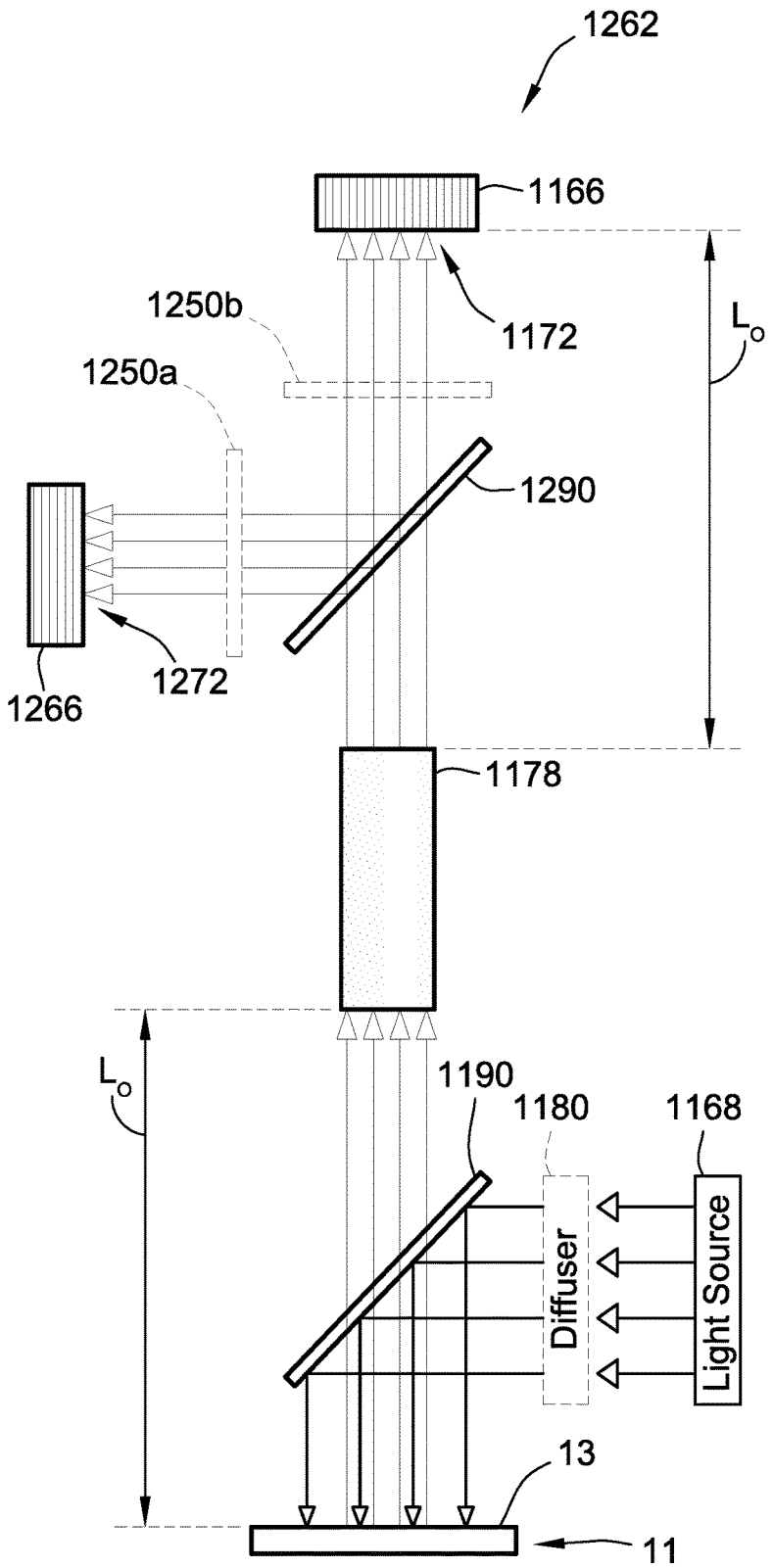
FIG. 12 is a schematic illustration of yet other examples of a linear optical sensor arrangement in accordance with aspects of the present disclosure.

The one or more light sources of the first light emitting device 1168 and/or the one or more light sources of the second light emitting device may emit visible spectrum light, infrared spectrum light (IR), and/or ultraviolet (UV) spectrum light. The same is true for the first and second light emitting devices of FIGS. 7-10. According to some embodiments, one or more light filters are disposed in front of the one or more detectors 1172 of the sensor arrangements 1162 and 1162' (and/or 362, 462, 562, 650) and/or light sources 1168 (e.g., individual LEDs) to allow multiwavelength illumination and selective and/or simultaneous detection of coin images using different parts of the optical spectrum, from UV to visible to IR. Examples of the use of optical filters are illustrated in FIG. 12.

The sensor arrangements 1162 and 1162' of FIGS. 11A and 11B employ one or more half mirrors 1190. According some embodiments, the one or more half mirrors 1190 are employed to re-direct light traveling from lights sources 1168 at an angle near parallel to the surface 13 of a passing coin 11 and direct the light approximately 90° so as to strike the surface 13 of a passing coin 11 at a normal or near-normal angle. Light striking the surface 13 of a passing coin 11 is reflected back into the housing 1164, through the one or more half-mirrors 1190 toward the photodetector 1166. According to some embodiments, the one or more half mirrors 1190 are 50/50 mirrors for reflection and transmission. Optical waveguides or light guides may also be optionally employed to direct light from light sources onto the surface 13 of the coin 11 and/or onto half mirror 1190. According to some embodiments employing waveguides, the light source(s) 1168 may be LEDs or fluorescent tubes.

According to some embodiments, use of the one or more half mirrors 1190, could affect the working distance (Lo) of the lens 1178. The choice of a lens with a specific working distance (Lo) is determined by the sensor geometry. For example, there are different SELFOC lens with differing working distances. According to some embodiments, the working distance (Lo) of lens 1178 is over 11 mm such as when lens 1178 is a SLA 09A made by NSG (Nippon Specialty Glass) which has some embodiments with a working distance of 13.80 mm. Depending on the working distance (Lo) desired for particular applications, an appropriate SELFOC lens can be selected. Other optical lens arraignments performing in a similar way as SELFOC lens could also be used.

According to some embodiments, the sensor arrangements 1162 and 1162' have a scan width which corresponds to distance $W_6$ shown in FIG. 6 of 36-48 mm. According to some embodiments, three (3) or four (4) chips, each chip having a linear array of light-sensitive photosensors 1172 and each chip having a scan width of 12 mm, are employed to achieve an overall scan width of 36-48 mm. In some embodiments, the scan width is chosen to be larger than the diameter of the largest coin to be imaged by the sensor arrangement 1162, 1162'.

According to some embodiments, the one or more light sources of the first light emitting device 1168 and/or the one or more light sources of the second light emitting device may comprise one or more LED arrays and/or one or more optical waveguides for directing light from the light sources to the one or more half mirrors 1190. Optionally, the illumination means may comprise a pair of optical waveguides or light guides each with multiple LEDs.

Extending across and mounted inside an opening in the housing 1164 of the sensor arrangement 1162, 1162' is a transparent cover glass 1176 (shown only in FIG. 11B, but also present in FIG. 11A). The cover glass 1176 allows light generated by the light emitting devices 1168 (and the high-angle light source in embodiments where high-angle light sources are present) to pass from the housing 1164 to the surface 13 of the coin 11, and then allows light reflected off of the coin 11 to reenter the housing 1164 and be captured by the linear array of photosensors 1172. Disposed between the photodetector 1166 and the passing coin 11 is a lens array 1178, such as an SLA or GRIN lens array, for focusing light reflected off of the coin 11 and transmitting the light to the photodetector 1166. The architecture of FIGS. 11A and 11B may also utilize a light diffusing element 1180 that is operable to diffuse light emitted by the light source 1168. Referring to FIG. 11A, the diffuser 1180 may be used to spread out the intensity of illumination coming from the light source 1168 to provide a more uniform distribution of light intensity striking half-mirror 1190. For example, according to some embodiments, the light source 1168 comprises one or more rows of LEDs which may generate generally point sources light such that the light intensity directly in front of each LED is large and in between two adjacent LEDs the light intensity is low. According to some embodiments, the diffuser 1180 spreads out the illumination so a more uniform intensity distribution is achieved. According to some embodiments, light traveling in a generally horizontal direction from the light source 1168 emerges from the diffuser 1180 still traveling in a generally horizontal direction. In some embodiments, the diffuser 1180 is a very thin piece of frosted glass. According to some embodiments, one or more sections of the inside walls 1164*a* of the sensor housing 1164 (such as near cover glass 1176) are coated by scattering media to provide efficient and uniform illumination.

According to some embodiments, multiple rows of LEDs and/or waveguides may be employed to provide a wider or sider area of illumination. While some of the above embodiments are described as employing LED arrays, desired illumination may be obtained without employing linear arrays of LEDs. For example, waveguides and/or light guides may direct light to the desired locations with the desired distribution over a scan area (e.g., the surface of a passing coin) with or without employing linear arrays of LEDs. For example, waveguide may be employed to achieve required uniformity of illumination and to appropriately diffuse light over a desired scan area. Some exemplary materials that may be employed in waveguides include glass, quartz, and plastic.

According to some embodiments, the sensor arrangements 1162 and 1162' have a scan width of 36-48 mm which corresponds to distance $W_6$ shown in FIG. 6. According to some embodiments, the window opening for cover glass 1176 has a length $L_{11}$ in the general direction of the arcuate movement of passing coins (corresponding to length $L_6$ of FIG. 6) of about 7.5 mm. According to some embodiments, the width of the window opening 312*a* for the cover glass is slightly longer than the corresponding scan width, e.g., 38-50 mm in the above example.

According to some non-limiting embodiments, the housing 1164 of the sensor arrangement 1162' has a lower portion having a reduced cross-section and the sensor arrangement 1162' has a shoulder distance $SH_{11}$ of about 11-14 mm. The reduced cross-section of the sensor arrangement 1162' facilitates the bottom portion of the housing 1164 of the sensor arrangement fitting within the opening 312*a* in the sorting head 312 shown in FIG. 6. According to some embodiments, the cover glass 1176 is a 1.0 mm thick Sapphire. According to some embodiments, the cover glass 1176 may be quartz. According to some embodiments, the bottom of the cover glass 1176 should be slightly recessed from, slightly protruding from, or flush with the lower surface 340 of the sorting head 312 so that the passing coin 11 does not contact the cover glass 1176. The vertical position of the sensor arrangement 1162, 1162' can be adjusted up or down to position the cover glass 1176 at the appropriate level. The shoulder distance $SH_{11}$ influences how far a reduced cross-section of the sensor arrangement 1162, 1162' may project through a sensor arrangement opening in the sorting head 312 (see FIG. 6). If a given shoulder distance $SH_{11}$ is less than the thickness of the sorting head 312 and the sensor arrangement 1162' needs to be positioned closer to the rotatable disk positioned below the lower surface 340 of the sorting head 312, the top surface of the sorting head 312 may be lowered (e.g., machined away), if necessary to arrange the sensor arrangement 1162' at the appropriate vertical position. Note a housing such as housing 1164 having a lower portion having a reduced cross-section and one or more shoulders and a shoulder distance $SH_{11}$ of about 11-14 mm may employed according to some embodiments in connection with sensor arrangements 1262 and/or 1362 including where the sensor arrangement has light sources 1168, 1368 on opposing sides of the area where coins 11 are to be scanned as in FIG. 13.

Figure 13:
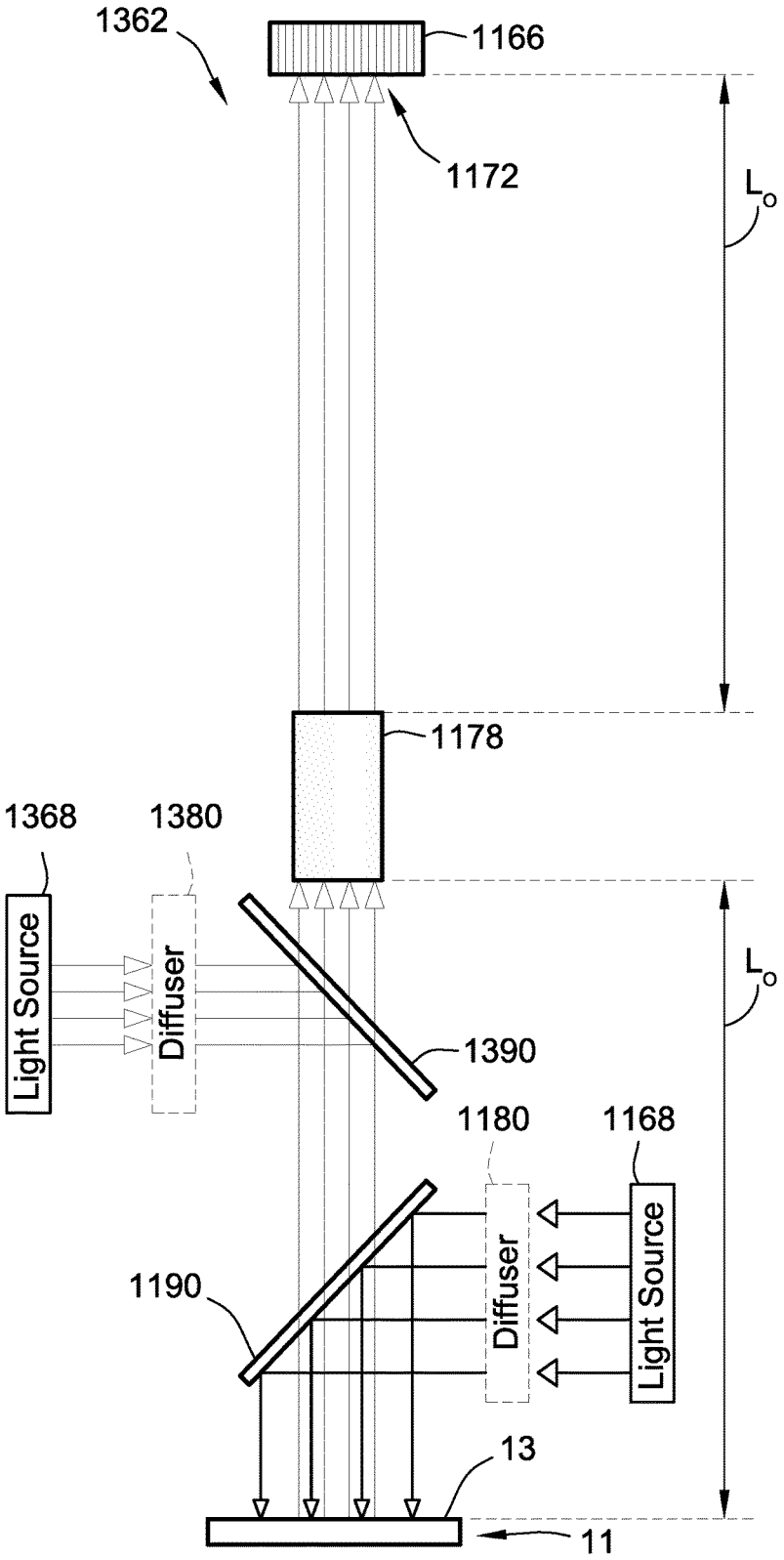
FIG. 13 is a schematic illustration of yet other examples of a linear optical sensor arrangement in accordance with aspects of the present disclosure.

Shown in FIGS. 12 and 13 are alternative architectures for the linear optical sensors of the sensor array 350 of FIG. 6 and/or alternative architectures for the near-normal angle of incidence light sources 367, 371, 467, and/or 567 of FIGS. 7-9. According to some embodiments, except for potentially selecting a different SELFOC lens having the appropriate working distance (Lo), the configurations of FIGS. 7-9 may otherwise remain unchanged including the presence of high-angle light sources (e.g., light sources 369, 373, 471, and 571) and their related structures with the light sources 1168, 1368 and mirror(s) 1190,1390 being provided in place of or in addition to the near-normal light sources described above in conjunction with FIGS. 7-9 such as light sources, e.g., light emitting diodes 367, 371, 467, 567. According to some embodiments, high-angle light sources such as, e.g., light sources 369, 373, 471, and 571, are not included and the sensor arrangements 1262, 1362 only include the normal or near-normal illumination. Unless otherwise logically prohibited, the architectures shown in FIGS. 12 and 13 may include any of the features, options and alternatives described above with respect to the architectures in FIGS. 6-9 and 11A-11B, and vice versa.

FIGS. 12 and 13 are schematic illustrations of yet other examples of linear optical sensor arrangements in accordance with aspects of the present disclosure. The embodiment of the sensor arrangement 1262 of FIG. 12 illustrates the use of multiple photodetectors 1166, 1266 but otherwise may be the same as described above in connection with FIGS. 11A and 11B. Like the photodetector 366 of FIG. 7, the photodetectors 1166, 1266 of FIG. 12 comprise linear arrays of light-sensitive photosensors 1172, 1272 that detect the presence of visible light, infrared light (IR), and/or ultraviolet light (UV) energy. According some embodiments, one or more half mirrors 1290 are employed to re-direct some of the light reflected from the surface 13 of a passing coin 11 and through the lens 1178 to the photodetector 1266. In some embodiments, the photodetectors 1166, 1266 are employed to sense light of different wavelengths. According to some embodiments, filters 1250*a*, 1250*b* may be placed in front of one or both of the photodetectors 1166, 1266 and/or in front of select ones of the photosensors 1172, 1272 so that photodetectors 1166, 1266 and/or select ones of the photosensors 1172, 1272 are responsive to select wavelengths of light. For example, photodetectors 1166 (with or without the use of filter 1250*b*) may be responsive to only visible light while photodetectors 1266 (with or without the use of filter 1250*a*) may be responsive to only infrared light. As another example, select ones of the photosensors 1272 (with or without the use of filter 1250*a*) may be responsive to only ultraviolet light while other ones of the photosensors 1272 (with or without the use of filter 1250*a*) may be responsive to only infrared light. Additionally or alternatively, filters 1250*a*, 1250*b* may be placed in front of single or multiple ones of the light sources 1168. According to some embodiments, different photodetectors/sensors may be employed with the different photodetectors/sensors being responsive to detection of different wavelengths of light, e.g., some photodetectors/sensors may be responsive to UV light but not be responsive to IR light and/or visible light, and vice versa. For example, according to some embodiments, one or more types of photodetectors/photosensors are employed to detect different wavelengths of illumination such as, for example, GaAsP detectors detecting light in the 200-800 nm range, Ge detectors detecting light in the 600-1700 nm range and InGaAs detectors detecting light in the 800-1900 nm, and/or Silicon sensors detecting light in the 200-1100 nm range.

According to some embodiments, the illumination of a passing coin 11 with different wavelengths of light is synchronized with the sensing of light by one or more of the photodetectors 1166, 1266 and/or some or all of the photosensors 1172, 1272. For example, in some embodiments, in a first period of time a coin 11 may be illuminated with only ultraviolet light and readings taken from the photodetectors 1166, 1266 and/or some or all of the photosensors 1172, 1272 while in a second period of time the coin 11 may be illuminated with only visible light and readings taken from the photodetectors 1166, 1266 and/or some or all of the photosensors 1172, 1272 and/or in a third period of time the coin 11 may be illuminated with only infrared light and readings taken from the photodetectors 1166, 1266 and/or some or all of the photosensors 1172, 1272. A processor such as processor 338 may be used to control the time of the activation of different light sources and/or the sampling of different photodetectors 1166, 1266 and/or some or all of the photosensors 1172, 1272. According to some embodiments the switching the wavelength of light of the illumination will allow multi-wavelength imaging of the coin.

According to some embodiments, multiple detectors such as for example, photodetectors 1166, 1266 including high and low resolution arrays of detectors may be employed for detecting multiple wavelengths of light.

The embodiment of the sensor arrangement 1362 of FIG. 13 illustrates the use of light sources 1168, 1368 positioned on opposite sides of a location at which a coin is to be illuminated but otherwise may be the same as described above in connection with FIGS. 11A, 11B, and/or 12. As shown in FIG. 13, according to some embodiments, first 1168 and second 1368 light sources or light emitting devices may be positioned on opposite sides of cover glass 1176. According to some embodiments, the light sources 1168, 1368 generate light having the same range of wavelengths, e.g., broadband illumination including UV, visible, and IR light. According to some embodiments, the light sources 1168, 1368 generate light having the different ranges of wavelengths, e.g., light source 1168 may generate visible light and light source 1368 may generate UV or IR light. According to some embodiments, more than two light sources may be employed, e.g., one for UV light, one for visible light, and one for IR light. As described above, light of different wavelengths may be sequentially or simultaneously used to illuminate the surface 13 of a passing coin 11 and the activation of the one or more light sources may be controlled by a processor such as processor 338 and may be synchronized with sampling by one or more photodetectors 1166, 1266 and/or some or all of the photosensors 1172, 1272. Selection of the wavelengths of light detected by sensors could be controlled by using selective wavelengths illumination or filters in the detectors optical path.

Although not illustrated, as mentioned above, according the some embodiments, the sensor arrangements 1262 and 1362 of FIGS. 12 and 13 may comprise second light emitting devices comprising one or more light sources for controllably emitting light onto the surface 13 of the passing coin 11 at high-angle incidence (such as light sources 369, 373, 471, and 571). As described above, in embodiments employing both near-normal light sources 1168 and high-angle light sources, a processor such as processor 338 may operate or activate the near-normal light sources 1168 and high-angle light sources either simultaneously or with only the near-normal light source 1168 being illuminated, or only the high-angle light sources being turned on at any given time to vary the type of illumination incident on the surface 13 of a passing coin 11.

According to some embodiments, the one or more half mirrors 1190, 1290, 1390 are 50/50 mirrors for reflection and transmission. Optical waveguides may also be optionally employed to direct light from light sources 1168, 1368 onto the surface 13 of the coin 11 and/or onto one or more of the half mirrors 1190, 1390.

According to some embodiments, the lens 1178 may be a SELFOC lens.

The architectures of FIGS. 12 and 13 may also utilize one or more light diffusing elements 1180, 1380 operable to diffuse light emitted by the light source(s) 1168, 1368. According to some embodiments, one or more sections of the inside walls 1164*a* of the sensor housing 1164 (such as near cover glass 1176) are coated by scattering media to provide efficient and uniform illumination.

According to some embodiments, multiple rows of LEDs and/or waveguides may be employed to provide a wider area of illumination. While some of the above embodiments are described as employing LED arrays, desired illumination may be obtained without employing linear arrays of LEDs. For example, waveguides may direct light to the desired locations with the desired distribution over a scan area (e.g., the surface of a passing coin) with or without employing linear arrays of LEDs. For example, waveguide may be employed to appropriately diffuse light over a desired scan area. Some exemplary materials that may be employed in waveguides include glass, quartz, and plastic.

According to some embodiments, the sensor arrangements 1162, 1162', 1262, 1362 of FIGS. 11A, 11B, 12 and 13 enable high-speed real-time imaging of a moving coin. According to some embodiments, the coin processing unit 200 of FIG. 4 employing the sensor arrangements 1162, 1162', 1262, and/or 1362 process coins of a plurality of denominations (mixed coins) at a rate of 3,100 coins per minute and the sensor arrangements 1162, 1162', 1262, and/or 1362 image the coins at that rate. According to some embodiments, the coin processing unit 200 of FIG. 4 employing the sensor arrangements 1162, 1162', 1262, and/or 1362 process coins of a plurality of denominations (mixed coins) at a rate of at least 1,000 to 4,000 coins per minute and the sensor arrangements 1162, 1162', 1262, and/or 1362 image the coins at that rate. According to some embodiments, the coin processing unit 200 of FIG. 4 employing the sensor arrangements 1162, 1162', 1262, and/or 1362 process coins of a single of denomination at a rate of 10,000-12,000 coins per minute and the sensor arrangements 1162, 1162', 1262, and/or 1362 image the coins at that rate. According to some embodiments, the coin processing unit 200 of FIG. 4 employing the sensor arrangements 1162, 1162', 1262, and/or 1362 process coins of a single of denomination at a rate of at least 10,000 coins per minute and the sensor arrangements 1162, 1162', 1262, and/or 1362 image the coins at that rate. According to some embodiments, the coin processing unit 200 of FIG. 4 employing the sensor arrangements 1162, 1162', 1262, and/or 1362 process coins of a plurality of denominations (mixed coins) at a rate wherein the rotatable disk 214 and the resilient pad 218 rotate at a rate of at least about 400 revolutions per minute (rpm) and the sensor arrangements 1162, 1162', 1262, and/or 1362 image the coins at that rate.

According to some embodiments, the coin processing unit 200 of FIG. 4 employing the sensor arrangements 1162, 1162', 1262, and/or 1362 employs a sorting head 212 having an 11-inch diameter and a rotating disk 214 and pad 222 that has a normal operating speed of 320-360 revolutions per minute (rpm). According to some such embodiments, the disk is rotated at a normal operating speed of 320 rpm and coins passing by under the sorting head 212 are imaged by the sensor arrangements 1162, 1162', 1262, and/or 1362 when the disk is rotating at 320 rpm with a linear speed of at least 9,000 inches per minute. According to some such embodiments, the disk is rotated at a normal operating speed of 360 rpm and coins pass by and are imaged by the sensor arrangements 1162, 1162', 1262, and/or 1362 when the disk is rotating at 360 rpm with a linear speed of at least 10,000 inches per minute or at least 11,000 inches per minute. According to some such embodiments, the disk is rotated at a higher operating speed of 500 rpm and coins pass by and are imaged by the sensor arrangements 1162, 1162', 1262, and/or 1362 when the disk is rotating at 500 rpm with a linear speed of at least 15,000 inches per minute. It should be noted that according to some embodiments, the speed of rotation of the disk is monitored by an encoder and the sensor arrangements 1162, 1162', 1262, and/or 1362 are controlled by a processor such as processor 338 so that even as the disk is slowing down (such as when it is needed to stop the rotation of the disk) or speeding up (such as when starting up the rotation of the disk after it has been stopped), the coin processing unit 200 of FIG. 4 is still able to image the passing coins even though their speed of movement past the sensor arrangements 1162, 1162', 1262, and/or 1362 is changing and/or is below their speed when the disk is rotating at a normal operating speed.

According to some embodiments, the sensor arrangements 1162, 1162', 1262, 1362 of FIGS. 11A, 11B, 12 and 13 enable speed independent operation such as by employing an encoder which monitors the rotation of the rotatable disk 214 and the resilient pad 218 disposed on therein which in turn can be used to monitor and track the movement of coins disposed on the surface of the resilient pad. The output of the encoder can be used by a processor such as processor 338 to adjust the sampling times of linear optical sensors (or "sensor arrangements") 362, 462, 562, 650, 1162, 1162' 1262 and/or 1362 and/or the timing of activating the various light sources and/or LEDs discussed above in connection with FIGS. 7-13. For example, as the speed of the rotatable disk 214 is increased, the processor 338 may increase the rate at which the outputs of these sensor arrangements 362, 462, 562, 650, 1162, 1162' 1262 and/or 1362 are sampled and/or increase the rate and/or adjust the timing of when the various light sources and/or LEDs discussed above in connection with FIGS. 7-13 are turned on. Likewise, as the speed of the rotatable disk 214 is decreased, the processor 338 may decrease the rate at which the outputs of these sensor arrangements 362, 462, 562, 650, 1162, 1162', 1262 and/or 1362 are sampled and/or decrease the rate and/or adjust the timing of when the various light sources and/or LEDs discussed above in connection with FIGS. 7-13 are turned on. As a result, the resulting images obtained may be independent of the speed of the rotatable disk 214 and the speed at which a coin to be imaged passes the sensor arrangements 362, 462, 562, 650, 1162, 1162', 1262 and/or 1362. Aspects of the present disclosure are distinguishable from other coin-imaging apparatuses that are commercially available by utilizing a linear, low-cost sensor array instead of utilizing a conventional two-dimensional (2D) imaging camera. 2D cameras are slow, costly, and difficult to implement in many coin sorters because of the required large window for imaging. Aspects of the present disclosure solve these issues by utilizing a high-speed linear sensor array that only requires a narrow window in the coin sorter. In addition, aspects of this disclosure enable capturing two different types of images: uniform illumination to reveal coin surface details, and high-angle illumination to produce edge-enhanced images to reveal surface topography variations and coin wear. Additionally, the sensor image capture mode can be reconfigured in real time to (1) switch between the two different types of images, and (2) simultaneously capture both types of images by simple electronic control. One or more of the sensor systems disclosed herein can produce an image of a coin that reveals details on the surface of the coin regardless of topography.

ALTERNATIVE EMBODIMENTS

Embodiment 1

A high-speed currency processing system comprising:

a housing with a coin input area configured to receive a batch of coins;

one or more coin receptacles operatively coupled to the housing;

a coin processing unit operatively coupled to the coin input area and the one or more coin receptacles, the coin processing unit being configured to process a plurality of the coins and discharge the processed coins to the one or more coin receptacles; and a sensor arrangement operatively coupled to the coin processing unit, the sensor arrangement including a photodetector and first and second light emitting devices, the first light emitting device being configured to emit light onto a surface of a passing coin at normal or near-normal incidence, the second light emitting device being configured to emit light onto the surface of the passing coin at high-angle incidence, and the photodetector being configured to sense light reflected off the surface of the passing coin and output a signal indicative of coin image information for processing the coin;

wherein the coins pass the sensor arrangement and the sensor arrangement outputs a signal indicative of coin image information at a rate of at least 2000 coins per minute.

Embodiment 2

The currency processing system of Embodiment 1, wherein the photodetector includes a linear array of photosensors with a normal incidence with the surface of the passing coin.

Embodiment 3

The currency processing system of Embodiment 1, further comprising a lens array between the photodetector and the passing coin.

Embodiment 4

The currency processing system of Embodiment 3, wherein the lens array includes a gradient-index (GRIN) lens array or a SELFOC lens array.

Embodiment 5

The currency processing system of Embodiment 1, wherein the first light emitting device comprises light sources configured to emit light onto the surface of the passing coin at a first near-normal incidence and a first high-angle of incidence, and the second light emitting device comprises light sources configured to emit light onto the surface of the passing coin at a second near-normal incidence and a second high-angle of incidence

Embodiment 6

The currency processing system of Embodiment 5, wherein the light sources of the first light emitting device include first and second rows of light emitting diodes (LED), and the light sources of the second light emitting device include third and fourth rows of LEDs.

Embodiment 7

The currency processing system of Embodiment 1, further comprising a processor operatively coupled to the sensor arrangement and operable to selectively simultaneously activate both the first and second light emitting devices to thereby provide both high-angle and near-normal illumination of the surface of the passing coin.

Embodiment 8

The currency processing system of Embodiment 7, wherein the processor is further operable to selectively activate the second light emitting device and thereby provide only high-angle illumination of the surface of the passing coin.

Embodiment 9

The currency processing system of Embodiment 1, further comprising a light diffusing element operable to diffuse high-angle incidence light emitted by the second light emitting device.

Embodiment 10

The currency processing system of Embodiment 1, further comprising a cylindrical lens and a light scattering element operable to scatter high-angle incidence light emitted by the second light emitting device.

Embodiment 11

The currency processing system of Embodiment 1, further comprising a processor operatively coupled to the sensor arrangement to receive the coin image information signals and determine therefrom whether the passing coin is valid or invalid.

Embodiment 12

The currency processing system of Embodiment 1, further comprising a processor operatively coupled to the sensor arrangement to receive the coin image information signals and determine therefrom a country, a denomination, a fitness, or an authenticity, or any combination thereof, of the passing coin.

Embodiment 13

The currency processing system of Embodiment 1, wherein the sensor arrangement is configured to sense all or substantially all of a top surface of the passing coin.

Embodiment 14

A high-speed coin processing machine comprising:

a housing with an input area configured to receive therethrough a batch of coins;

a plurality of coin receptacles stowed inside the housing;

a processor stored inside the housing; and a disk-type coin processing unit disposed at least partially inside the housing and operatively coupled to the coin input area and the plurality of coin receptacles to transfer coins therebetween, the coin processing unit including:

a rotatable disk configured to support on an upper surface thereof and impart motion to a plurality of coins received from the coin input area, a stationary sorting head having a lower surface generally parallel to and spaced slightly apart from the rotatable disk, the lower surface forming a plurality of exit channels configured to guide the coins, under the motion imparted by the rotatable disk, to a plurality of exit stations through which the coins are discharged from the coin processing unit to the plurality of coin receptacles, and a sensor arrangement mounted to the sorting head facing the rotatable disk, the sensor arrangement including a linear array of photosensors and first and second rows of LEDs, the first row of LEDs being configured to emit light onto respective surfaces of passing coins at near-normal incidence, the second row of LEDs being configured to emit light onto the respective surfaces of the passing coins at high-angle incidence, and the linear array of photosensors having a normal incidence with the surfaces of the passing coins and being configured to sense light reflected off the respective surfaces of the passing coins and output signals indicative thereof, wherein the processor is configured to receive the coin image signals from the sensor arrangement and generate therefrom multiple images of the respective surfaces of each of the passing coins for processing the coins with the rotatable disk turning at a rate of at least 120 rpm.

Embodiment 15

A high-speed coin imaging sensor system for a coin processing apparatus, the coin processing apparatus including a housing with an input area for receiving coins, a coin receptacle for stowing processed coins, a coin sorting device for separating coins by denomination, and a coin transport mechanism for transferring coins from the input area, through the coin sorting device, to the coin receptacle, the coin imaging sensor system comprising:

a sensor arrangement configured to mount inside the housing adjacent the coin transport mechanism upstream of the coin receptacle and downstream from the coin input area, the sensor arrangement including a photodetector and first and second light emitting devices, the first light emitting device being configured to emit light onto a surface of a passing coin at near-normal incidence, the second light emitting device being configured to emit light onto the surface of the passing coin at high-angle incidence, and the photodetector being configured to sense light reflected off the surface of the passing coin and output a signal indicative of coin image information;

an image processing circuit operatively coupled to the sensor arrangement and configured to process the coin image information signal output therefrom; and a processor operatively coupled to the image processing circuit and configured to analyze the processed signals and generate therefrom an image for the passing coin wherein the coins pass the sensor arrangement, the sensor arrangement outputs a signal indicative of coin image information, and the processor generates an image of each passing coin at a rate of at least 2000 coins per minute.

Embodiment 16

The coin imaging sensor system of Embodiment 15, wherein the photodetector includes a linear array of photosensors with a normal incidence with the surface of the passing coin.

Embodiment 17

The coin imaging sensor system of Embodiment 15, further comprising a lens or a lens array between the photodetector and the passing coin.

Embodiment 18

The coin imaging sensor system of Embodiment 15, wherein the first light emitting device comprises light sources configured to emit light onto the surface of the passing coin at a first near-normal incidence and a first high-angle of incidence, and the second light emitting device comprises light sources configured to emit light onto the surface of the passing coin at a second near-normal incidence and a second high-angle of incidence.

Embodiment 19

The coin imaging sensor system of Embodiment 18, wherein the light sources of the first light emitting device include first and second rows of light emitting diodes (LED), and the light sources of the second light emitting device include third and fourth rows of LEDs.

Embodiment 20

The coin imaging sensor system of Embodiment 15, wherein the processor is further operable to selectively simultaneously activate both the first and second light emitting devices to thereby provide both high-angle and near-normal illumination of the surface of the passing coin.

Embodiment 21

The currency processing system of Embodiment 1, wherein a coin processing unit comprises a rotatable disk configured to support on an upper surface thereof and impart motion to a plurality of coins received from the coin input area, and a stationary sorting head having an eleven inch diameter having a lower surface generally parallel to and spaced slightly apart from the rotatable disk, the lower surface forming a plurality of exit channels configured to guide the coins, under the motion imparted by the rotatable disk, to a plurality of exit stations through which the coins are discharged from the coin processing unit to a plurality of coin receptacles.

Embodiment 22

The currency processing system of Embodiment 1, wherein the rotatable disk rotates at a rate of at least 300 rpm.

Embodiment 23

The currency processing system of Embodiment 1, wherein the coins pass the sensor arrangement and the sensor arrangement outputs a signal indicative of coin image information at a rate of at least 3000 coins per minute.

Embodiment 24

The currency processing system of Embodiment 23, wherein a coin processing unit comprises a rotatable disk configured to support on an upper surface thereof and impart motion to a plurality of coins received from the coin input area, and a stationary sorting head having an eleven inch diameter having a lower surface generally parallel to and spaced slightly apart from the rotatable disk, the lower surface forming a plurality of exit channels configured to guide the coins, under the motion imparted by the rotatable disk, to a plurality of exit stations through which the coins are discharged from the coin processing unit to a plurality of coin receptacles.

Embodiment 25

The currency processing system of Embodiment 24, wherein the rotatable disk rotates at a rate of at least 300 rpm.

Embodiment 26

The high-speed coin processing machine of Embodiment 14, wherein the processor is configured to receive the coin image signals from the sensor arrangement and generate therefrom multiple images of the respective surfaces of each of the passing coins at a rate of at least 2000 coins per minute.

Embodiment 27

The high-speed coin processing machine of Embodiment 14, wherein the stationary sorting head has a diameter of eleven (11) inches.

Embodiment 28

The high-speed coin processing machine of Embodiment 14, wherein the processor is configured to receive the coin image signals from the sensor arrangement and generate therefrom multiple images of the respective surfaces of each of the passing coins at a rate of at least 3000 coins per minute.

Embodiment 29

The high-speed coin processing machine of Embodiment 28, wherein the stationary sorting head has a diameter of eleven (11) inches.

Embodiment 30

The coin imaging sensor system of Embodiment 15, wherein the coins pass the sensor arrangement, the sensor arrangement outputs a signal indicative of coin image information, and the processor generates an image of each passing coin at a rate of at least 3000 coins per minute.

Embodiment 31

A currency processing system comprising:

a housing with a coin input area configured to receive a batch of coins;

one or more coin receptacles operatively coupled to the housing;

a coin processing unit operatively coupled to the coin input area and the one or more coin receptacles, the coin processing unit being configured to process a plurality of the coins and discharge the processed coins to the one or more coin receptacles; and a sensor arrangement operatively coupled to the coin processing unit, the sensor arrangement including a photodetector and a first light emitting device, the first light emitting device being configured to emit light in a generally horizontal direction onto a surface of a half-mirror, the half-mirror being oriented at about 45° to the horizontal direction, the half-mirror being configured to re-direct at least some of the light in a generally vertical direction and onto a passing coin at normal or near-normal angle of incidence and the photodetector being configured to sense light reflected off the surface of the passing coin and passed through the half-mirror and output a signal indicative of coin image information for processing the coin.

Embodiment 32

The currency processing system of Embodiment 31 further comprising of a second light emitting device being configured to emit light onto the surface of the passing coin at high-angle incidence.

Embodiment 33

The currency processing system of Embodiment 31 further comprising a processor configured to receive the signal indicative of coin image information and generate an image of the passing coin at a rate of at least 1,000 coins per minute.

Embodiment 34

The currency processing system of Embodiment 31 further comprising a processor configured to receive the signal indicative of coin image information and generate an image of the passing coin at a rate of at least 2,000 coins per minute.

Embodiment 35

The currency processing system of Embodiment 31 further comprising a processor configured to receive the signal indicative of coin image information and generate an image of the passing coin at a rate of at least 3,000 coins per minute.

Embodiment 36

The currency processing system of Embodiment 31, further comprising a light diffusing element positioned between the first light emitting device and the half-mirror.

Embodiment 37

A coin processing machine comprising:

a housing with an input area configured to receive therethrough a batch of coins;

a plurality of coin receptacles stowed inside the housing;

a processor stored inside the housing; and a disk-type coin processing unit disposed at least partially inside the housing and operatively coupled to the coin input area and the plurality of coin receptacles to transfer coins therebetween, the coin processing unit including:

a rotatable disk configured to support on an upper surface thereof and impart motion to a plurality of coins received from the coin input area, a stationary sorting head having a lower surface generally parallel to and spaced slightly apart from the rotatable disk, the lower surface forming a plurality of exit channels configured to guide the coins, under the motion imparted by the rotatable disk, to a plurality of exit stations through which the coins are discharged from the coin processing unit to the plurality of coin receptacles, and a sensor arrangement mounted to the sorting head facing the rotatable disk, the sensor arrangement including a linear array of photosensors and a first light source being configured to emit light in a generally horizontal direction onto a surface of a half-mirror, the half-mirror being oriented at about 45° to the horizontal direction, the half-mirror being configured to re-direct at least some of the light in a generally vertical direction and onto respective surfaces of passing coins at normal or near-normal angle of incidence and the linear array of photosensors having a normal incidence with the surfaces of the passing coins and being configured to sense light reflected off the respective surfaces of the passing coins and passed through the half-mirror and output signals indicative thereof, wherein the processor is configured to receive the coin image signals from the sensor arrangement and generate therefrom multiple images of the respective surfaces of each of the passing coins.

Embodiment 38

The coin processing machine of Embodiment 37 further comprising a second light source configured to emit light onto the respective surfaces of the passing coins at high-angle incidence.

Embodiment 39

The coin processing machine of Embodiment 37 wherein the rotatable disk rotates at a rate of at least 120 rpm.

Embodiment 40

The coin processing machine of Embodiment 37 wherein the first light source comprises one or more light sources, collectively, generating light of a plurality of wavelengths.

Embodiment 41

The coin processing machine of Embodiment 40 wherein the plurality of wavelengths comprise visible light and infrared light.

Embodiment 42

The coin processing machine of Embodiment 40 wherein the plurality of wavelengths comprise visible light and ultraviolet light.

Embodiment 43

The coin processing machine of Embodiment 40 wherein the plurality of wavelengths comprise ultraviolet light and infrared light.

Embodiment 44

The coin processing machine of Embodiment 40 wherein the plurality of wavelengths comprise visible light, ultraviolet light and infrared light.

Embodiment 45

The coin processing machine of Embodiment 40 further comprising one or more light filters positioned in front of the one or more of the photosensors.

Embodiment 46

The coin processing machine of Embodiment 45 wherein the one or more light filters permit only visible light to reach the one or more of the photosensors.

Embodiment 47

The coin processing machine of Embodiment 45 wherein the one or more light filters permit only infrared light to reach the one or more of the photosensors.

Embodiment 48

The coin processing machine of Embodiment 45 wherein the one or more light filters permit only ultraviolet light to reach the one or more of the photosensors.

Embodiment 49

The coin processing machine of Embodiment 45 wherein the one or more light filters permit only visible light to reach a first group of the one or more of the photosensors and permit only infrared light to reach a second group of the one or more of the photosensors.

Embodiment 50

The coin processing machine of Embodiment 45 wherein the one or more light filters permit only visible light to reach a first group of the one or more of the photosensors and permit only ultraviolet light to reach a second group of the one or more of the photosensors.

Embodiment 51

The coin processing machine of Embodiment 45 wherein the one or more light filters permit only visible light to reach a first group of the one or more of the photosensors, permit only ultraviolet light to reach a second group of the one or more of the photosensors, and permit only infrared light to reach a third group of the one or more of the photosensors.

Embodiment 52

A coin imaging sensor system for a coin processing apparatus, the coin processing apparatus including a housing with an input area for receiving coins, a coin receptacle for stowing processed coins, a coin sorting device for separating coins by denomination, and a coin transport mechanism for transferring coins from the input area, through the coin sorting device, to the coin receptacle, the coin imaging sensor system comprising:

a sensor arrangement configured to mount inside the housing adjacent the coin transport mechanism upstream of the coin receptacle and downstream from the coin input area, the sensor arrangement including a photodetector and a first light source, the first light source being configured to emit light in a generally horizontal direction onto a surface of a half-mirror, the half-mirror being oriented at about 45° to the horizontal direction, the half-mirror being configured to re-direct at least some of the light in a generally vertical direction and onto a surface of a passing coin at a normal or near-normal angle of incidence, and the photodetector being configured to sense light reflected off the surface of the passing coin and passed through the half-mirror and output a signal indicative of coin image information;

an image processing circuit operatively coupled to the sensor arrangement and configured to process the coin image information signal output therefrom; and a processor operatively coupled to the image processing circuit and configured to analyze the processed signals and generate therefrom an image for the passing coin.

Embodiment 53

The coin imaging sensor system of Embodiment 52 further comprising a second light source being configured to emit light onto the surface of the passing coin at high-angle incidence.

Embodiment 54

The coin imaging sensor system of Embodiment 53 wherein the coins pass the sensor arrangement, the sensor arrangement outputs a signal indicative of coin image information, and the processor generates an image of each passing coin at a rate of at least 2000 coins per minute.

Embodiment 55

The coin imaging sensor system of Embodiment 52 wherein the coins pass the sensor arrangement, the sensor arrangement outputs a signal indicative of coin image information, and the processor generates an image of each passing coin at a rate of at least 2000 coins per minute.

Embodiment 56

The coin imaging sensor system of Embodiment 52 wherein the first light source comprises one or more light sources, collectively, generating light of a plurality of wavelengths.

Embodiment 57

The coin imaging sensor system of Embodiment 56 wherein the plurality of wavelengths comprise visible light and infrared light.

Embodiment 58

The coin imaging sensor system of Embodiment 56 wherein the plurality of wavelengths comprise visible light and ultraviolet light.

Embodiment 59

The coin imaging sensor system of Embodiment 56 wherein the plurality of wavelengths comprise ultraviolet light and infrared light.

Embodiment 60

The coin imaging sensor system of Embodiment 56 wherein the plurality of wavelengths comprise visible light, ultraviolet light and infrared light.

Embodiment 61

The coin imaging sensor system of Embodiment 56 wherein the photodetector comprises a plurality of photosensors and further comprising one or more light filters positioned in front of the one or more of the photosensors.

Embodiment 62

The coin imaging sensor system of Embodiment 61 wherein the one or more light filters permit only visible light to reach the one or more of the photosensors.

Embodiment 63

The coin imaging sensor system of Embodiment 61 wherein the one or more light filters permit only infrared light to reach the one or more of the photosensors.

Embodiment 64

The coin imaging sensor system of Embodiment 61 wherein the one or more light filters permit only ultraviolet light to reach the one or more of the photosensors.

Embodiment 65

The coin imaging sensor system of Embodiment 61 wherein the one or more light filters permit only visible light to reach a first group of the one or more of the photosensors and permit only infrared light to reach a second group of the one or more of the photosensors.

Embodiment 66

The coin imaging sensor system of Embodiment 61 wherein the one or more light filters permit only visible light to reach a first group of the one or more of the photosensors and permit only ultraviolet light to reach a second group of the one or more of the photosensors.

Embodiment 67

The coin imaging sensor system of Embodiment 61 wherein the one or more light filters permit only infrared light to reach a first group of the one or more of the photosensors and permit only ultraviolet light to reach a second group of the one or more of the photosensors.

Embodiment 68

The coin imaging sensor system of Embodiment 61 wherein the one or more light filters permit only visible light to reach a first group of the one or more of the photosensors, permit only ultraviolet light to reach a second group of the one or more of the photosensors, and permit only infrared light to reach a third group of the one or more of the photosensors.

Embodiment 69

A high-speed currency processing system comprising:

a housing with a coin input area configured to receive a batch of coins;

one or more coin receptacles operatively coupled to the housing;

a coin processing unit operatively coupled to the coin input area and the one or more coin receptacles, the coin processing unit being configured to process a plurality of the coins and discharge the processed coins to the one or more coin receptacles; and a sensor arrangement operatively coupled to the coin processing unit, the sensor arrangement including a photodetector and at least one light emitting device, the light emitting device being configured to emit light onto a surface of a passing coin, and the photodetector being configured to sense light reflected off the surface of the passing coin and output a signal indicative of coin image information for processing the coin;

wherein the coins pass the sensor arrangement and the sensor arrangement outputs a signal indicative of coin image information at a rate of at least 2000 coins per minute.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims. Moreover, this disclosure expressly includes any and all combinations and subcombinations of the preceding elements and aspects.

What is claimed:

1. A high-speed currency processing system comprising:

a housing with a coin input area configured to receive a batch of coins;

one or more coin receptacles operatively coupled to the housing;

a coin processing unit operatively coupled to the coin input area and the one or more coin receptacles, the coin processing unit being configured to process a plurality of the coins and discharge the processed coins to the one or more coin receptacles; and a sensor arrangement operatively coupled to the coin processing unit, the sensor arrangement including a photodetector and first and second light emitting devices, the first light emitting device being configured to emit light onto a surface of a passing coin at normal or near-normal incidence, the second light emitting device being configured to emit light onto the surface of the passing coin at high-angle incidence, and the photodetector being configured to sense light reflected off the surface of the passing coin and output a signal indicative of coin image information for processing the coin;

wherein the coins pass the sensor arrangement and the sensor arrangement outputs a signal indicative of coin image information at a rate of at least 2000 coins per minute;

wherein the photodetector includes a linear array of photosensors with a normal incidence with the surface of the passing coin.

2. The currency processing system of claim 1, further comprising a light diffusing element operable to diffuse high-angle incidence light emitted by the second light emitting device.

3. The currency processing system of claim 1, further comprising a cylindrical lens and a light scattering element operable to scatter high-angle incidence light emitted by the second light emitting device.

4. The currency processing system of claim 1, further comprising a processor operatively coupled to the sensor arrangement to receive the coin image information signals and determine therefrom whether the passing coin is valid or invalid.

5. The currency processing system of claim 1, further comprising a processor operatively coupled to the sensor arrangement to receive the coin image information signals and determine therefrom a denomination, a fitness, or an authenticity, or any combination thereof, of the passing coin.

6. The currency processing system of claim 1, wherein the sensor arrangement is configured to sense all or substantially all of a top surface of the passing coin.

7. The currency processing system of claim 1, further comprising a lens array between the photodetector and the passing coin.

8. The currency processing system of claim 7, wherein the lens array includes a gradient-index (GRIN) lens array or a SELFOC lens array.

9. The currency processing system of claim 1, wherein the first light emitting device comprises light sources configured to emit light onto the surface of the passing coin at a first near-normal incidence and a first high-angle of incidence, and the second light emitting device comprises light sources configured to emit light onto the surface of the passing coin at a second near-normal incidence and a second high-angle of incidence.

10. The currency processing system of claim 9, wherein the light sources of the first light emitting device include first and second rows of light emitting diodes (LED), and the light sources of the second light emitting device include third and fourth rows of LEDs.

11. The currency processing system of claim 1, further comprising a processor operatively coupled to the sensor arrangement and operable to selectively simultaneously activate both the first and second light emitting devices to thereby provide both high-angle and near-normal illumination of the surface of the passing coin.

12. The currency processing system of claim 11, wherein the processor is further operable to selectively activate the second light emitting device and thereby provide only high-angle illumination of the surface of the passing coin.

13. A high-speed coin imaging sensor system for a coin processing apparatus, the coin processing apparatus including a housing with an input area for receiving coins, a coin receptacle for stowing processed coins, a coin sorting device for separating coins by denomination, and a coin transport mechanism for transferring coins from the input area, through the coin sorting device, to the coin receptacle, the coin imaging sensor system comprising:

a sensor arrangement configured to mount inside the housing adjacent the coin transport mechanism upstream of the coin receptacle and downstream from the coin input area, the sensor arrangement including a photodetector and first and second light emitting devices, the first light emitting device being configured to emit light onto a surface of a passing coin at near-normal incidence, the second light emitting device being configured to emit light onto the surface of the passing coin at high-angle incidence, and the photodetector being configured to sense light reflected off the surface of the passing coin and output a signal indicative of coin image information;

an image processing circuit operatively coupled to the sensor arrangement and configured to process the coin image information signal output therefrom; and a processor operatively coupled to the image processing circuit and configured to analyze the processed signals and generate therefrom an image for the passing coin wherein the coins pass the sensor arrangement, the sensor arrangement outputs a signal indicative of coin image information, and the processor generates an image of each passing coin at a rate of at least 2000 coins per minute;

wherein the photodetector includes a linear array of photosensors with a normal incidence with the surface of the passing coin.

14. The coin imaging sensor system of claim 13, further comprising a lens array between the photodetector and the passing coin.

15. The coin imaging sensor system of claim 13, wherein the processor is further operable to selectively simultaneously activate both the first and second light emitting devices to thereby provide both high-angle and near-normal illumination of the surface of the passing coin.

16. The coin imaging sensor system of claim 13, wherein the first light emitting device comprises light sources configured to emit light onto the surface of the passing coin at a first near-normal incidence and a first high-angle of incidence, and the second light emitting device comprises light sources configured to emit light onto the surface of the passing coin at a second near-normal incidence and a second high-angle of incidence.

17. The coin imaging sensor system of claim 16, wherein the light sources of the first light emitting device include first and second rows of light emitting diodes (LED), and the light sources of the second light emitting device include third and fourth rows of LEDs.

* * * * *